US006569589B2

(12) United States Patent
Inaba et al.

(10) Patent No.: US 6,569,589 B2
(45) Date of Patent: May 27, 2003

(54) TONER, TONER PRODUCTION PROCESS AND IMAGE FORMING METHOD

(75) Inventors: Koji Inaba, Odawara (JP); Hiroaki Kawakami, Yokohama (JP); Tatsuya Nakamura, Mishima (JP); Shinya Yachi, Mishima (JP); Yuji Moriki, Numazu (JP); Satoshi Handa, Suntoh-gun (JP); Katsuyuki Nonaka, Mishima (JP); Yoshihiro Nakagawa, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/915,420

(22) Filed: Jul. 27, 2001

(65) Prior Publication Data

US 2002/0048010 A1 Apr. 25, 2002

(30) Foreign Application Priority Data

Jul. 28, 2000 (JP) ..... 2000-228793

(51) Int. Cl.[7] ..... G03G 9/087

(52) U.S. Cl. ..... 430/108.22; 430/108.1; 430/110.1

(58) Field of Search ..... 430/108.1, 108.22, 430/110.1

(56) References Cited

U.S. PATENT DOCUMENTS

| | | | | |
|---|---|---|---|---|
| 2,297,691 | A | 10/1942 | Carlson | |
| 3,666,363 | A | 5/1972 | Tanaka et al. | |
| 4,071,361 | A | 1/1978 | Marushima | |
| 4,507,378 | A | 3/1985 | Wada et al. | 430/137 |
| 4,797,339 | A | 1/1989 | Marayuma et al. | 430/109 |
| 4,996,127 | A | 2/1991 | Hasegawa et al. | 430/109 |
| 5,104,764 | A | 4/1992 | Wada et al. | 430/109 |
| 5,407,776 | A | 4/1995 | Kanbayashi et al. | 430/137 |
| 5,604,067 | A | 2/1997 | Nagai et al. | 430/106.6 |
| 5,614,344 | A | 3/1997 | Kawakami et al. | 430/102 |
| 5,691,093 | A | 11/1997 | Kanbayashi et al. | 430/47 |
| 5,721,433 | A | 2/1998 | Kosaka | 250/573 |
| 6,187,495 | B1 * | 2/2001 | Chiba et al. | 430/106 |

FOREIGN PATENT DOCUMENTS

| | | |
|---|---|---|
| JP | 36-10231 | 7/1961 |
| JP | 56-130762 | 10/1981 |
| JP | 59-53856 | 3/1984 |
| JP | 59-61842 | 4/1984 |
| JP | 61-22354 | 1/1986 |
| JP | 62-106473 | 5/1987 |
| JP | 63-186253 | 8/1988 |
| JP | 1-217466 | 8/1989 |
| JP | 5-104764 | 4/1992 |
| JP | 8-50370 | 2/1996 |
| JP | 8-136439 | 5/1996 |
| JP | 8-160661 | 6/1996 |
| JP | 9-114125 | 5/1997 |
| JP | 2000-56518 | 2/2000 |

OTHER PUBLICATIONS

Fedors, A Method for Estimating . . . Liquids, Polym. Eng. & Sci., vol. 14, No. 2, 1974, 147–154.

* cited by examiner

*Primary Examiner*—John Goodrow
(74) *Attorney, Agent, or Firm*—Fitzpatrick, Cella, Harper & Scinto

(57) ABSTRACT

A toner having a good chargeability stable against an environmental change is formed of toner particles each comprising at least a binder resin, a colorant, a release agent and a sulfur-containing polymer, and an external additive. The toner particles contain 100 to 30,000 ppm by weight thereof of at least one stabilizer element selected from the group consisting of magnesium, calcium, barium, zinc, aluminum and phosphorus. The toner particles may preferably be produced by suspension polymerization of a monomer composition containing the sulfur-containing polymer in an aqueous medium containing a dispersion stabilizer having the stabilizer element.

47 Claims, 8 Drawing Sheets

TONER, TONER PRODUCTION PROCESS AND IMAGE FORMING METHOD

FIELD OF THE INVENTION AND RELATED ART

The present invention relates to a toner for use in an image forming method, such as electrophotography, electrostatic recording, magnetic recording and toner jetting, a process for producing the toner, and an image forming method using the toner.

Hitherto, a large number of electrophotographic processes have been known, inclusive of those disclosed in U.S. Pat. Nos. 2,297,691; 3,666,363; and 4,071,361. In these processes, in general, an electrostatic latent image is formed on a photosensitive member comprising a photoconductive material by various means, then the latent image is developed with a toner, and the resultant toner image is transferred via or without via an intermediate transfer member onto a transfer(-receiving) material such as paper etc., as desired, fixed by heating, pressing, or heating and pressing, or with solvent vapor to obtain a copy or print carrying a fixed toner image. A portion of the toner remaining on the photosensitive member without being transferred is cleaned by various means, and the above mentioned steps are repeated for a subsequent cycle of image formation.

An example of ordinary full-color image forming process will now be described. A photosensitive member (electrostatic image-bearing member) in the form of a drum is uniformly charged by a primary charger and then subjected to imagewise exposure with laser light modulated by a magenta image signal obtained from an original to form an electrostatic image on the photosensitive drum, which is then developed with a magenta toner contained in a magenta developing device to form a magenta toner image. Then, the magenta toner image formed on the photosensitive drum is transferred directly or indirectly onto a transfer material under the action of a transfer charger.

The photosensitive drum after the above-mentioned developing of an electrostatic image is charge-removed by a charge-removing charger and cleaned by a cleaning means so as to be prepared for a subsequent cyan-image forming cycle including charging again by the primary charger, a cyan toner image formation and a transfer of the cyan toner image onto the transfer material carrying the magenta toner image already transferred thereto, followed further by a yellow-image forming cycle and a black image forming cycle to provide the transfer material with four-color toner images thereon. Then, the transfer material carrying the four-color toner images is subjected to fixation under application of heat and pressure, thereby forming a full-color image.

In recent years, an image-forming apparatus performing an image forming method as described above not only is used as a business copier for simply reproducing an original but also has been used as a printer, typically a laser beam printer (LBP), for computer output, and a personal copier (PC) for individual users.

In addition to such uses as representatively satisfied by a laser beam printer, the application of the basic image forming mechanism to a plain paper facsimile apparatus is also popular.

Particularly, for such uses as a color printer for a personal computer and a personal color copier of which a rapid enlargement of market is being expected in future, a stronger desire is posed on such image forming apparatus, regarding a smaller size, a higher speed, a higher image quality and a higher reliability. Among all, a high reliability for maintaining the initial image quality in continuous image formation is strongly required, and for complying with such requirements, the improvement in chargeability is an essential subject of improved toner performance.

In either of the two-component development system wherein an amount of charge is determined by triboelectrification between a toner and a carrier, and a mono-component development system wherein an amount of charge is determined by triboelectrification between a toner on a developer-carrying member and a charge-imparting member, several problems have been left as objects of improvement regarding the charge amount, the charging speed and the maintenance of charge.

From a viewpoint of solving the above problems by controlling the toner shape, a suspension polymerization process has been proposed for producing a toner (JP-B 36-10231). In the suspension polymerization process, a monomer composition is prepared by uniformly mixing (i.e., dissolving or dispersing) a polymerizable monomer and a colorant, and optionally a polymerization initiator, a crosslinking agent, a charge control agent, and other additives, and the monomer composition is dispersed in an aqueous medium containing a dispersion stabilizer under the action of an appropriate stirrer, and subjected to polymerization, thereby providing toner particles having a desired particle size. Compared with the pulverization process, the suspension polymerization process allows easier control of particle size and its distribution and accordingly provides a toner having a narrower charge distribution and allowing easier charge control.

In the suspension polymerization system, a dispersion stabilizer used is attached to dispersed droplets, thereby uniformly stabilizing the dispersed droplets owing to its electrical polarity. It has been generally acknowledged that a toner chargeability is adversely affected if such an ionic or electrically polar substance has not been sufficiently removed therefrom.

As the dispersion stabilizer, there has been generally used a water-soluble polymer, such as polyvinyl alcohol or gelatin, or fine powder of hardly water-soluble inorganic substance, such as barium sulfate or calcium carbonate. However, the removal of such a dispersion stabilizer is generally difficult, and particularly a water-soluble polymer is difficult to remove because of high viscosity of its aqueous solution, thus being liable to remain in a large amount on the resultant toner particles and adversely affecting the triboelectric chargeability to result in remarkably inferior image qualities.

For solving these problems, JP-A 46-130762, JP-A 61-22354 and JP-A 2-148046 have proposed a process of using calcium phosphate as a dispersion stabilizer. More specifically, JP-A 2-148046 has proposed a process wherein calcium phosphate is dissolved in an acidic aqueous solution, a polymerizable monomer composition is dispersed in suspension under stirring, and an alkali hydroxide is added to again precipitate calcium phosphate on the droplets of the monomer composition for subsequent polymerization. JP-A 56-130762 and JP-A 61-22354 have proposed a process of using an adduct of sodium tertiary phosphate and calcium chloride as a dispersion stabilizer.

On the other hand, proposals of regulating the residual amount of dispersion stabilizers have been made, e.g., in JP-A 8-50370 and JP-A 8-160661. Based on a similar concept, the control of a residual amount of dispersion stabilizer in an emulsion dispersion process has been proposed in JP-A 9-218532. On the other hand, in contrast with such a general trend, JP-A 9-114125 has proposed to leave a certain amount or more of dispersion stabilizer.

Further, JP-A 1-217466 has proposed a toner production process wherein a monomer composition containing a polymerizable monomer and a copolymer of a water-soluble $SO_3X$ group-containing monomer and an oil-soluble monomer is subjected to suspension polymerization. JP-A 2000-56518 has proposed a toner comprising a copolymer of a vinyl monomer and an $SO_3X$ group-containing (meth) acrylamide. According to these proposals, some improvement in chargeability is recognizable. However, in view of Examples of these proposals, the dispersion stabilizer remaining in the product toner has not been substantially removed, so that problems regarding chargeability and developing performance attributable to the residual dispersion stabilizer have not been sufficiently solved.

SUMMARY OF THE INVENTION

Accordingly, a generic object of the present invention is to provide a toner capable of solving the above-mentioned problems.

A more specific object of the present invention is to provide a toner having good chargeability which is little affected by environmental changes.

Another object of the present invention is to provide a toner providing good image density which is little affected by environmental changes.

Another object of the present invention is to provide a toner capable of retaining good transferability even in continuous image formation.

Another object of the present invention is to provide a toner showing good fixability.

Further objects of the present invention are to provide a process for producing such a toner, and to provide an image forming method using such a toner.

According to the present invention, there is provided a toner comprising: toner particles each comprising at least a binder resin, a colorant, a release agent and a sulfur-containing polymer, and an external additive;

wherein the toner particles contain 100 to 30,000 ppm by weight thereof of at least one element selected from the group consisting of magnesium, calcium, barium, zinc, aluminum and phosphorus.

According to the present invention, there is also provided a process for producing a toner, comprising:

dispersing a monomer composition comprising at least a polymerizable monomer, a colorant, a release agent and a sulfur-containing polymer in an aqueous medium containing at least one element selected from the group consisting of magnesium, calcium, barium, zinc, aluminum and phosphorus, to form droplets of the monomer composition therein, subjecting the droplets of the monomer composition to polymerization in the aqueous medium to form toner particles containing 100 to 30,000 ppm by weight thereof of at least one element selected from the group consisting of magnesium, calcium, barium, zinc, aluminum and phosphorus, and blending the toner particles with an external additive to form a toner.

The present invention further provides an image forming method, comprising at least:

a charging step of charging an image-bearing member, an electrostatic image forming step of forming an electrostatic image on the image-bearing member, a developing step of developing the electrostatic image with the above-mentioned toner carried on a developer-carrying member to form a toner image on the image-bearing member, a transfer step of transferring the toner image from the image bearing member to a transfer material via or without via an intermediate transfer member, and a fixing step of fixing the toner image onto the transfer material.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
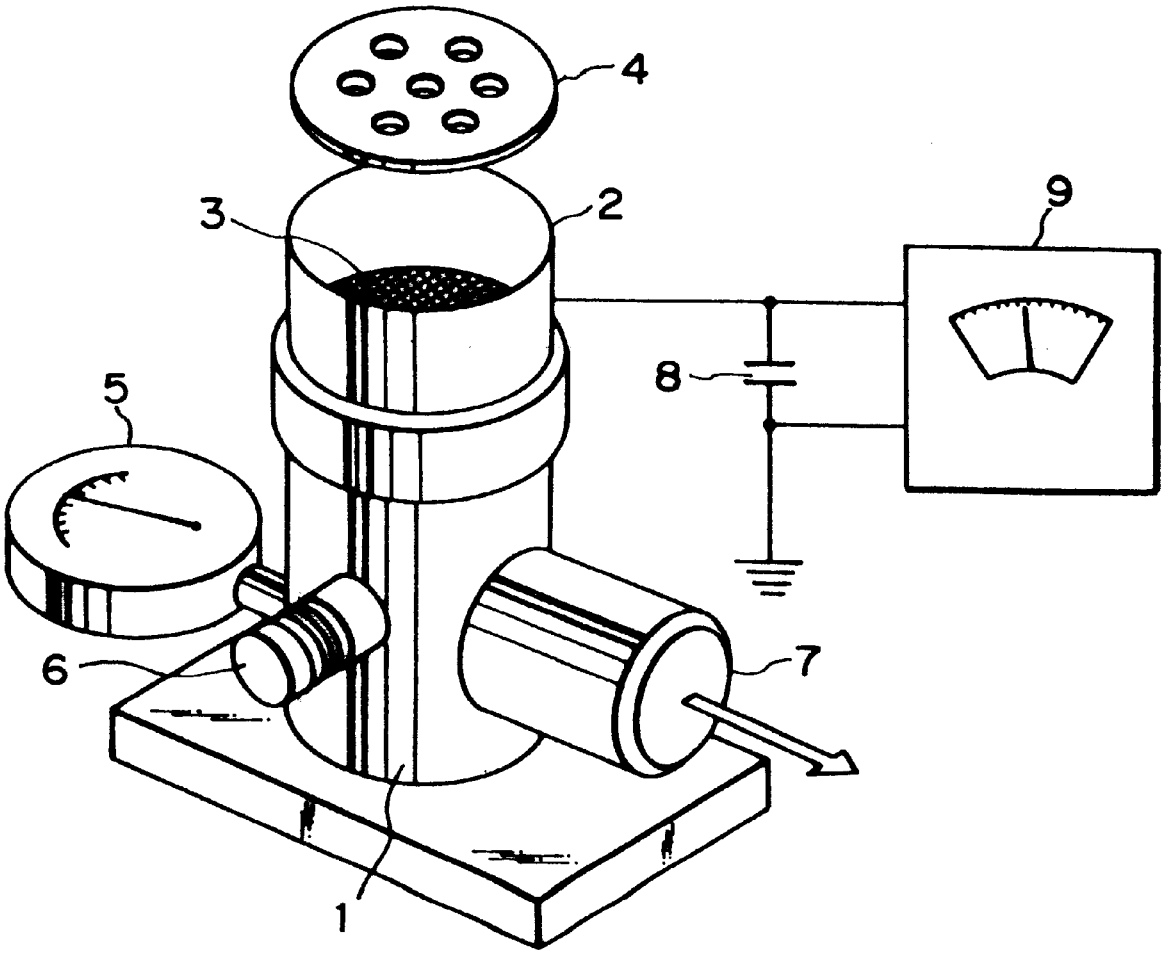
FIG. 1 illustrates an apparatus for measuring a triboelectric charge of a toner.

A dispersion stabilizer conventionally used in a wet process for toner production has an advantageous function of uniformly dispersing objective particles but, on the other hand, is accompanied with a difficulty in complete removal thereof, so that a substantial amount thereof remaining on the toner surface can adversely affect the triboelectric chargeability, thus resulting in inferior image forming performances particularly in a high temperature/high humidity environment.

As a result of our study, however, the above-mentioned toner of the present invention having toner particles containing a sulfur-containing polymer and also a specific element is provided with a stable chargeability regardless of environmental conditions and also excellent fixability, thus being capable of forming good images. Detailed mechanisms for the improvement have not been fully clarified yet, but we consider as follows.

A residual substance at toner particle surfaces originated from a dispersion stabilizer is the dispersion stabilizer itself, and if the removal thereof is insufficient, the toner surface becomes moisture-absorptive because of moisture-absorptivity of the dispersion stabilizer, thus causing a lower chargeability of the toner.

In contrast thereto, in the case of toner particles of the present invention containing a sulfur-containing polymer, the sulfur of the sulfur-containing polymer and the elements, such as magnesium, calcium, barium, zinc, aluminum or phosphorus, contained in the dispersion stabilizer are attracted with each other to stabilize the dispersion of the toner particles or precursor droplets thereof, whereby the dispersion stabilizer element is caused to be present not only at the toner particle surfaces but also be dispersed inside the toner particles. Particularly, in the case where the sulfur is contained in the form of a sulfonic acid group in the sulfur-containing polymer, the sulfur is caused to form a very stable associated state together with the dispersion stabilizer element so as to allow a better dispersion in the entirety of the toner particles. As a result, the sulfur and the dispersion stabilizer element are caused to be present in a larger amount inside the toner particles, thus being less liable to be affected by environmental moisture to provide a toner with an environmentally stable chargeability. Thus, particularly in the case where the sulfur-containing polymer has a sulfonic acid group, the toner particles are less moisture-absorptive, and the chargeability change due to moisture is suppressed very well. Further, colorant particles are generally liable to be agglomerated in the toner particles, but in the toner of the present invention, the agglomerated colorant particles are well disintegrated simultaneously with the dispersion of the sulfur and the dispersion stabilizer element within the toner particles to promote the colorant dispersion within the toner particles. Further, along with the enhanced colorant dispersion, a portion of the wax is caused to be present in spots in the form of being attached on the colorant particle surface in the binder resin, thus resulting in an improved toner fixability.

Thus, in the toner of the present invention, the amount of the dispersion stabilizer at the toner particle surfaces liable to lower the environmental stability of chargeability is suppressed while promoting the dispersion of the dispersion stabilizer element in the toner particles to promote the dispersion of the colorant and a portion of the wax, whereby the stability and coloring power are improved in addition to good chargeability.

The sulfur-containing polymer may preferably have a certain acidity so as to provide a surface-treated state of a colorant in combination with a colorant which has a basic group in many cases to form a bonding between the acid of the sulfur-containing polymer and the base of the colorant surface. This suppresses the charge leakage caused through the colorant as leakage points, so that the toner charge distribution becomes more uniform and allows the maintenance of high transferability even in continuous image formation. Further, as a result of the acid-base bond, the colorant dispersion in the toner particle is promoted in association with the dispersion of the sulfur-containing polymer in the toner particles, thus providing a stable image density.

Further, while details thereof will be described later, it has been also confirmed that the maintenance of image quality in continuous image formation is further promoted in case where the sulfur-containing polymer has a glass transition point of 50–100° C., and the sulfur-containing polymer is a sulfonic acid group-containing polymer with contents of units originated from a sulfuric acid group-containing monomer and residual monomer in the polymer. These factors are considered to better suppress the influence of moisture and more uniform charge distribution of the resultant toner. It has been also confirmed that a good influence on the above effects is attained by using the sulfur-containing polymer in combination with a condensation resin.

In the toner of the present invention, the toner particles contain at least one dispersion stabilizer element selected from magnesium, calcium, barium, zinc, aluminum and phosphorus in an amount (or total amount in the case of containing two or more elements) of 100 to 30,000 ppm (by weight), preferably 100 to 25,000 ppm, further preferably 100 to 20,000 ppm, most preferably 100 to 9,000 ppm, based on the weight of the toner particles.

In the case where the dispersion stabilizer element is less than 100 ppm, the stable state of attraction between the element and the sulfur-containing polymer is difficult to achieve, thus lowering the dispersibility of the element in the toner particles, so that the effect of promoting the colorant dispersion in the toner particles is lowered and the charging stability is liable to be lowered. Further, below 100 ppm, the charge leakage points become fewer so that the toner is liable to be excessively charged triboelectrically in a low humidity environment. Further, in order to achieve a dispersion stabilizer element content of below 100 ppm, a complicated washing step is required to result in a lower productivity.

On the other hand, in the case where the dispersion stabilizer element content exceeds 30,000 ppm, the toner is liable to cause a remarkable lowering in chargeability in a high humidity environment, thus resulting in fog. Further, the fixability is remarkably lowered in a low humidity environment, thus exhibiting inferior fixability in full-color image formation.

For measuring the dispersion stabilizer element content in a toner containing also an external additive, it is appropriate to effect the measurement after washing the toner and re-washing the toner in water under application of vibration for removing the external additive to recover only the toner particles. More specifically, the recovery of toner particles may for example be effected in the following manner.

(1) 10 g of a toner sample containing an external additive is added to 150 ml of 10%-hydrochloric acid, followed by 2 hours of stirring.

(2) The resultant dispersion liquid from (1) above is subjected to filtration through filter paper of JIS-P3801 5C (retention particle size $\geqq 3$ $\mu$m).

(3) The resultant cake on the filter paper is added to 150 ml of deionized water and subjected to ultrasonic dispersion under stirring.

(4) The dispersion liquid from (3) above is again subjected to filtration through filter paper of JIS-P3801 5C (retention particle size $\geqq 3$ $\mu$m).

(5) The resultant cake is again washed with 150 ml of deionized water like (3) and (4) above.

(6) The resultant cake is dried at 40° C. for 24 hours.

The toner particles thus recovered by removal of the external additive may be subjected to determination of the above-mentioned dispersion stabilizer element by known methods of quantitative analysis, such as fluorescent X-ray analysis, plasma emission spectroscopy (ICP) and ESCA or XPS (X-ray photoelectron spectroscopy).

The element contents described herein are generally based on values measured by fluorescent X-ray analysis (according to JIS-K0119) performed in the following manner.

(i) Apparatus

Fluorescent X-ray analyzer ("3080", made by Rigaku Denki K.K.).

Sample press-molding machine (made by Maekawa Testing Machine Mfg. Co. Ltd.).

(ii) Preparation of a Calibration Curve

Five samples are prepared by external addition of a standard compound containing an objective element at 5 levels of amounts and milling by a coffee mill. The 5 samples are respectively subjected to press molding by the above-mentioned press-molding machine. From a prescribed 29-table, [M]Kα peak angle (a deg.) is determined for the standard compound. Each sample is placed under vacuum in the fluorescent X-ray analyzer and the X-ray intensity thereof is measured under the following conditions to prepare a calibration curve based on the measured values (wt. ppm-scale).

(iii) Measurement Conditions

Voltage: 50 kV, 50–70 mA

2θ-angle: a (deg.)

Crystal plate: LiF

Measurement time: 60 sec.

(iv) Measurement of an Element Content in Sample Toner Particles

Sample toner particles are mold in the same manner as in the preparation of a calibration curve-preparation sample, and the molded sample is subjected to the same fluorescence X-ray analysis under the same conditions to determine an objective element content by comparing a measured X-ray intensity with the calibration curve.

Next, some description will be made regarding the sulfur-containing polymer used in the present invention.

It has been a known matter that an elevated triboelectric chargeability can be attained by incorporating a sulfur-containing polymer in a toner. Also in the present invention, a toner having a high chargeability is obtained by incorporating a sulfur-containing polymer.

The sulfur-containing polymer is preferably a sulfonic acid group-containing polymer. By incorporating a sulfonic acid group-containing polymer, it is possible to form a more stable state with the dispersion stabilizer element of Mg, Ca, Ba, Zn, Al or P, so that the dispersion of a colorant into the toner particles is promoted and the dispersion of a portion of wax is improved along with the colorant dispersion.

The residual monomer content in the sulfur-containing polymer may preferably be reduced to at most 1000 ppm, more preferably at most 300 ppm. If the residual monomer content exceeds 1000 ppm, it becomes difficult to attain a desired chargeability characteristic, thus being difficult to attain a stable image density in continuous image formation.

It is further preferred that the sulfur-containing polymer has a glass transition temperature (Tg) of 50 to 100° C., more preferably above 70° C. to 100° C., further preferably 73 to 100° C. If Tg is below 50° C., the resultant toner is liable to have lower flowability and storage stability, and also a lower transferability. If Tg is above 100° C., the resultant toner is liable to exhibit a lower fixability especially in the case of a high image area.

The sulfur-containing polymer may be obtained as a homopolymer or a copolymer of a sulfur-containing monomer, examples of which may include: styrene-sulfonic acid, 2-acrylamido-2-methylpropanesulfonic acid, 2-methacrylamido-2-methylpropanesulfonic acid, vinylsulfonic acid, methacrylsulfonic acid, and maleic acid derivative, maleimide derivative and styrene derivative represented by structural formulae shown below. Among these, sulfonic acid group-containing (meth)acrylamide is preferred.

maleic acid amide derivative

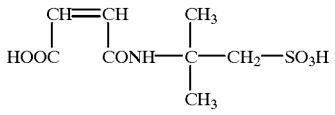

maleimide derivative

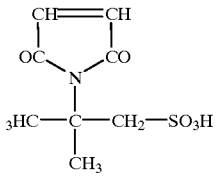

styrene derivative

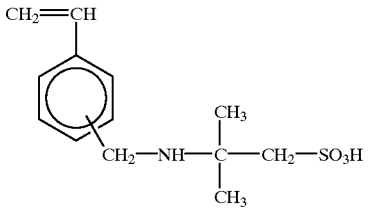

(bonding cite may be ortho or para).

It is possible to use a homopolymer of the above-mentioned sulfur containing monomer, but copolymers with other polymerizable monomers, such as vinyl aromatic compounds and (meth)acrylate esters, are preferred.

More specifically, examples of monofunctional monomer for providing the sulfur-containing copolymer may include: styrene; styrene derivatives, such as α-methylstyrene, β-methylstyrene, o-methylstyrene, m-methylstyrene, p-methylstyrene, 3,4-dichlorostyrene, p-ethylstyrene, 2,4-dimethylstyrene, p-n-butylstyrene, p-tert-butylstyrene, p-n-hexylstyrene, p-n-octyl-styrene, p-n-nonylstyrene, p-n-decylstyrene, p-n-dodecylstyrene, p-methoxystyrene and p-phenylstyrene; acrylic monomers, such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate n-nonyl acrylate, cyclohexyl acrylate, benzyl acrylate, dimethylphosphateethyl acrylate, diethylphosphateethyl acrylate, dibutylphosphateethyl acrylate, and 2-benzoyloxyethyl acrylate; methacrylate monomers, such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl-methacrylate, diethylphosphateethyl methacrylate, and dibutylphosphateethyl methacrylate; methyl-monocarboxylic acid esters; vinyl esters, such as vinyl acetate, vinyl propionate, vinyl lactate, vinylbenzoate, and vinyl formate; vinyl ethers, such as vinyl methyl ether, vinyl ethyl ether, and vinyl isobutyl ether; and vinyl ketones, such as vinyl methyl ketone, vinyl hexyl ketone and vinyl isopropyl ketone.

Examples of poly-functional monomer may include: diethylene glycol diacrylate, triethylene glycol diacrylate, tetraethylene glycol diacrylate, polyethylene glycol diacrylate, 1,6-hexanediole diacrylate, neopentyl glycol diacrylate, tripropylene glycol diacrylate, polypropylene glycol diacrylate, 2,2'-bis(4-(acryloxy-diethoxy)phenyl) propane, trimethylolpropane triacrylate, tetramethylmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis(4-methacryloxydiethoxy)-phenyl)propane, 2,2'-dis(4-methacryloxy polyethoxy)-phenyl)propane, trimethylpropane trimethacrylate, tetramethylmethane tetramethacrylate, divinylbenzene, divinylnaphthalene and divinyl ether.

The sulfur-containing polymer may preferably contain polymerized units of the sulfur-containing monomer in a proportion of 0.01–20 wt. % thereof, more preferably 0.05–10 wt. %, further preferably 0.1 to 7 wt. %. Below 0.01 wt. %, the effect of addition of the sulfur-containing polymer cannot be sufficiently attained, and in excess of 20 wt. %, the dispersion stabilizer element is liable to remain in excess, to result in inferior fixability.

For providing the sulfur-containing polymer, bulk polymerization, solution polymerization, suspension polymerization or ionic polymerization may be used, but solution polymerization is preferred in view of the processability.

The sulfur-containing polymer may have a structure represented by the following formula $$X(SO_3^-)_n.mY^{k+},$$

wherein X represents polymer sites originated from the above-mentioned monomers, $Y^+$ denotes a counter ion, k denotes a valence of the counter ion, m and n are integers representing the number of the counter ion and the sulfonic acid group in the polymer and satisfying n=k×m. Preferred examples of the counter ion may include: hydrogen, sodium, potassium, calcium and ammonium, and a hydrogen ion is particularly preferred.

The sulfur-containing polymer may preferably have an acid value of 3–80 mgKOH/g, more preferably 5–40 mgKOH/g, further preferably 10–30 mgKOH/g. If the acid value is below 3 mgKOH/g, the charge-controlling function intended by the present invention can be lowered and the environmental stability of the resultant toner can be lowered. In excess of 50 mgKOH/g, the resultant toner particles are liable to have distorted shapes showing a lower circularity and the release agent exposed at the surface, thus showing a lower developing performance, especially when they are formed through suspension polymerization.

The sulfur-containing polymer may preferably be contained in 0.01–15 wt. parts, more preferably 0.1–10 wt. parts, per 100 wt. parts of the binder resin. If the content is below 0.01 wt. part, the charge controlling function obtained thereby is scarce, and in excess of 15 wt. parts, the resultant toner particles when produced by suspension polymerization are liable to have a lower circularity, thus causing lowering in developing performance and transferability.

It is further preferred that the toner of the present invention contains 0.001–3 wt. parts, more preferably 0.005–2 wt. parts, further preferably 0.01–1.5 wt. parts of polymerized units of the sulfur-containing monomer, per 100 wt. parts of the binder resin.

The content of the sulfur-containing polymer may be determined by capillary electrophoresis, etc.

The sulfur-containing polymer may preferably have a weight-average molecular weight (Mw) of $5\times10^2$ to $1\times10^5$, more preferably $1\times10^3$–$7\times10^4$, further preferably $5\times10^3$–$5\times10^4$. If Mw is below $5\times10^2$, the resultant toner is liable to have a lower flowability, and in excess of $1\times10^5$, the solubility thereof in the polymerizable monomer at the time of toner production through the polymerization process is lowered and the dispersibility of the pigment is lowered to result in a toner having a lower coloring power.

The sulfur-containing polymer may preferably have a volatile matter content of 0.01 to 2.0 wt. %. A volatile matter content below 0.01% requires a complicated volatile matter removal treatment, and in excess of 2.0%, the resultant toner is liable to have inferior chargeability in a high temperature/high humidity environment, particularly after standing for some period. The volatile matter content is determined by a weight loss after standing at 135° C. for 1 hour.

The sulfur-containing polymer may preferably have a melt index (MI) value of 0.1 to 100 g/10 min., more preferably 0.2 to 80 g/10 min. Below 0.1 g/10 min., the dissolution of the polymer in the monomer becomes difficult, thus resulting in an unstable polymerizable composition and being liable to fail in toner particles having a sharp particle size distribution. If MI value exceeds 100 g/10 min., the polymer has an excessively sharp meltability, thus being liable to result in a toner having inferior anti-blocking property and lower durability. The MI values referred to herein are values measured according to JIS K7210, A method, and converted into values for 10 min.

Incidentally, in the case where the isolation of the sulfur-containing polymer from the toner is required for measuring the above-mentioned properties, the isolation may be performed any known methods, inclusive of extraction.

The binder resin constituting the toner particles may comprise any known binder resins, inclusive of styrene copolymers such as styrene-acrylate ester copolymer and styrene-methacrylate ester copolymer, and polyester resin.

The release agent for constituting the toner particles may preferably have a weight-average molecular weight (Mw) of 350–4000 and a number-average molecular weight (Mn) of 200–4000, more preferably Mw of 400–3500 and Mn of 250–3500. If Mw is below 350 or Mn is below 200, the resultant toner is liable to have a lower anti-blocking property. On the other hand, if Mw exceeds 4000 or Mn exceeds 4000, the release agent is caused to have an increased crystallinity and is liable to result in a lower transparency for OHP fixed images.

The molecular weight (distribution) of a release agent may be measured by GPC under the following conditions:

| | |
|---|---|
| Apparatus: | "GPC-150C" (available from Waters Co.) |
| Column: | "GMH-HT" 30 cm-binary (available from Toso K.K.) |
| Temperature: | 135° C. |
| Solvent: | o-dichlorobenzene containing 0.1% of ionol. |
| Flow rate: | 1.0 ml/min. |
| Sample: | 0.4 ml of a 0.15%-sample. |

Based on the above GPC measurement, the molecular weight distribution of a sample is obtained once based on a calibration curve prepared by monodisperse polystyrene standard samples, and re-calculated into a distribution corresponding to that of polyethylene using a conversion formula based on the Mark-Houwink viscosity formula.

The release agent may preferably have a melting point (represented by a maximum heat absorption peak temperature (Tabs.max) on a DSC heat-absorption curve taken in a range of 20–200° C.) of 30–120° C., more preferably 50–110° C. Particularly, a wax which is solid at room temperature is preferred, and a solid wax having a melting point of 50–110° C. is preferred in view of the anti-blocking property, continuous image forming performance on a large number of sheets, low-temperature fixability and anti-offset property of the resultant toner.

Examples of such waxes may include: paraffin wax, polyolefin wax, microcrystalline wax, polymethylene wax such as Fischer-Tropsche wax, amide wax, higher fatty acids, long-chain alcohols, ester wax, ketone wax, and derivatives of these, such as grafted products and block polymerized products. These waxes may preferably have a DSC maximum heat-absorption peak which has been made narrower by removal of low-molecular weight components.

A preferred class of waxes may include: linear alkyl alcohols linear fatty acids, linear acid amides, linear esters, and montan derivatives, having 15–100 carbon atoms. It is also preferred to remove impurities such as liquid fatty acids from these waxes.

A further preferred class of waxes may include: a low-molecular weight alkylene polymer obtained-through radical polymerization under a high pressure or in the presence of a Ziegler catalyst or other catalysts under a low pressure; an alkylene polymer obtained by thermal decomposition of a high-molecular weight alkylene polymer; a product obtained by refining low-molecular weight alkylene polymers by-produced in polymerization of alkylenes; and polymethylene waxes obtained by extracting a specific fraction from distillation residues of hydrocarbon polymers obtained through the Arge process from a synthetic gas comprising carbon monoxide and hydrogen, or from synthetic hydrocarbons obtained by hydrogenating the distillation residues. The waxes can contain an anti-oxidant added thereto.

In order to improve the transparency of fixed images, a solid ester wax may preferably be used.

Preferred examples of the ester wax may include those comprising compounds represented by formulae (I) to (VI) shown below:

(I)

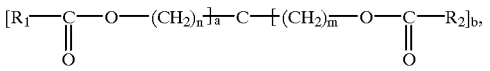

wherein a and b are integers of 0–4 with the proviso of a+b=4, $R_1$ and $R_2$ are organic groups each having 1–40 carbon atoms providing a difference of at least three carbon atoms between $R_1$ and $R_2$; and m and n are integers of 0–25 with the proviso that at least one of m and n is not zero;

(II)

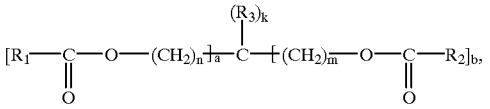

wherein a and b are integers of 0–3 and k is an integer of 1–3 with the provisos of a+b=1 to 3 and a+b+k=4, $R_1$ and $R_2$ are organic groups each having 1–40 carbon atoms providing a difference of at least three carbon atoms between $R_1$ and $R_2$; $R_3$ is a hydrogen atom or an organic group having at least one carbon atom with the proviso that at least one $R_3$ is an organic group having at least one carbon atom when k is 2 or 3; and m and n are integers of 0–25 with the proviso that at least one of m and n is not zero;

(III)

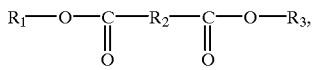

wherein $R_1$ and $R_3$ are independently organic groups having 6–32 carbon atoms, and $R_2$ is an organic group having 1–20 carbon atoms;

(IV)

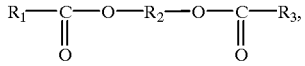

wherein $R_1$ and $R_3$ are independently organic groups having 6–32 carbon atoms and $R_2$ is $—(CH_2)_n—$ and n is an integer of 1–20;

(V)

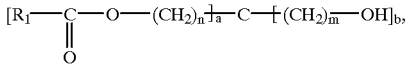

wherein a is an integer of 0–3 and b is an integer of 1–3 with the proviso of a+b=4; $R_1$ is an organic group having 1–40 carbon atoms, m and n are integers of 0–25 with the proviso that at least one of m and n is not zero; and

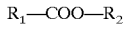

(VI), wherein $R_1$ and $R_2$ are hydrocarbon groups each having 15–45 carbon atoms.

Specific examples of the release agent are enumerated hereinbelow based on a structure of a principal compound which occupies at least 50 wt. % of the relevant release agent.

Release Agent No. 1

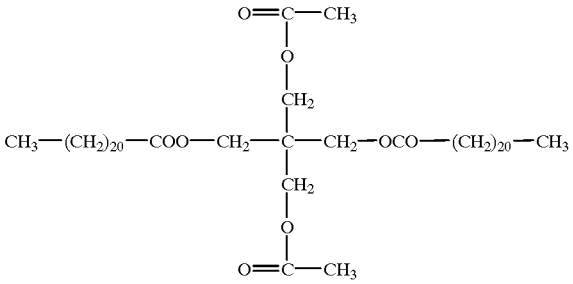

Release Agent No. 2

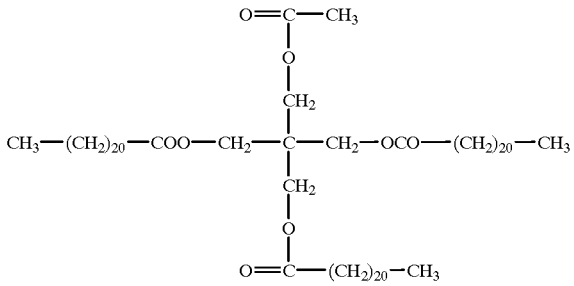

Release Agent No. 3

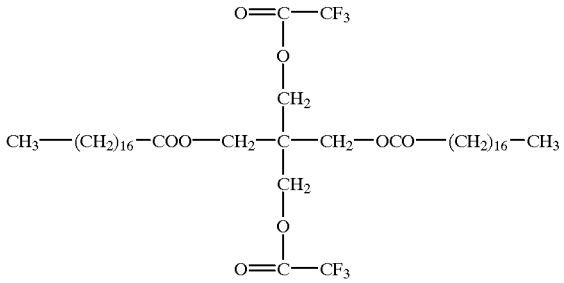

Release Agent No. 4

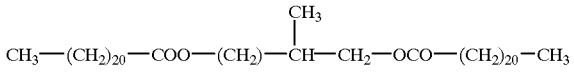

Release Agent No. 5

$CH_3(CH_2)_{20}COO(CH_2)_{21}CH_3$

Release Agent No. 6

$CH_3(CH_2)_{18}COO(CH_2)_{21}CH_3$

Release Agent No. 7

$CH_3(CH_2)_{39}COO(CH_2)_{17}CH_3$

Release Agent No. 8

$CH_3(CH_2)_{20}COO(CH_2)_{17}CH_3$

Release Agent No. 9

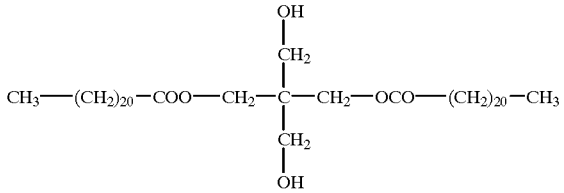

Release Agent No. 10

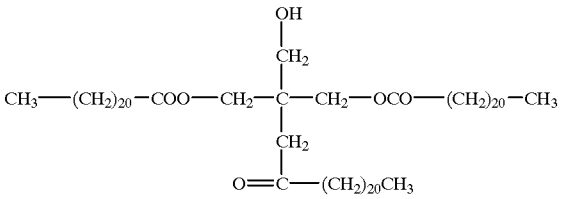

Release Agent No. 11

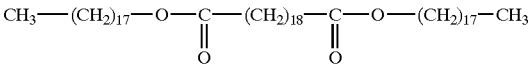

Release Agent No. 12

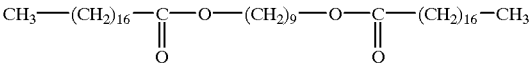

Further, in the case where a release agent comprises a mixture of two or more ester compounds, it is preferred that the release agent contains 50–95 wt. % thereof of ester compounds having an identical number of total number of carbon atoms. The content of the ester compounds having an identical number of total carbon atoms may be measured by gas chromatography (GC) and the values described herein are based on those measured according to the following method by using an apparatus "GC-17A", available from Shimazu Seisakusho K.K.

A sample is preliminarily dissolved in toluene at a concentration of 1 wt. %, and 1 $\mu$l of the solution is injected into the apparatus equipped with an on-column injector. The column used is Ultra Alloy-1 (HT) having sizes of 0.5 mm-dia.×10 m-length. The column is initially heated at a rate of 40° C./min. from 40° C. to 200° C., then at a rate of 15° C./min. to 350° C., and then at a rate of 7° C./min. to 450° C. He (helium) gas is caused to flow as a carrier gas at a pressure of 50 kPa. The ester compounds are identified by comparison with chromatograms of alkanes having a known number of carbon atoms prepared in advance by the same apparatus and the results of mass spectrum chromatography of the gassified components thereof. The content of an ester compound is calculated as a ratio of the peak area thereof to a total area of peaks in a chromatogram of the sample wax.

If an ester wax comprising an ester compound having a structure as represented by the above formulae is used as the release agent, it is possible to obtain a toner exhibiting a good transparency and also an excellent fixability.

Particularly, in the case where the release agent and the sulfur-containing polymer are dissolved in a polymerizable mixture to form a polymerizable composition and the composition is dispersed in a aqueous medium containing a dispersion stabilizer having an element such as magnesium, calcium, barium, zinc, aluminum or phosphorus to effect the polymerization of the monomer for producing toner particles, the wax can be well dispersed in the toner particles to provide a toner which has a high chargeability, exhibits a high speed for acquiring an appropriate level of charge and exhibits little change in triboelectric chargeability during continuous image formation on a large number of sheets.

In the case of toner production through the polymerization process, the release agent may preferably be used in 1 to 40 wt. parts, more preferably 10 to 30 wt. parts, per 100 wt.

parts of the polymerizable monomer, and thus may preferably be contained in 1 to 40 wt. parts, more preferably 10 to 30 wt. parts, per 100 wt. parts of the binder resin in the toner.

In the case of toner production through the melt-kneading and pulverization process, the release agent may preferably be contained in 1 to 10 wt. parts, more preferably 1–5 wt. parts, per 100 wt. parts of the binder resin in the toner.

Compared with the dry toner production through the melt-kneading and pulverization process, in the case of the polymerization process toner production, a larger amount of release agent can be easily enclosed within toner particles by the action of a polar resin inclusive of the sulfur-containing polymer, thus providing a toner showing better offset prevention effect in the fixation.

If the addition amount of the release agent is below the lower limit, the offset prevention effect is liable to be lowered. In excess of the upper limit, the anti-blocking effect is liable to be lowered and the offset-prevention effect is also liable to be adversely affected. Moreover, several other difficulties are liable to be encountered, such as toner melt-sticking onto the photosensitive drum and the developing sleeve, and also the formation of toner particles having a broader particle size distribution in the polymerization process toner production.

The release agent used in the present invention may preferably have a solubility parameter (SP) value in a range of 7.6–10.5. A release agent having an SP value below 7.6 shows little mutual solubility with the polymerizable monomer or binder resin, thus being liable to cause inferior dispersion in the binder resin which leads to attachment of the release agent and change in chargeability during continuous image formation on a large number of sheets. Further, ground fog and toner concentration change at the time of toner replenishment are also liable to occur. If a release agent has an SP value above 10.5, the toner particles are liable to cause blocking in a long-term storage. Further, because of an excessive mutual solubility with the binder resin, it becomes difficult to form a sufficient release layer between the fixing member and the toner, thus being liable to cause an offset phenomenon.

The solubility parameter (SP) value can be calculated according to the Fedors' method (Polym. Eng. Sci., 14 (2), p. 147 (1974)) utilizing the additivity of atomic groups.

The release agent used in the present invention may preferably have a melt-viscosity at 135° C. of 1–300 cPs, more preferably 3–50 cPs. Below 1 cPs, the developing sleeve is liable to be soiled due to a shearing force in case where the toner is applied in a thin layer by an application blade, etc. Further, in the cases of the two-component scheme, the toner is liable to be damaged by a shearing force exerted by the carrier particles, resulting in embedding of the external additive and breakage of the toner particles. Above 300 cPs, the polymerizable monomer composition in the polymerization process toner production is liable to have a high viscosity, so that it becomes difficult to obtain a small-particle size toner having a sharp particle size distribution.

The melt-viscosity of a release agent can be measured by a viscometer ("VP-500", made by Haake Co.) equipped with a cone plate-type rotor ("PK-1").

Further, the release agent may preferably have a penetration of at most 14, more preferably at most 4, further preferably at most 3, as measured by JIS-K2235. Above 14, the release agent is liable to cause filming on the photosensitive drum surface.

In case where extraction of the release agent from the toner is required, the extraction may be performed according to any arbitrary method.

As an example, a prescribed amount of a sample toner is subjected to Soxhlet extraction with toluene, and after recovering the toluene solvent from the toluene-soluble content, the release agent may be recovered as a chloroform-insoluble content.

The release agent may be identified by IR (infrared spectroscopy) and quantitatively analyzed by DSC (differential scanning calorimeter), etc.

The toner according to the present invention can further contain a condensation resin in addition to the binder resin (vinyl-type binder resin). In the case of polymerization process toner production, the addition of such a condensation resin improves the droplet (or particle) forming characteristic, the environmental stability of chargeability, developing performance and transferability of the resultant toner.

The condensation resin may preferably have a weight-average molecular weight (Mw) of $6\times10^3$–$1\times10^5$, more preferably $6.5\times10^3$–$8.5\times10^4$, further preferably $6.5\times10^3$–$4.5\times10^4$. Below $6\times10^3$, the external additive is liable to be embedded, during continuous image formation, thus being liable to cause a lowering in transferability. On the other hand, above $1\times10^5$, a long time is required for dissolving the condensation resin in the polymerizable monomer. Further, the viscosity of the polymerizable monomer composition is increased, so that it becomes difficult to obtain toner particle having a small particle size and a uniform particle size distribution.

It is also preferred that the condensation resin has a number-average molecular weight (Mn) of $3\times10^3$–$8\times10^4$, more preferably $3.5\times10^3$–$1.2\times10^4$, and also a main peak molecular weight (Mp) or a GPC chromatogram in a range of $4.5\times10^3$–$4\times10^4$, more preferably $6\times10^3$–$3\times10^4$, further preferably $6\times10^3$–$2\times10^4$. Outside the ranges, similar difficulties as regards the weight-average molecular weight range are liable to be encountered.

It is also preferred that the condensation resin has an Mw/Mn ratio of 1.2–3.0, more preferably 1.5–2.5. Below 1.2, the resultant toner is liable to have low continuous image forming performance and anti-offset property. Above 3.0, the toner is liable to have a somewhat lower low-temperature fixability.

The condensation resin may preferably have a glass transition temperature (Tg) of 50–100° C., more preferably 50–95° C., further preferably 55–90° C. Below 50° C., the resultant toner is liable to have a lower anti-blocking property Above 100° C., the toner is caused to have a lower anti-low-temperature offset property. Tg referred to herein is based on values measured according to the middle point method.

The condensation resin may have an acid value (mgKOH/g) of 0.1 to 35, preferably 3–35, more preferably 4–35, further preferably 5–30. Below 0.1, the toner is liable to have a slower rise-up of charge, thus being liable to cause fog. Above 35, the toner is liable to cause a fluctuation in triboelectric chargeability after being left to stand in a high temperature/high humidity environment. Further, above 35, the condensation resin is caused to have strong affinity between polymer molecules thereof, so that the dissolution thereof in the polymerizable monomer becomes difficult, thus taking a longer time for preparation of the polymerizable monomer composition.

The condensation resin may have a hydroxy value (mgKOH/g) of 0.2 to 50, preferably 5 to 50, further preferably 7 to 45. Below 0.2, the localization of the condensation resin at the surfaces of droplets of the polymerizable monomer composition in the aqueous medium Above 50, the resultant toner is liable to have somewhat lower chargeability after being left to stand in a high temperature/high humidity environment. Further, the toner is liable to cause a charge in image density during continuous image formation. If necessary, the condensation resin may be extracted from the toner according to an arbitrary method.

In the present invention, it is preferred the condensation resin has an acid value AV1 and the sulfur-containing polymer has an acid value AV2 satisfying AV1<AV2. If this condition is satisfied, the sulfur-containing polymer can be localized at the utmost surfaces of toner particles at the time of droplet or particle formation in the wet process toner production, the opportunity of contact thereof with the dispersion stabilizer element of Mg, Ca, Ba, Zn, Al or P is increased to form a stable dispersion state, and the dispersion of the dispersion stabilizer element inside the toner particles is promoted.

The condensation resin may preferably be contained in a proportion of 0.1–20 wt. parts, more preferably 1–15 wt. parts, per 100 wt. parts of the binder resin (i.e., vinyl-type binder resin) in the toner of the present invention.

The molecular weights and the molecular weight distribution of the sulfur-containing polymer and the condensation resin referred to herein are based on values measured according to the following method.

In the GPC apparatus, a column is stabilized in a heat chamber at 40° C., tetrahydrofuran (THF) solvent is caused to flow through the column at that temperature at a rate of 1 ml/min., and ca. 100 $\mu$l of a sample solution in THF is injected. The identification of sample molecular weight and its distribution is performed based on a calibration curve obtained by using several monodisperse polystyrene samples and having a logarithmic scale of molecular weight versus count number. The standard polystyrene samples maybe available from, e.g., Toso K.K. or Showa Denko. It is appropriate to use at least 10 standard polystyrene samples having molecular weights ranging from ca. $10^2$ to ca. $10^7$. The detector may be an RI (refractive index) detector. It is appropriate to constitute the column as a combination of several commercially available polystyrene gel columns. For example, it is possible to use a combination of Shodex GPC KF-801, 802, 803, 804, 805, 806, 807 and 808P available from Showa Denko K.K.; or a combination of TSKgel G1000H ($H_{XL}$), G2000H ($H_{XL}$), G3000H ($H_{XL}$), G4000H ($H_{XL}$), G5000H ($H_{XL}$), G7000H ($H_{XL}$) and TSK-guard column available from Toso K.K.

A GPC sample solution is prepared in the following manner.

A sample is added to THF and left standing for several hours. Then, the mixture is well shaked until the sample mass disappears and further left to stand still for at least 24 hours. Then, the mixture is caused to pass through a sample treatment filter having a pore size of 0.2–0.5 $\mu$m (e.g., "Maishori Disk H-25-2", available from Toso K.K. or "Ekikuro-Disk 25CR", available from German Science Japan K.K.) to obtain a GPC sample having a resin concentration of 0.5–5 mg/ml.

The glass-transition temperatures (Tg) of the sulfur-containing polymer and the condensation resin may be measured according to DSC in the following manner.

The DSC measurement may preferably be performed by using a high-accuracy internal heat-impact comparation-type differential scanning calorimeter, e.g., "DSC-7", available from Perkin-Elmer, Inc.

The measurement may be performed according to ASTM D3418-82. A sample is once heated and cooled for removing its thermal history and then subjected heating at a rate of 10° C./min. for taking a DSC curve.

The acid values of the sulfur-containing polymer and the condensation resin referred to herein are based on values measured according to the following method (JIS-K0070). (The acid value refers to an amount (mg) of potassium hydroxide (KOH) required to neutralize free fatty acid and resinous acid contained in a unit amount (1 g) of a sample.)

(1) Reagent (a) Solvent

As a solvent for a sample, an ethyl ether/ethyl alcohol mixture (=1/1 or 2/1) is used after neutralization immediately before use thereof with 0.1 mol/liter KOH-ethyl alcohol solution with phenolphthalein as an indicator.

(b) Phenolphthalein Solution 1 g of phenolphthalein is dissolved in 100 ml of ethyl alcohol (95 V/V %).

(c) 0.1-mol/liter KOH-ethyl Alcohol Solution 7.0 g of potasiumhydroxide is dissolved in a minimum amount of water and ethyl alcohol (95 V/V %) is added thereto up to a total volume of 1 liter to prepare a 0.1 mol/l-KOH/EtOH solution. After standing for 2–3 days, the solution is filtered and standardized according to JIS-K8006.

(2) Operation

A sample is weighted accurately in 1–20 g, and 100 ml of the solvent and several droplets of the phenolphthalein solution (as the indicator) are added thereto, followed by sufficient shaking until the sample is completely dissolved, if necessary by warming on the water bath. After cooling, the sample solution is titrated with the 0.1 mol/l-KOH/EtOH solution until an end point of the titration determined by continuation for 30 sec of the pale red color of the indicator.

(3) Calculation

The acid value (AV (mgKOH/g)) is calculated according to the following equation.

$$AV(mgKOH/g)=B\times f\times 5.611/S,$$

B: amount of the 0.1 mol/l-KOH/EtOH solution (ml).

f: factor of the 0.1 mol/l-KOH/EtOH solution (-).

S: sample amount (g).

The hydroxyl value (an amount of KOH (mg) required for neutralizing acetic acid connected with OH group by acetylation of 1 g of sample) of the sulfur-containing polymer and the condensation resin referred to herein are based on values measured according to the following method.

(1) Reagents (a) Acetylating Agent 25 ml of acetic anhydride is placed in a 100 ml-measuring flask, and pyridine is added thereto up to a total volume of 100 ml, followed by sufficient shaking. The pyridine may be added further as desired. The acetylating agent should be stored in a brown bottle so as not to contact moisture, carbonate gas or acid vapor.

(b) Phenolphthalein Solution 1 g of phenolphthalein is dissolved in 100 ml of ethyl alcohol (95 V/V %).

(c) 0.5-mol/liter KOH-EtOH Solution 35 g of potasiumhydroxide is dissolved in a minimum amount of water and ethyl alcohol (95 V/V %) is added thereto up to a total volume of 1 liter to prepare a 0.5 mol/l-KOH/EtOH solution. After standing for 2–3 days, the solution is filtered and standardized according to JIS-K8006.

(2) Operation 0.5–20 g of a sample is accurately weighed in a round-bottomed flask and 5 ml of the acetylating agent is accurately added thereto. A small funnel is placed at the opening of the flask, and the flask is dipped in a depth of ca. 1 cm in a glycerin bath at 95–100° C. At this time, the neck of the flask is covered with a round-bored disk of cardboard so as not to heat the neck of the flask by the heat from the bath. After 1 hour, the flask is taken out of the bath and left for cooling. Then, 1 ml of water is added through the funnel and the flask is shaked to decompose the acetic anhydride. For completing the decomposition, the flask is again heated for 10 min. on the glycerin bath, and after being cooled, the walls of the funnel and the flask are washed. Then, the content of the flask is titrated with the 0.5 mol/l-KOH/EtOH solution with the phenolphthalein solution as the indicator. A blank test is performed in parallel with the above.

(3) Calculation

The hydroxyl vale ($V_{OH}$ (mgKOH/g)) is calculated according to the following equation:

$$V_{OH}(mgKOH/g)=((B-C)\times f\times 28.05)/S+D$$

B: amount of the 0.5 ml/l-KOH/EtOH solution (ml) used in the blank test.

C: amount of the 0.5 mol/l-KOH/EtOH solution (ml) used in the sample test.

f: factor of the 0.5 mol/l-KOH/EtOH solution (-)

S: sample weight (g)

D: acid value (mgKOH/g)

Examples of the condensation resin used in the present invention may include: polyester, polycarbonate, phenolic resin, epoxy resin, polyamide, and cellulose resin. Polyester is particularly preferred in view of the diversity of the material.

Polyester as a condensation resin or an ester wax composed as a release agent may be synthesized, e.g., by oxidation, synthesis from carboxylic acids or derivatives thereof, ester-introduction reactions as represented by Micheal addition, dehydrocondensation between carboxylic acid compound and alcohol compound, reaction between acid halide and alcohol compound, and ester exchange reaction. As the catalyst, ordinary acidic or alkaline catalysts may be used, such as zinc acetate and titanium compound. The reaction product may be purified by, e.g., recrystallization or distillation.

A particularly preferred production method is the dehydro-condensation between a carboxylic acid compound and an alcohol compound in view of the diversity of starting materials and easy reaction control A polyester (resin) as a preferred example of the condensation resin may preferably have a composition as follows.

The polyester may preferably comprise 45–55 mol. % of alcohol and 55–45 mol % of acid.

Examples of the alcohol component may include: diols, such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and bisphenol derivatives represented by the following formula (1):

(1)

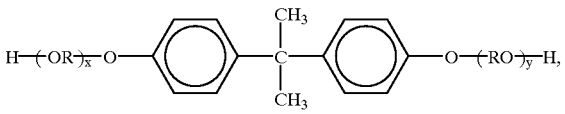

wherein R denotes an ethylene or propylene group, x and y are independently an integer of at least 1 with the proviso that the average of x+y is in the range of 2–10; diols represented by the following formula (2):

(2)

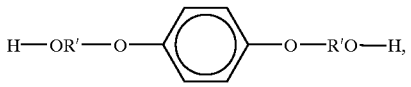

wherein R' denotes

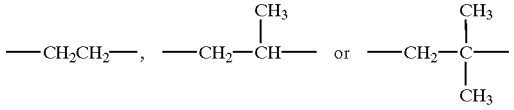

Examples of a dibasic acid may include dicarboxylic acids and derivatives thereof inclusive of: aromatic dicarboxylic acids, such as phthalic acid, terephthalic acid, isophthalic acid, phthalic anhydride, diphenyl-p,p'-dicarboxylic acid, naphthalene-2,7-dicarboxylic acid, naphthalene-2,6-dicarboxylic acid, diphenylmethane-p,p'-dicarboxylic acid, benzophenone-4,4'-dicarboxylic acid, and 1,2-diphenoxyethane-p,p'-dicarboxylic acid; alkyldicarboxylic acids, such as succinic acid, adipic acid, sebacic acid, azelaic acid, cyclohexanedicarboxylic acid, glutaric acid, triethylenedicarboxylic acid and malonic acid and their anhydrides and lower alkyl esters thereof; $C_6$–$C_{18}$ alkenyl- or $C_6$–$C_{18}$ alkyl-substituted succinic acids, such as n-dodecenylsuccinic acid and n-dodecylsuccinic acid, and their anhydrides and lower alkyl esters thereof; and unsaturated dicarboxylic acids, such as fumaric acid, maleic acid, citraconic acid and itaconic acid, and their anhydrides and lower alkyl esters thereof.

Particularly preferred examples of the alcohol component may include bisphenol derivatives represented by the above formula (1), and particularly preferred examples of the acid component may include: dicarboxylic acids, such as terephthalic acid, isophtharic acid, phthalic acid and anhydride thereof, succinic acid, n-dodecenylsuccinic acid and anhydrides of these, fumaric acid, maleic acid and maleic anhydride.

The condensation resin may be composed of such a dicarboxylic acid and a diol, but it is also possible to include a polycarboxylic acid and/or a polyhydric alcohol having three or more functional groups within an extent of not adversely affecting the present invention.

Examples of the polycarboxylic acid having at least three carboxyl groups may include polycarboxylic acids and derivatives thereof inclusive of: trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra (methylenecarboxyl)methane, 1,2,7,8-octanetetracarboxylic acid, and anhydrides and lower alkyl esters of these.

Examples of the polyhydric alcohol having at least three hydroxyl groups may include: sorbitol, 1,2,3,6-hexanetetrol, 1,4-sorbitan, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxybenzene.

The toner of the present invention can contain a charge control agent.

Examples of the negative charge control agents may include: organometallic compounds, chelate compounds, monoazo metal compounds, acetylacetone metal compounds, urea derivatives, metal-containing salicylic acid compounds, metal-containing naphthoic acid compounds, quaternary ammonium salts, calixarenes, silicon compounds, non-metallic carboxylic compounds and derivatives thereof.

Examples of the positive charge control agents may include: nigrosine and modified products thereof with aliphatic acid metal salts, etc., onium salts inclusive of quaternary ammonium salts, such as tributylbenzylammonium 1-hydroxy-4-naphtholsulfonate and tetrabutylammonium tetrafluoroborate, and their homologous inclusive of phosphonium salts, and lake pigments thereof; triphenylmethane dyes and lake pigments thereof (the laking agents including, e.g., phosphotungstic acid, phosphomolybdic acid, phosphotungsticmolybdic acid, tannic acid, lauric acid, gallic acid, ferricyanates, and ferrocyanates); higher aliphatic acid metal salts; and diorganotin oxides, such as dibutyltin oxide, dioctyltin oxide and dicyclohexyltin oxide; diorganotin borates, such as dibutyltin borate, dioctyltin borate and dicyclohexyltin borate. These may be used singly or in mixture of two or more species. Among these, nigrosine compounds and quaternary ammonium salts are preferred.

The charge control agent may be contained in 0.01–20 wt. parts, preferably 0.5 to 10 wt. parts, per 100 wt. parts of the binder resin in the toner.

The toner of the present invention contains a colorant. For example, a black colorant may comprise carbon black, a magnetic material, and a black colored mixture of yellow/magenta/cyan colorants as described below.

Examples of the yellow colorant may include: pigments comprising compounds represented by condensed azo compounds, isoindolinone compounds, anthraquinone compounds, azo metal complex, methine compounds and arylamide compounds. Specific pigments suitably used may include: C.I. Pigment Yellow 3, 7, 10, 12, 13, 14, 15, 17, 23, 24, 60, 62, 74, 75, 83, 93, 94, 95, 99, 100, 101, 104, 108, 109, 110, 111, 117, 123, 128, 129, 138, 139, 147, 148, 150, 166, 168, 169, 177, 179, 180, 181, 183, 185, 191:1, 191, 192, 193, and 199. specific examples of dyes may include: C.I. Solvent Yellow 33, 56, 79, 82, 93, 112, 162, 163, C.I. disperse Yellow 42, 64, 201 and 211.

Examples of the magenta colorant may include: condensed azo compounds, diketopyrrolopyrrole compounds, anthraquinone, quinacridone compounds, basic dye lake compounds, naphthol compounds, benzimidazolone compounds, thioindigo compounds and perylene compounds. Particularly preferred pigments may include: C.I. Pigment Red 2, 3, 5, 6, 7, 23, 48:2, 48:3, 48:4, 57:1, 81:1, 122, 146, 166, 169, 177, 184, 185, 202, 206, 220, 221, 254 and C.I. Pigment Violet 19.

Examples of the cyan colorant may include: copper phthalocyanine compound and derivatives thereof, anthraquinone compounds, and basic dye lake compounds. Particularly suitably usable pigments may include: C.I. Pigment Blue 1, 7, 15, 15:1, 15:2, 15:3, 15:4, 60, 62 and 66.

These colorants may be used singly or in combination of two or more species in a form of mixture or solid solution. Particular colorants to be used in the present invention may be appropriately be selected from the above in view of the angle of saturation, brightness, weatherability, transparency for OHP use and dispersibility in the toner particles. The colorant may be added in a proportion of 1 to 20 wt. parts per 100 wt. parts of the binder resin.

The toner of the present invention can also be formed as a magnetic toner by incorporating a magnetic material. In this case, the magnetic material can also be used as a colorant. Examples of the magnetic material used for constituting such a magnetic toner may include: iron oxides, such as magnetite, hematite and ferrite; metals, such as iron, cobalt and nickel, and alloys of these metals, such as aluminum, cobalt, copper, lead, magnesium, tin, zinc, antimony, beryllium, bismuth, cadmium, calcium, manganese, selenium, titanium, tungsten and vanadium, and mixtures of these.

The magnetic material used in the present invention may preferably comprise a surface-treated magnetic material. For use in the polymerization process toner production, it is preferred to surface-treat the magnetic material for hydrophobization with a surface-treating agent which has no polymerization-inhibiting function. Examples of such surface-treating gent may include: silane coupling gents and titanate coupling agents.

The magnetic material may preferably have an average particle size of at most 2 $\mu$m, preferably ca. 0.1–0.5 $\mu$m, and may preferably be contained in 20–200 wt. parts, particularly 40–150 wt. parts, per 100 wt. parts of the binder resin in the toner.

The magnetic material may preferably have magnetic properties including a coercive force (Hc) of 1.59–23.9 kA/m (20–300 oersted), a saturation magnetization ($\sigma s$) of 50–20 emu/g and a residual magnetization ($\sigma r$) of 2–20 emu/g, as measured under application of 796 kA/m (10 k-oersted).

The toner according to the present invention can further include external additives added for improving various properties of the toner. Such external additives may preferably have a particle size which is at most ⅕ of the volume-average particle size of the toner. Herein, the particle size of an external additive means an average particle size as determined by observation of toner surfaces through an electron microscope. Examples of such external additives may include the following.

Examples of flowability-improving agents may include: fine powder of metal oxides, such as silicon oxide, aluminum oxide, titanium oxide and hydrotalcite; carbon black and fluorinated carbon. It is preferred to use these fine powders after hydrophobization.

Examples of the abrasives may include: metal oxides, such as strontium titanate, cerium oxide, aluminum oxide, magnesium oxide, and chromium oxide; nitrides, such as silicon nitride; carbides, such as silicon carbide; and metal salts, such as calcium sulfate, barium sulfate and calcium carbonate.

Examples of the lubricants may include: powders of fluorine-containing resins, such as vinylidene fluoride resin, and polytetrafluoroethylene; and fatty acid metal salts, such as zinc stearate and calcium stearate.

Charge-controlling particles may include: particles of metal oxides, such as tin oxide, titanium oxide, zinc oxide, silicon oxide and aluminum oxide; and carbon black.

These external additives may be added in 0.1–10 wt. parts, preferably 0.1–5 wt. parts, per 100 wt. parts of the toner particles. These additives may be added singly or in combination of two or more species.

The toner according to the present invention may preferably exhibit an agglomeratability (Dagg) (or, cohesion) of 1–50%, more preferably 1–30%, further preferably 4–30%, particularly preferably 4–20%, in view of the developing performance. A lower Dagg value represents a higher flowability and a higher Dagg value represents a lower flowability of the toner.

The agglomeratability (Dagg) (%) of a toner sample may be measured in the following manner.

A powder tester (mfd. by Hosokawa Micron K.K.) is used. On a vibration table of the powder tester, a 400-mesh sieve (opening=33 μm), a 200-mesh sieve (opening=77 μm) and a 100-mesh sieve (opening=154 μm) are set in a stacked form in this order, and the vibration table is supplied with an input voltage of 15 volts so as to provide a vibration table vibration width in the range of 60–90 μm. Then, 5 g of a sample is placed gently on the uppermost 100-mesh sieve, and the sieves are vibrated for ca. 25 sec. Then, the amounts of the toner on the respective sieves are measured to calculate an agglomeratability (Dagg.) according to the following equation:

$$\text{Agglomeratability}(Dagg)(\%)=(\text{toner weight } (g) \text{ on 100-mesh sieve}/5\ (g))\times 100+(\text{toner weight } (g) \text{ on 200-mesh sieve}/5\ (g))\times 100\times 3/5+(\text{toner weight } (g) \text{ on 400-mesh sieve}/5\ (g))\times 100\times 1/5$$

A sample is left to stand for 7 days in an environment of 20° C./60%RH before the measurement.

The toner of the present invention may preferably have a glass-transition temperature (Tg) of 40 to 90° C., more preferably 50 to 80° C., further preferably 50 to 70° C. Below 40° C., the toner is liable to have a lower anti-blocking property. Above 90° C., the toner is liable to have a lower anti-low-temperature offset property and a lower transparency for providing overhead projector (OHP) transparent image films.

It is also preferred that the toner shows a thermal behavior providing a DSC heat-absorption peak showing a half-value width of at most 14° C., more preferably at most 7° C., further preferably at most 4° C. Above 14° C., the toner is liable to soil the associated members inclusive of the image-bearing member and fail in provide images of good uniformity.

The glass-transition temperature and half-value width of the toner may also be measured in the same manners as the above-described DSC measurement according to JIS-K0070.

The THF-soluble content in the toner binder resin may preferably have a THF-insoluble content of at most 90 wt. %, more preferably at most 70 wt. %, most preferably at most 65 wt. %. In the case of a toner obtained through a melt-kneading step, the THF-insoluble content may preferably be at most 30 wt. %, at most 20 wt. %, most preferably at most 15 wt. %.

The THF-insoluble content in the binder resin means an ultra-high molecular weight polymer component (substantially, a crosslinked polymer component) which has become insoluble in solvent THF (tetrahydrofuran). The THF-insoluble component referred to herein is based on values measured in the following manner.

Ca. 1 g of a resin sample is accurately weighed at $W_1$ g, placed on a cylindrical filter paper (e.g., "No. 86R", made by Toyo Roshi K.K.) and then placed on a Soxhlet extractor for extraction with 100–200 ml of THF for 6 hours. The THF-soluble content extracted with THF is then recovered by evaporating the THF, and after being dried at 100° C. under vacuum for several hours, is weighed at $W_2$ g. The THF-insoluble content is calculated according to the following equation:

$$\text{THF-insoluble content(wt. \%)}=((W_1-W_2)/W_1)\times 100.$$

The toner according to the present invention may preferably have a number-average particle size (D1) based on circle-equivalent diameters ($D_{CE}$), an average circularity (Cav) of 0.920 to 0.995 and a standard deviation of circularity (SDc) of below 0.004, respectively as measured by a flow particle image analyzer. It is further preferred that the average circularity (Cav) is 0.950 to 0.995, more preferably 0.970 to 0.995, and the standard deviation of circularity (SDc) is below 0.035, more preferably from 0.015 to below 0.035. It is further preferred that the toner contains at most 15% by number of toner particles having a circularity (Ci) below 0.950 It is also preferred that the toner shows a number-basis variation coefficient (=$V_N$=SDc/Cav) of at most 0.35, more preferably at most 0.30.

The toner showing a number-average particle size (D1) of 2–10 μm is excellent in reproducibility of image contour, particularly in development of character images and line images. However, in case where the toner size is reduced, the proportion of smaller toner particles is naturally increased, so that it becomes generally difficult to uniformly charge the toner, thus being liable to result in image fog and exhibit a larger attachment force onto the image-bearing member and the developer carrying member. As a result, the developing performance is liable to be lowered consequently.

However, if the toner is formed in an increased average circularity (Cav) of 0.920 to 0.995, preferably 0.950 to 0.995, further preferably 0.970 to 0.995, the transferability of such a small-particle size toner is remarkably improved together with a remarkable improvement in developing performance.

Further, by reducing the circularity standard deviation (SDc) to below 0.040, preferably below 0.035, the toner of the present invention can be provided with a remarkably improved developing performance.

This is presumably because such a toner having a smaller circularity standard deviation has a closely uniform chargeability of toner particles, so that individual toner particles receive good and uniform triboelectric charging force and conveying force from the toner layer thickness-regulating member and the developer-carrying member to form a layer of toner particles having a uniform charge and an appropriate thickness on the developer-carrying member.

If the toner of the present invention containing a sulfur-containing polymer and also a specific dispersion stabilizer element is also provided with a circularity distribution as mentioned above, the toner can exhibit further increased developing efficiency and transfer efficiency of solid and line image portions to provide images of a higher uniformity not only in normal temperature/normal humidity environment but also in low temperature/low humidity environment and high temperature/high humidity environment because the chargeability and transferability of the toner has been improved compared with a toner not satisfying such a circularity distribution. This is presumably because the toner chargeability is further uniformized because of the uniformized circularity distribution in addition to the improved environmental performances inclusive of freeness from moisture absorption and charge leakage stability due to the inclusion of the sulfur-containing polymer and the specific dispersion stabilizer element.

The toner satisfying the above-mentioned morphological characteristic (circularity distribution and particle size) is also very advantageous in a development of latent images formed of minute spots according to the digital scheme and formation of full-color images involving a plurality of transfer steps by using an intermediate transfer member, and exhibits good watching with the image forming apparatus.

The average circularity (Cav) is used herein as a quantitative measure for evaluating particle shapes and based on values measured by using a flow-type particle image analyzer ("FPIA-1000", mfd. by Toa Iyou Denshi K.K.). A circularity (Ci) of each individual particle is determined according to an equation (1) below, and the circularity values (Ci) are totaled and divided by the number of total particles (m) to determine an average circularity (Cav) as shown in an equation (2) below:

$$\text{Circularity } Ci = L_0/L, \tag{1}$$

wherein L denotes a circumferential length of a particle projection image, and $L_0$ denotes a circumferential length of a circle having an area identical to that of the particle projection image.

$$\text{Average circularity } (Cav) = \sum_{i=1}^{m} Ci/m \tag{2}$$

Incidentally, for actual calculation of an average circularity (Cav), the measured circularity values of the individual particles were divided into 61 classes in the circularity range of 0.40–1.00, i.e., from 0.400–0.410, 0.410–0.420, . . . , 0.990–1.000 (for each range, the upper limit is not included) and 1.000, and a central value of circularity of each class was multiplied with the frequency of particles of the class to provide a product, which was then summed up to provide an average circularity. It has been confirmed that the thus-calculated average circularity (Cav) is substantially identical to an average circularity value obtained (according to Equation (2) above) as an arithmetic mean of circularity values directly measured for individual particles without the above-mentioned classification adopted for the convenience of data processing, e.g., for shortening the calculation time.

Further, the number-average particle size (D1) is calculated according to the following formula based on circle-equivalent diameters ($D_{CE}$) measured by the FPIA measurement.

$$D1 = \sum_{i=1}^{n} (Fi \times D_{CE}i) \Big/ \sum_{i=1}^{n} Fi,$$

wherein Fi represents a frequency (number) of particles appearing in an i-th channel among totally n channels for the FPIA measurement and $D_{CE}i$ represents a central value of circle-equivalent diameter ($D_{CE}$) of the i-th channel. In the FPIA measurement, a $D_{CE}$ range of 0.60–400.0 μm is designed to be divided into channels as shown in the following Table 1, wherein each channel does not include the upper limit value. (Actually, the channels of 159.21 μm or smaller were used for the measurement giving the values described herein.)

TABLE 1

| Particle size (circle-equivalent diameter) ranges for Flow Particle Image Analyzer |
|---|
| Size (μm) |
| 0.60–0.61 |
| 0.61–0.63 |
| 0.63–0.65 |
| 0.65–0.67 |
| 0.67–0.69 |
| 0.69–0.71 |
| 0.71–0.73 |

TABLE 1-continued

| Particle size (circle-equivalent diameter) ranges for Flow Particle Image Analyzer |
|---|
| Size (μm) |
| 0.73–0.75 |
| 0.75–0.77 |
| 0.77–0.80 |
| 0.80–0.82 |
| 0.82–0.84 |
| 0.84–0.87 |
| 0.87–0.89 |
| 0.89–0.92 |
| 0.92–0.95 |
| 0.95–0.97 |
| 0.97–1.00 |
| 1.00–1.03 |
| 1.03–1.06 |
| 1.06–1.09 |
| 1.09–1.12 |
| 1.12–1.16 |
| 1.16–1.19 |
| 1.19–1.23 |
| 1.23–1.26 |
| 1.26–1.30 |
| 1.30–1.34 |
| 1.34–1.38 |
| 1.38–1.42 |
| 1.42–1.46 |
| 1.46–1.50 |
| 1.50–1.55 |
| 1.55–1.59 |
| 1.59–1.64 |
| 1.64–1.69 |
| 1.69–1.73 |
| 1.73–1.79 |
| 1.79–1.84 |
| 1.84–1.89 |
| 1.89–1.95 |
| 1.95–2.00 |
| 2.00–2.06 |
| 2.06–2.12 |
| 2.12–2.18 |
| 2.18–2.25 |
| 2.25–2.31 |
| 2.31–2.38 |
| 2.38–2.45 |
| 2.45–2.52 |
| 2.52–2.60 |
| 2.60–2.67 |
| 2.67–2.75 |
| 2.75–2.83 |
| 2.83–2.91 |
| 2.91–3.00 |
| 3.00–3.09 |
| 3.09–3.18 |
| 3.18–3.27 |
| 3.27–3.37 |
| 3.37–3.46 |
| 3.46–3.57 |
| 3.57–3.67 |
| 3.67–3.78 |
| 3.78–3.89 |
| 3.89–4.00 |
| 4.00–4.12 |
| 4.12–4.24 |
| 4.24–4.36 |
| 4.36–4.49 |
| 4.49–4.62 |
| 4.62–4.76 |
| 4.76–4.90 |
| 4.90–5.04 |
| 5.04–5.19 |
| 5.19–5.34 |
| 5.34–5.49 |
| 5.49–5.65 |
| 5.65–5.82 |
| 5.82–5.99 |
| 5.99–6.16 |

TABLE 1-continued

| Particle size (circle-equivalent diameter) ranges for Flow Particle Image Analyzer |
|---|
| Size (μm) |
| 6.16–6.34 |
| 6.34–6.53 |
| 6.53–6.72 |
| 6.72–6.92 |
| 6.92–7.12 |
| 7.12–7.33 |
| 7.33–7.54 |
| 7.54–7.76 |
| 7.76–7.99 |
| 7.99–8.22 |
| 8.22–8.46 |
| 8.46–8.71 |
| 8.71–8.96 |
| 8.96–9.22 |
| 9.22–9.49 |
| 9.49–9.77 |
| 9.77–10.05 |
| 10.05–10.35 |
| 10.35–10.65 |
| 10.65–10.96 |
| 10.96–11.28 |
| 11.28–11.61 |
| 11.61–11.95 |
| 11.95–12.30 |
| 12.30–12.66 |
| 12.66–13.03 |
| 13.03–13.41 |
| 13.41–13.80 |
| 13.80–14.20 |
| 14.20–14.62 |
| 14.62–15.04 |
| 15.04–15.48 |
| 15.48–15.93 |
| 15.93–16.40 |
| 16.40–16.88 |
| 16.88–17.37 |
| 17.37–17.88 |
| 17.88–18.40 |
| 18.40–18.94 |
| 18.94–19.49 |
| 19.49–20.06 |
| 20.06–20.65 |
| 20.65–21.25 |
| 21.25–21.87 |
| 21.87–22.51 |
| 22.51–23.16 |
| 23.16–23.84 |
| 23.84–24.54 |
| 24.54–25.25 |
| 25.25–25.99 |
| 25.99–26.75 |
| 26.75–27.53 |
| 27.53–28.33 |
| 28.33–29.16 |
| 29.16–30.01 |
| 30.01–30.89 |
| 30.89–31.79 |
| 31.79–32.72 |
| 32.72–33.67 |
| 33.67–34.65 |
| 34.65–35.67 |
| 35.67–36.71 |
| 36.71–37.78 |
| 37.78–38.88 |
| 38.88–40.02 |
| 40.02–41.18 |
| 41.18–42.39 |
| 42.39–43.62 |
| 43.62–44.90 |
| 44.90–46.21 |
| 46.21–47.56 |
| 47.56–48.94 |
| 48.94–50.37 |
| 50.37–51.84 |

TABLE 1-continued

| Particle size (circle-equivalent diameter) ranges for Flow Particle Image Analyzer |
|---|
| Size (μm) |
| 51.84–53.36 |
| 53.36–54.91 |
| 54.91–56.52 |
| 56.52–58.17 |
| 58.17–59.86 |
| 59.86–61.61 |
| 61.61–63.41 |
| 63.41–65.26 |
| 65.26–67.16 |
| 67.16–69.12 |
| 69.12–71.14 |
| 71.14–73.22 |
| 73.22–75.36 |
| 75.36–77.56 |
| 77.56–79.82 |
| 79.82–82.15 |
| 82.15–84.55 |
| 84.55–87.01 |
| 87.01–89.55 |
| 89.55–92.17 |
| 92.17–94.86 |
| 94.86–97.63 |
| 97.63–100.48 |
| 100.48–103.41 |
| 103.41–106.43 |
| 106.43–109.53 |
| 109.53–112.73 |
| 112.73–116.02 |
| 116.02–119.41 |
| 119.41–122.89 |
| 122.89–126.48 |
| 126.48–130.17 |
| 130.17–133.97 |
| 133.97–137.88 |
| 137.88–141.90 |
| 141.90–146.05 |
| 146.05–150.31 |
| 150.31–154.70 |
| 154.70–159.21 |
| 159.21–163.86 |
| 163.86–168.64 |
| 168.64–173.56 |
| 173.56–178.63 |
| 178.63–183.84 |
| 183.84–189.21 |
| 189.21–194.73 |
| 194.73–200.41 |
| 200.41–206.26 |
| 206.26–212.28 |
| 212.28–218.48 |
| 218.48–224.86 |
| 224.86–231.42 |
| 231.42–238.17 |
| 238.17–245.12 |
| 245.12–252.28 |
| 252.28–259.64 |
| 259.64–267.22 |
| 267.22–275.02 |
| 275.02–283.05 |
| 283.05–291.31 |
| 291.31–299.81 |
| 299.81–308.56 |
| 308.56–317.56 |
| 317.56–326.83 |
| 326.83–336.37 |
| 336.37–346.19 |
| 346.19–356.29 |
| 356.29–366.69 |
| 366.69–377.40 |
| 377.40–388.41 |
| 388.41–400.00 |

More specifically, the above-mentioned FPIA measurement is performed in the following manner. Into 10 ml of water containing ca. 0.1 mg of a nonionic surfactant, ca. 5 mg of a toner sample is dispersed and subjected to 5 min. of dispersion by application of ultrasonic wave (20 kHz, 50 W), to form a sample dispersion liquid containing 5,000–20,000 particles/$\mu$l. The sample dispersion liquid is subjected to the FPIA analysis for measurement of the average circularity (Cav) and circle equivalent diameters (DCE) in a range of 0.60 $\mu$m to 159.21 $\mu$m.

The details of the measurement is described in a technical brochure and an attached operation manual on "FPIA-1000" published from Toa Iyou Denshi K.K. (Jun. 25, 1995) and JP-A 8-136439 (U.S. Pat. No. 5,721,433). The outline of the measurement is as follows.

A sample dispersion liquid is caused to flow through a flat thin transparent flow cell (thickness=ca. 200 $\mu$m) having a divergent flow path. A strobe and a CCD camera are disposed at mutually opposite positions with respect to the flow cell so as to form an optical path passing across the thickness of the flow cell. During the flow of the sample dispersion liquid, the strobe is flashed at intervals of 1/30 second each to capture images of particles passing through the flow cell, so that each particle provides a two-dimensional image having a certain area parallel to the flow cell. From the two-dimensional image area of each particle, a diameter of a circle having an identical area (an equivalent circle) is determined as a circle-equivalent diameter ($D_{CE}=L_0/\pi$. Further, for each particle, a peripheral length ($L_0$) of the equivalent circle is determined and divided by a peripheral length (L) measured on the two-dimensional image of the particle to determine a circularity Ci of the particle according to the above-mentioned formula (1).

The "circularity" referred to above is a measure of roundness of a toner particle. A circularity of 1.00 means that the toner particle has a shape of perfect sphere, and a lower circularity represents a complex shape of the toner particle.

A toner having an indefinite shape generally has a lower uniformity of chargeability at convex and concave parts of the toner particles and is caused to have an increased area of contact with the image-bearing member, so that it is liable to results in an increased amount of transfer residual toner.

Next, some processes for producing the toner of the present invention will be described.

Various processes may be adopted for producing the toner of the present invention, inclusive of: direct toner production according to suspension polymerization as disclosed in JP-B 36-10231, JP-A 59-53856 and JP-A 59-61842; toner production according to emulsion polymerization as represented by soap-free polymerization wherein toner particles are directly formed by polymerization of a monomer in the presence of a water-soluble polymerization initiator which is soluble in the monomer but insoluble in the resultant polymer; toner production according to interfacial polymerization or in-situ polymerization as used in microencapsulation; toner production by coacervation; toner production by association polymerization wherein fine particles of at least one species are agglomerated into a desired particle size as disclosed in JP-A 62-106473 and JP-A 63-186253; toner production according to dispersion polymerization characterized by mono-dispersion; toner production by emulsion dispersion wherein resinous toner ingredients are dissolved in a non-water-soluble organic solvent and converted into toner particles in water; the pulverization process wherein toner ingredients are uniformly kneaded and dispersed in a pressure kneader, an extruder or a media dispersing apparatus, the kneaded product after being cooled is finely pulverized into a desired toner particle size mechanically or by impingement under a jet stream onto a target, and the pulverized product is classified into toner particles having a sharper particle size distribution; and a process of sphering toner particles from the pulverization process, e.g., by heating in a solvent.

Among the above, the suspension polymerization process, the association polymerization process and the emulsion dispersion process, are preferred.

The suspension polymerization process capable of easily producing a small-particle size toner is further preferred. It is also possible to suitably apply the seed polymerization process wherein a monomer is adsorbed onto polymerizate particles once formed by the suspension polymerization and polymerized by using a polymerization initiator. In this instance, it is also possible to incorporate a polar compound by dispersion or dissolution in the monomer to be adsorbed.

The toner production by the suspension polymerization may be performed in the following manner. Into a monomer, the release agent, the colorant, the sulfur-containing polymer, a polymerization initiator, a crosslinking agent and other additives, are dissolved or dispersed to form a monomer composition, which is then dispersed in an aqueous medium containing therein a dispersion stabilizer having an element selected from magnesium, calcium, barium, zinc, aluminum and phosphorus by means of an ordinary stirrer, a homomixer or a homogenizer. Preferably, the stirring speed and time are adjusted so as to provide a desired size of droplets of the monomer composition corresponding to the desired toner particle size. Thereafter, the stirring is continued at such an intensity as to maintain the droplet size and prevent the sedimentation of the droplets. The polymerization temperature may be at least 40° C., ordinarily 50–95° C., preferably 55–85° C., and can be elevated at the final stage of polymerization. It is also possible to change the system pH during the polymerization. Further, in order to remove yet-unpolymerized monomer and by-products which can cause odor at the time of fixation, it is possible to distill off a portion of aqueous medium at the final stage of or after the polymerization. After the polymerization, the resultant polymerizate particles are washed, recovered, e.g., by filtration and dried to provide toner particles.

The pH of the aqueous medium during the droplet formation is not particularly restricted but may preferably be 4.5–13.0, more preferably 4.5–12.0, further preferably 4.5–11.0, most preferably 4.5–7.5. At a pH below 4.5, a portion of the dispersion stabilizer can be dissolved to lower the dispersion stabilizing effect, thus being liable to fail in droplet dispersion in some cases. At a pH above 13.0, some component in the monomer composition can be decomposed, thus failing to exhibit a sufficient chargeability in some cases. If the droplet formation is effected in an acidic side pH region, it is possible to suppress the inclusion of an excessive amount of the dispersion stabilizer element in the toner, so that it becomes easy to attain a toner satisfying the requirement of the present invention.

It is further preferred that the polymerizate particles are washed with an acid at a pH of at most 3, more preferably at most 1.5. By washing the particles with an acid, it becomes possible to reduce the amount of the dispersion stabilizer remaining at the toner particle surfaces. The acid used for the washing is not particularly restricted, and an inorganic acid, such as hydrochloric acid or sulfuric acid, may be used.

Examples of the dispersion stabilizer suitably used in the present invention may include: magnesium phosphate, calcium phosphate, aluminum phosphate, zinc phosphate, magnesium carbonate, calcium carbonate, magnesium hydroxide, calcium hydroxide, aluminum hydroxide, calcium metasilicate, calcium sulfate, barium sulfate, and hydroxy apatite.

In addition to the above-mentioned dispersion stabilizer, it is also possible to use in combination an organic dispersion aid, such as polyvinyl alcohol, gelatin, methyl cellulose, methyl hydroxypropyl cellulose, ethyl cellulose, carboxymethyl cellulose sodium salt, or starch.

The dispersion stabilizer may preferably be used in a proportion of 0.1–2.0 wt. parts per 100 wt. parts of the polymerizable monomer.

In order to achieve fine dispersion of the dispersion stabilizer, it is also possible to use 0.001 to 0.1 wt. % of a surfactant in combination. A commercially available nonionic, anionic or cationic surfactant may be used. Specific examples thereof may include: sodium dodecylsulfate, sodium tetradecyl sulfate, sodium pentadecylsulfate, sodium octylsulfate, sodium tetradecylsulfate, sodium pentadecylsulfate, sodium octylsulfate, sodium oleate, sodium laurate, potassium stearate, and calcium oleate.

As the polymerizable monomer used for polymerization process toner production of the toner according to the present invention, a vinyl-polymerizable monomer capable of radical polymerization may be used.

The vinyl-polymerizable monomer may comprise a monofunctional monomer or a polyfunctional monomer. Examples of the monofunctional monomer may include: styrene; styrene derivatives, such as α-methylstyrene, β-methylstyrene, o-methylstyrene, m-methylstyrene, p-methylstyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene and p-phenylstyrene; acrylic monomers, such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate n-nonyl acrylate, cyclohexyl acrylate, benzyl acrylate, dimethylphosphateethyl acrylate, diethylphosphateethyl acrylate, dibutylphosphateethyl acrylate, and 2-benzoyloxyethyl acrylate; methacrylate monomers, such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl-methacrylate, diethylphosphateethyl methacrylate; and dibutylphosphateethyl methacrylate; methylmonocarboxylic acid esters; vinyl esters, such as vinyl acetate, vinyl propionate, vinyl lactate, vinylbenzoate, and vinyl formate; vinyl ethers, such as vinyl methyl ether, vinyl ethyl ether, and vinyl isobutyl ether; and vinyl ketones, such as vinyl methyl ketone, vinyl hexyl ketone and vinyl isopropyl ketone.

Examples of the poly-functional monomer may include: diethylene glycol diacrylate, triethylene glycol diacrylate, tetraethylene glycol diacrylate, polyethylene glycol diacrylate, 1,6-hexanediole diacrylate, neopentyl glycol diacrylate, tripropylene glycol diacrylate, polypropylene glycol diacrylate, 2,2'-bis(4-(acryloxy-diethoxy)phenyl) propane, trimethylolpropane triacrylate, tetramethylmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis(4-methacryloxydiethoxy)-phenyl)propane, 2,2'-dis(4-methacryloxy polyethoxy)-phenyl)propane, trimethylpropane trimethacrylate, tetramethylmethane tetramethacrylate, divinylbenzene, divinylnaphthalene and divinyl ether.

In the present invention, the above-mentioned monofunctional monomers may be used singly or in combination of two or more species, or in combination with one or more of the polyfunctional monomers. The polyfunctional monomer can also be used as a crosslinking agent.

The polymerization initiator used for polymerization of the above-mentioned polymerizable monomers may be an oil-soluble initiator and/or a water-soluble initiator. Examples of the oil-soluble initiator may include: azo-compounds, such as 2,2'-azobisisobutyronitrile, 2,2'-azobis-2,4-dimethylvaleronitrile, 1,1'-azobis(cyclohexane-1-carbonitrile), and 2,2'-azobis-4-methoxy-2,4-dimethylvaleronitrile; and peroxide initiators, such as acetylcyclohexylsulfonyl peroxide, diisopropyl peroxycarbonate, decanonyl peroxide, lauroyl peroxide, stearoyl peroxide, propionyl peroxide, acetyl peroxide, t-butyl proxy-2-ethylhexanoate, benzoyl peroxide, t-butyl peroxyisobutyrate, cyclohexanone peroxide, methyl ethyl ketone peroxide, dicumyl peroxide, t-butyl hydroperoxide, di-t-butyl peroxide, and cumene hydroperoxide.

Examples of the water-soluble initiator may include: ammonium persulfate, potassium persulfate, 2,2'-azobis(N, N'-dimethyleneisobutyroamidine) hydrochloride, 2,2'-azobis(2-amidinopropane) hydrochloride, azobis (isobutylamidine) hydrochloride, sodium 2,2'-azobisisobutyronitrile sulfonate, ferrous sulfate and hydrogen peroxide.

In order to control the polymerization degree of the polymerizate, it is also possible to add a chain transfer agent, a polymerization inhibitor, etc.

In the present invention, it is also possible to provide a binder resin having a crosslikage by using a crosslinking agent, which may be a compound having two or more polymerizable double bonds. Examples thereof may include: aromatic divinyl compounds, such as divinylbenzene and divinylnaphthalene; carboxylate esters having two double bonds, such as ethylene glycol diacrylate, ethylene glycol dimethacrylate, and 1,3-butanediol dimethacrylate; divinyl compounds, such as divinylaniline, divinyl ether, divinyl sulfide and divinylsulfone; and compounds having 3 or more vinyl groups. These compounds may be used singly or in mixture.

The toner of the present invention can be used as a toner for a mono-component developer or also as a toner for a two-component developer in combination with carrier particles.

When constituted as a magnetic toner containing a magnetic material and constituting a mono-component developer, the magnetic toner can be conveyed and charged while being carried on a developing sleeve enclosing a magnet. When constituted as a non-magnetic toner not containing a magnetic material, the toner can be applied or pressed against a sleeve by a blade or a roller so as to be charged and conveyed thereby to a developing zone.

For constituting a two-component developer, the toner of the present invention may be blended with a magnetic carrier. The magnetic carrier may comprise particles of elements, such as iron, copper, zinc, nickel, cobalt, manganese and chromium alone, or in the form of oxides or complex ferrites. The magnetic carrier particles may have a spherical, flat or indefinite shape. It is also preferred to control the surface microstructure, such as surface unevenness of the magnetic carrier particles. Generally, inorganic oxides as described above, after calcination, are formed into carrier particles, followed by coating to magnetic carrier core particles. In order to reduce the weight load or stress of the magnetic carrier acting on the toner, it is possible to melt-knead the inorganic oxide and a resin, followed by pulverization and classification, to provide a low-density dispersion carrier, or form true-spherical magnetic carrier particles by subjective a kneaded mixture of the inorganic oxide and a monomer to suspension polymerization in an aqueous medium.

A coated carrier formed by coating the above carrier particles with a resin is particularly preferred. The coating may be performed by applying a solution or dispersion of a resin onto carrier particles, or blending of such resin powder and carrier particles for attachment.

The coating material for coating carrier particles surfaces may vary depending on the toner material, but examples thereof may include: polytetrafluoroethylene, monochlorotrifluoroethylene polymer, polyvinylidene fluoride, silicone resin, polyester resin, styrene resin, acrylic resin, polyamide, polyvinyl butyral and aminoacrylate resin.

The carrier may preferably have magnetic properties, after magnetic saturation, including a magnetization at 79.6 kA/m (1 k-oersted) ($\sigma_{1000}$) of 30–300 emu/cm$^3$, more preferably 100 to 250 emu/cm$^3$. Above 300 emu/cm$^3$, it becomes difficult to form high-quality toner images. On the other hand, below 30 emu/cm$^3$, carrier attachment is liable to occur due to insufficient constraint force acting on the carrier particles.

The carrier particles may preferably have a shape factor SF-1 (representing a roundness) of at most 180 and a shape factor SF-2 (representing an unevenness) of at most 250 according to the following formulae based on analysis of carrier particle shapes through a particle image analyzer (e.g., "Luzex III", available from Nireco K.K.).

$$SF-1 = \{(\text{maximum carrier particle chord length})^2 / (\text{carrier particle projection area})\} \times (\pi/4) \times 100$$

$$SF-2 = \{(\text{carrier particle peripheral length})^2 / (\text{carrier particle projection area})\} \times (1/4\pi) \times 100$$

In the case of providing a two-component developer, the toner of the present invention may be blended with a magnetic carrier so as to provide a toner concentration of 2–15 wt. %, preferably 4–13 wt. %, in the resultant developer.

Hereinbelow, some embodiments of image forming methods to which the toner of the present invention is applicable will be described with reference to drawings.

Figure 3:
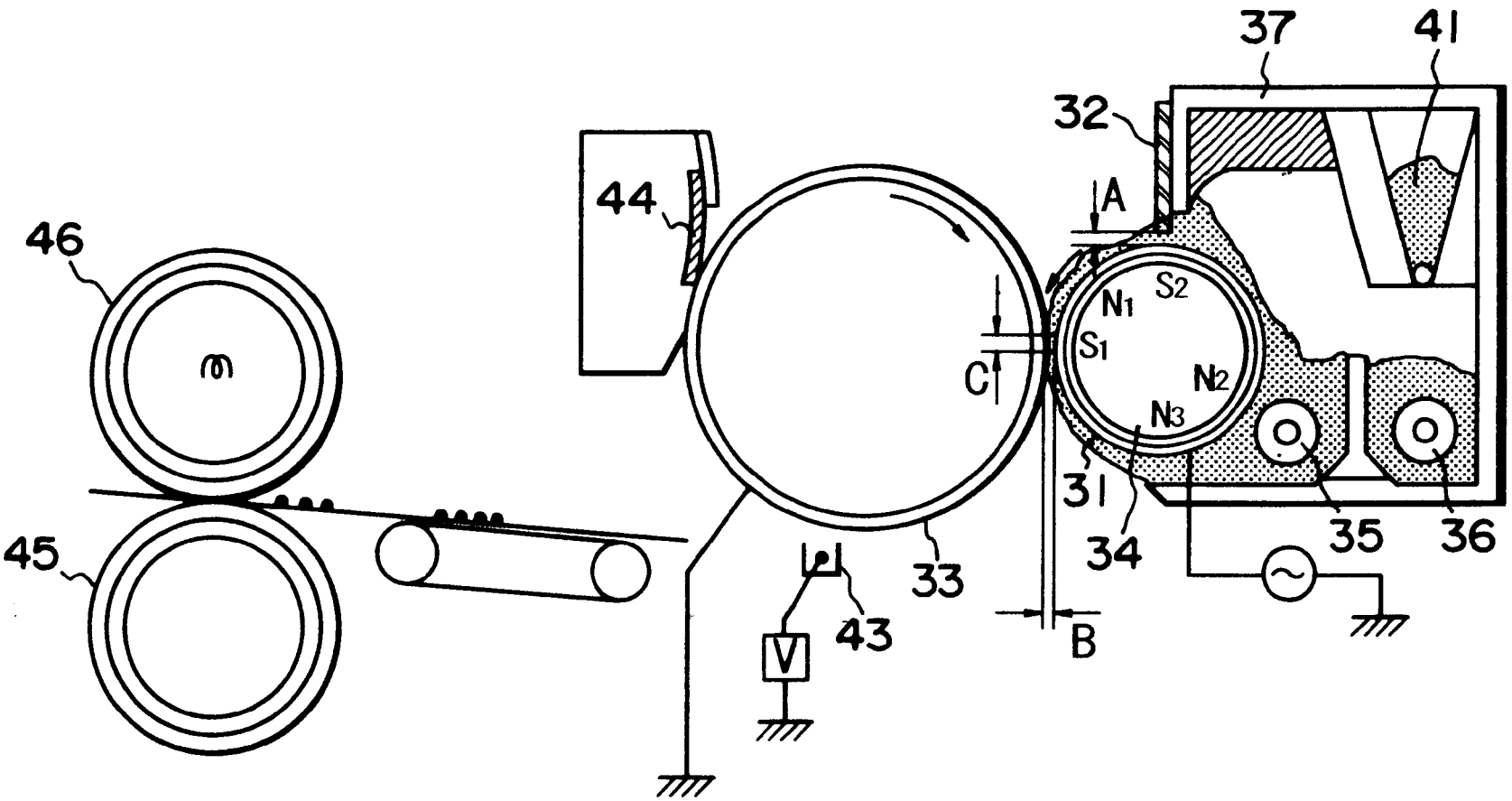
FIG. 3 illustrates an image forming apparatus including a developing device suitable for using a toner of the invention.

A non-magnetic toner according to the present invention may be blended with a magnetic carrier and may be used for development by using a developing means 37 as shown in FIG. 3. It is preferred to effect a development in a state where a magnetic brush contacts a latent image-bearing member, e.g., a photosensitive drum 33 under application of an alternating electric field. A developer-carrying member (developing sleeve) 31 may preferably be disposed to provide a gap B of 100–1000 $\mu$m from the photosensitive drum 33 in order to prevent the toner attachment and improve the dot reproducibility. If the gap is narrower than 100 $\mu$m, the supply of the developer is liable to be insufficient to result in a low image density. In excess of 1000 $\mu$m, the lines of magnetic force exerted by a developing pole S1 is spread to provide a low density of magnetic brush, thus being liable to result in an inferior dot reproducibility and a weak carrier constraint force leading to carrier attachment. The toner 41 in a hopper is successively supplied to the developer container, blended with the carrier by stirring means 35 and 36 and supplied onto the developing sleeve 31 enclosing a magnet 34.

The alternating electric field may preferably have a peak-to-peak voltage of 500–5000 volts and a frequency of 500–10000 Hz, preferably 500–3000 Hz, which may be selected appropriately depending on the process. The waveform therefor may be appropriately selected, such as triangular wave, rectangular wave, sinusoidal wave or waveforms obtained by modifying the duty ratio. If the application voltage is below 500 volts it may be difficult to obtain a sufficient image density and fog toner on a non-image region cannot be satisfactorily recovered in some cases. Above 5000 volts, the latent image can be disturbed by the magnetic brush to cause lower image qualities in some cases.

By using a two-component type developer containing a well-charged toner, it becomes possible to use a lower fog-removing voltage (Vback) and a lower primary charge voltage on the photosensitive member, thereby increasing the life of the photosensitive member. Vback may preferably be at most 150 volts, more preferably at most 100 volts.

It is preferred to use a contrast potential of 200–500 volts so as to provide a sufficient image density.

The frequency can affect the process, and a frequency below 500 Hz may result in charge injection to the carrier, which leads to lower image qualities due to carrier attachment and latent image disturbance, in some cases. Above 10000 Hz, it is difficult for the toner to follow the electric field, thus being liable to cause lower image qualities.

In the developing method according to the present invention, it is preferred to set a contact width (developing nip) C of the magnetic brush on the developing sleeve 31 with the photosensitive drum 33 at 3–8 mm in order to effect a development providing a sufficient image density and excellent dot reproducibility without causing carrier attachment. If the developing nip C is narrower than 3 mm, it may be difficult to satisfy a sufficient image density and a good dot reproducibility. If broader than 8 mm, the developer is apt to be packed to stop the movement of the apparatus, and it may become difficult to sufficiently prevent the carrier attachment. The developing nip C may be appropriately adjusted by changing a distance A between a developer regulating member 32 and the developing sleeve 31 and/or changing the gap B between the developing sleeve 31 and the photosensitive drum 33.

In formation of a full color image for which a halftone reproducibility is a great concern may be performed by using at least 3 developing devices for magenta, cyan and yellow, adopting the toner according to the present invention and preferably adopting a developing system for developing digital latent images in combination, whereby a development faithful to a dot latent image becomes possible while avoiding an adverse effect of the magnetic brush and disturbance of the latent image. The use of the toner according to the present invention is also effective in realizing a high transfer ratio in a subsequent transfer step. As a result, it becomes possible to obtain high image qualities both at the halftone portion and the solid image portion.

In addition to the high image quality at an initial stage of image formation, the use of the toner according to the present invention is also effective in avoiding the lowering in image quality in a continuous image formation on a large number of sheets.

The toner image formed on the image-bearing member 33 is transferred onto a transfer(-receiving) material by a transfer means 43 such as a corona charger, and the transfer material carrying the toner image is sent to a heat-pressure fixing means comprising a heating roller 46 and a pressure roller 47 where the toner image is fixed onto the transfer material. Transfer residual toner remaining on the image-bearing member 33 is removed from the image-bearing member 33 by a cleaning means 44, such as a cleaning blade. The toner of the present invention exhibits a high transfer efficiency in the transfer step to leave little transfer residual toner and also exhibits a high cleanability so that it is less liable to cause filming on the image-bearing member 33. Further, the toner of the present invention is less liable to cause embedding of the external additive at the toner particle surfaces, thus being capable of retaining good image quality even in continuous image formation on a large number of sheets.

In order to obtain good and steady full-color images, it is preferred to use an image forming apparatus equipped with four developing devices for magenta, cyan, yellow and black, among which the black developing device is disposed at the position of effecting the find color of development.

An image forming apparatus suitable for practicing multicolor or full-color image forming method by using a toner according to the present invention will be described with reference to FIG. 4.

Figure 4:
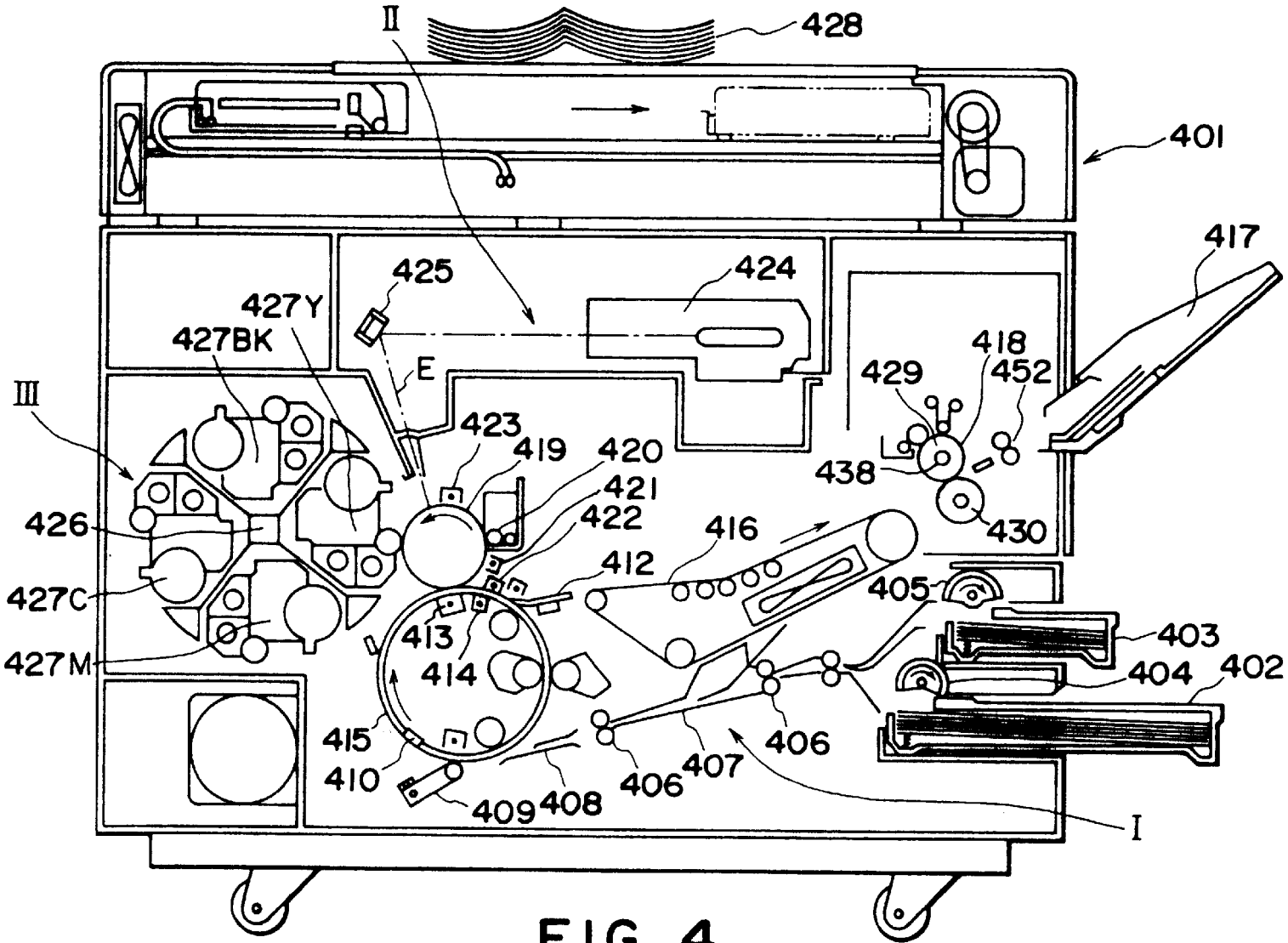
FIG. 4 illustrates a full-color or multi-color image forming system.

The color electrophotographic apparatus shown in FIG. 4 is roughly divided into a transfer material (recording sheet)-conveying section I including a transfer drum 415 and extending from the right side (the right side of FIG. 4) to almost the central part of an apparatus main assembly 401, a latent image-forming section II disposed close to the transfer drum 415, and a developing means (i.e., a rotary developing apparatus) III.

The transfer material-conveying section I is constituted as follows. In the right wall of the apparatus main assembly 401, an opening is formed through which are detachably disposed transfer material supply trays 402 and 403 so as to protrude a part thereof out of the assembly. Paper (transfer material)-supply rollers 404 and 405 are disposed almost right above the trays 402 and 403. In association with the paper-supply rollers 404 and 405 and the transfer drum 415 disposed leftward thereof so as to be rotatable in an arrow A direction, paper-supply rollers 406, a paper-supply guide 407 and a paper-supply guide 408 are disposed. Adjacent to the outer periphery of the transfer drum 415, an abutting roller 409, a glipper 410, a transfer material separation charger 411 and a separation claw 412 are disposed in this order from the upperstream to the downstream alone the rotation direction.

Inside the transfer drum 415, a transfer charger 413 and a transfer material separation charger 414 are disposed. A portion of the transfer drum 415 about which a transfer material is wound about is provided with a transfer sheet (not shown) attached thereto, and a transfer material is closely applied thereto electrostatically. On the right side above the transfer drum 415, a conveyer belt means 416 is disposed next to the separation claw 412, and at the end (right side) in transfer direction of the conveyer belt means 416, a fixing device 418 is disposed. The fixing device 418 comprises a fixing roller 429 enclosing therein a heat-generating member 438, and a pressure roller 430. Further downstream of the fixing device is disposed a discharge tray 417 which is disposed partly extending out of and detachably from the main assembly 401.

The latent image-forming section II is constituted as follows. A photosensitive member (e.g., an OPC photosensitive drum) 419 (or an OPC photosensitive belt) as a latent image-bearing member rotatable in an arrow direction shown in the figure is disposed with its peripheral surface in contact with the peripheral surface of the transfer drum 415. Generally above and in proximity with the photosensitive drum 419, there are sequentially disposed a discharging charger 420, a cleaning means 421 and a primary charger 423 from the upstream to the downstream in the rotation direction of the photosensitive drum 419. Further, an image-wise exposure means including, e.g., a laser 424 and a reflection means like a mirror 425, is disposed so as to form an electrostatic latent image on the outer peripheral surface of the photosensitive drum 419.

The rotary developing apparatus III is constituted as follows. At a position opposing the photosensitive drum 419, a rotatable housing (hereinafter called a "rotary member") 426 is disposed. In the rotary member 426, four-types of developing devices are disposed at equally distant four radial directions so as to visualize (i.e., develop) an electrostatic latent image formed on the outer peripheral surface of the photosensitive drum 419. The four-types of developing devices include a yellow developing device 427Y, a magenta developing device 427M, a cyan developing apparatus 427C and a black developing apparatus 427BK.

The entire operation sequence of the above-mentioned image forming apparatus will now be described based on a full color mode. As the photosensitive drum 419 is rotated in the arrow direction, the drum 419 is charged by the primary charger 423. In the apparatus shown in FIG. 4, the moving peripheral speeds (hereinafter called "process speed") of the respective members, particularly the photosensitive drum 419, may be at least 100 mm/sec, (e.g., 130–250 mm/sec). After the charging of the photosensitive drum 419 by the primary charger 423, the photosensitive drum 419 is exposed imagewise with laser light modulated with a yellow image signal from an original 428 to form a corresponding latent image on the photosensitive drum 419, which is then developed by the yellow developing device 427Y set in position by the rotation of the rotary member 426, to form a yellow toner image.

A transfer material (e.g., plain paper) sent via the paper supply guide 407, the paper supply roller 406 and the paper supply guide 408 is taken at a prescribed timing by the glipper 410 and is wound about the transfer drum 415 by means of the abutting roller 409 and an electrode disposed opposite the abutting roller 409. The transfer drum 415 is rotated in the arrow A direction in synchronism with the photosensitive drum 419 whereby the yellow toner image formed by the yellow-developing device is transferred onto the transfer material at a position where the peripheral surfaces of the photosensitive drum 419 and the transfer drum 415 abut each other under the action of the transfer charger 413. The transfer drum 415 is further rotated to be prepared for transfer of a next color (magenta in the case of FIG. 4).

On the other hand, the photosensitive drum 419 is charge-removed by the discharging charger 420, cleaned by a cleaning blade or cleaning means 421, again charged by the primary charger 423 and then exposed imagewise based on a subsequent magenta image signal, to form a corresponding electrostatic latent image. While the electrostatic latent image is formed on the photosensitive drum 419 by image-wise exposure based on the magenta signal, the rotary member 426 is rotated to set the magenta developing device 427M in a prescribed developing position to effect a development with a magenta toner. Subsequently, the above-mentioned process is repeated for the colors of cyan and black, respectively, to complete the transfer of four color toner images. Then, the four color-developed images on the transfer material are discharged (charge-removed) by the chargers 422 and 414, released from holding by the glipper 410, separated from the transfer drum 415 by the separation claw 412 and sent via the conveyer belt 416 to the fixing device 418, where the four-color toner images are fixed under heat and pressure. Thus, a series of full color print or image formation sequence is completed to provide a prescribed full color image on one surface of the transfer material.

Another image forming method to which the toner according to the present invention is applicable will now be described with reference to FIG. 5.

Figure 5:
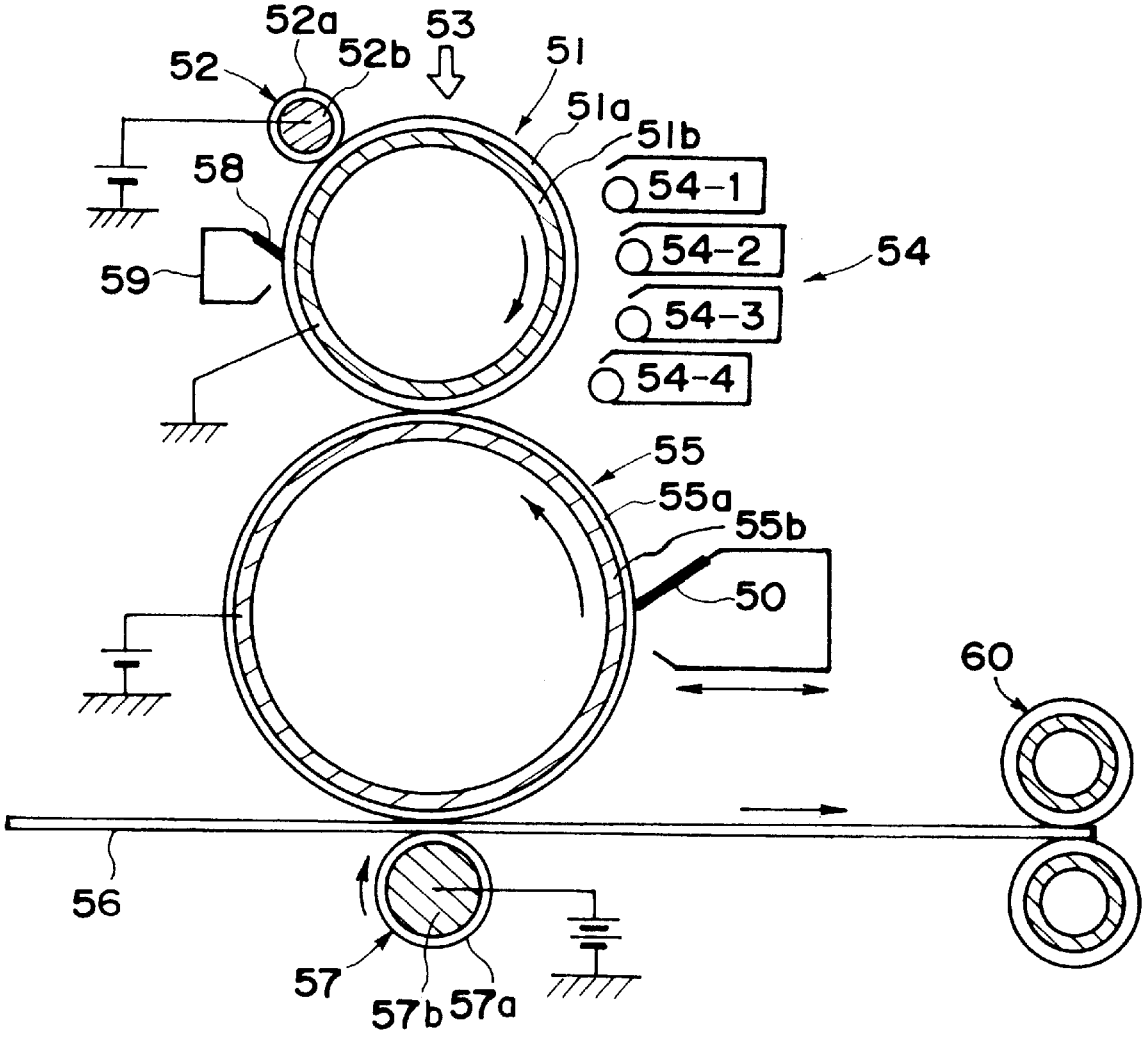
FIG. 5 illustrates an image forming system including an intermediate transfer member.

Referring to FIG. 5, an image forming apparatus principally includes a photosensitive member 51 as an electrostatic image-bearing member, a charging roller 52 as a charging means, a developing device 54 comprising four developing units 54-1, 54-2, 54-3 and 54-4, an intermediate transfer member 55, a transfer roller 57 as a transfer means, and a fixing device 60 as a fixing means. Four developers comprising cyan toner particles, magenta toner particles, yellow toner particles, and black toner particles are incorporated in the developing units 54-1 to 54-4. An electrostatic image is formed on the photosensitive member 51 and developed with the four color toner particles by a developing method such as a magnetic brush developing system or a non-magnetic monocomponent developing system, whereby the respective toner images are formed on the photosensitive member 51.

The electrostatic image-bearing member 51 may comprise a photosensitive drum (or a photosensitive belt) comprising a layer of a photoconductive insulating material, such as a-Se, CdS, $ZnO_2$, OPC (organic photoconductor), and a-Si (amorphous silicon). The image-bearing member 51 is rotated in an indicated arrow direction by a drive mechanism (not shown).

The electrostatic image-bearing member 1 may preferably comprise an a-Si (amorphous silicon) photosensitive layer or OPC photosensitive layer.

The organic photosensitive layer may be composed of a single layer comprising a charge-generating substance and a charge-transporting substance or may be a function-separation type photosensitive layer comprising a charge generation layer and a charge transport layer. The function-separation type photosensitive layer may preferably comprise an electroconductive support, a charge generation layer, and a charge transport layer arranged in this order. The organic photosensitive layer may preferably comprise a binder resin, such as polycarbonate resin, polyester resin or acrylic resin, because such a binder resin is effective in improving transferability and cleaning characteristic and is not liable to cause toner sticking onto the photosensitive member or filming of external additives.

A charging step may be performed by using a corona charger which is not in contact with the photosensitive member 51 or by using a contact charger, such as a charging roller. The contact charging system as shown in FIG. 5 may preferably be used in view of efficiency of uniform charging, simplicity and a lower ozone-generating characteristic.

The charging roller 52 comprises a core metal 52*b* and an electroconductive elastic layer 52*a* surrounding a periphery of the core metal 52*b*. The charging roller 52 is pressed against the photosensitive member 51 at a prescribed pressure (pressing force) and rotated mating with the rotation of the photosensitive member 51.

The charging step using the charging roller may preferably be performed under process conditions including an applied pressure of the roller of 5–500 g/cm, an AC voltage of 0.5–5 kVpp, an AC frequency of 50–5 kHz and a DC voltage of ±0.2–±1.5 kV in the case of applying AC voltage and DC voltage in superposition; and an applied pressure of the roller of 5–500 g/cm and a DC voltage of ±0.2–±1.5 kV in the case of applying DC voltage.

Other charging means may include those using a charging blade or an electroconductive brush. These contact charging means are effective in unnecessitating a high voltage or decreasing the occurrence of ozone. The charging roller and charging blade each used as a contact charging means may preferably comprise an electroconductive rubber and may optionally comprise a releasing film on the surface thereof. The releasing film may comprise, e.g., a nylon-based resin, polyvinylidene fluoride (PVDF) or polyvinylidene chloride (PVDC).

The toner image formed on the electrostatic image-bearing member 51 is transferred to an intermediate transfer member 55 to which a voltage (e.g., ±0.1–±5 kV) is applied. The surface of the electrostatic image-bearing member may then be cleaned by cleaning means 59 including a cleaning blade 58.

The intermediate transfer member 55 comprises a pipe-like electroconductive core metal 55*b* and a medium resistance-elastic layer 55*a* (e.g., an elastic roller) surrounding a periphery of the core metal 55*b*. The core metal 55*b* can comprise a plastic pipe coated by electroconductive plating. The medium resistance-elastic layer 55*a* may be a solid layer or a foamed material layer in which an electroconductivity-imparting substance, such as carbon black, zinc oxide, tin oxide or silicon carbide, is mixed and dispersed in an elastic material, such as silicone rubber, teflon rubber, chloroprene rubber, urethane rubber or ethylene-propylene-diene terpolymer (EPDM), so as to control an electric resistance or a volume resistivity at a medium resistance level of $10^5$–$10^{11}$ ohm.cm, particularly $10^7$–$10^{10}$ ohm.cm. The intermediate transfer member 55 is disposed under the electrostatic image-bearing member 51 so that it has an axis (or a shaft) disposed in parallel with that of the electrostatic image-bearing member 51 and is in contact with the electrostatic image-bearing member 51. The intermediate transfer member 55 is rotated in the direction of an arrow (counterclockwise direction) at a peripheral speed identical to that of the electrostatic image-bearing member 51.

The respective color toner images are successively intermediately transferred to the peripheral surface of the intermediate transfer member 55 by an elastic field formed by applying a transfer bias to a transfer nip region between the electrostatic image-bearing member 51 and the intermediate transfer member 55 at the time of passing through the transfer nip region.

After the intermediate transfer of the respective toner image, the surface of the intermediate transfer member 55 is cleaned, as desired, by a cleaning means 50 which can be attached to or detached from the intermediate transfer member 55. In case where the toner image is placed on the intermediate transfer member 55, the cleaning means 50 is detached or released from the surface of the intermediate transfer member 55 so as not to disturb the toner image.

The transfer means (e.g., a transfer roller) 57 is disposed under the intermediate transfer member 55 so that it has an axis (or a shaft) disposed in parallel with that of the intermediate transfer member 55 and is in contact with the intermediate transfer member 55. The transfer means (roller)

57 is rotated in the direction of an arrow (clockwise direction) at a peripheral speed identical to that of the intermediate transfer member 55. The transfer roller 57 may be disposed so that it is directly in contact with the intermediate transfer member 55 or in contact with the intermediate transfer member 55 via a belt, etc. The transfer roller 57 may comprise an electroconductive elastic layer 57*a* disposed on a peripheral surface of a core metal 57*b*.

The intermediate transfer member 55 and the transfer roller 57 may comprise known materials as generally used. By setting the volume resistivity of the elastic layer 55*a* of the intermediate transfer member 55 to be higher than that of the elastic layer 57*a* of the transfer roller, it is possible to alleviate a voltage applied to the transfer roller 57. As a result, a good toner image is formed on the transfer-receiving material and the transfer-receiving material is prevented from winding about the intermediate transfer member 55. The elastic layer 55*a* of the intermediate transfer member 55 may preferably have a volume resistivity at least ten times that of the elastic layer 57*a* of the transfer roller 57.

The hardness of the intermediate transfer member 55 and the transfer roller 57 may be measured according to JIS K-6301. The intermediate transfer member 55 may preferably have an elastic layer 55*a* having a hardness in a range of 10–40 deg. On the other hand, the elastic layer 57*a* of the transfer roller 57 may preferably have a hardness in a range of 41–80 deg. higher than that of the elastic layer 55*a* of the intermediate transfer member 55 so as to prevent the winding of the transfer material about the intermediate transfer member 55. If the hardness relationship between the intermediate transfer member 55 and the transfer roller 57 is reversed, a concavity is preferentially formed on the transfer roller 57, and the winding of a transfer material about the intermediate transfer member 55 is liable to be caused.

The transfer roller 57 is rotated at a peripheral speed which is identical to or with some difference from that of the intermediate transfer member 55. A transfer material 56 is conveyed to between the intermediate transfer member 55 and the transfer roller 57 and, simultaneously therewith, is supplied with a transfer bias voltage of a polarity opposite to that of the triboelectric charge of the toner from the transfer roller 57, so that the toner image is transferred onto the front side of the transfer material 56.

The transfer roller 57 may comprise similar materials as the charging roller 52 and may be operated under the conditions of a roller abutting pressure of 5–50 g/cm and a DC voltage of ±0.2 to ±10 kV.

For example, the transfer roller 57 may comprise a core metal 57*b* and an electroconductive elastic layer 57*a* comprising an elastic material having a volume resistivity of $10^6$–$10^{10}$ ohm.cm, such as polyurethane or ethylene-propylene-diene terpolymer (EPDM) containing an electroconductive substance, such as carbon, dispersed therein. A certain bias voltage (e.g., preferably of ±0.2–±10 kV) is applied to the core metal 57*b* by a constant-voltage supply.

The transfer-receiving material 56 carrying the transferred toner image is then conveyed to a hot roller fixation device 60 comprising basically a heating roller enclosing a heat-generating member, such as a halogen heater, and a pressure roller comprising an elastic material pressed against the heating roller, whereby the toner image is fixed onto the transfer material by application of heat and pressure. It is also possible to use a fixing means wherein a toner image on a transfer material is heated by a heater via a film.

Next, mono-component developing methods will be described. The toner of the present invention is applicable to both a magnetic monocomponent developing method and a non-magnetic mono-component developing method. First, a magnetic mono-component developing method is described with reference to FIG. 6.

Figure 6:
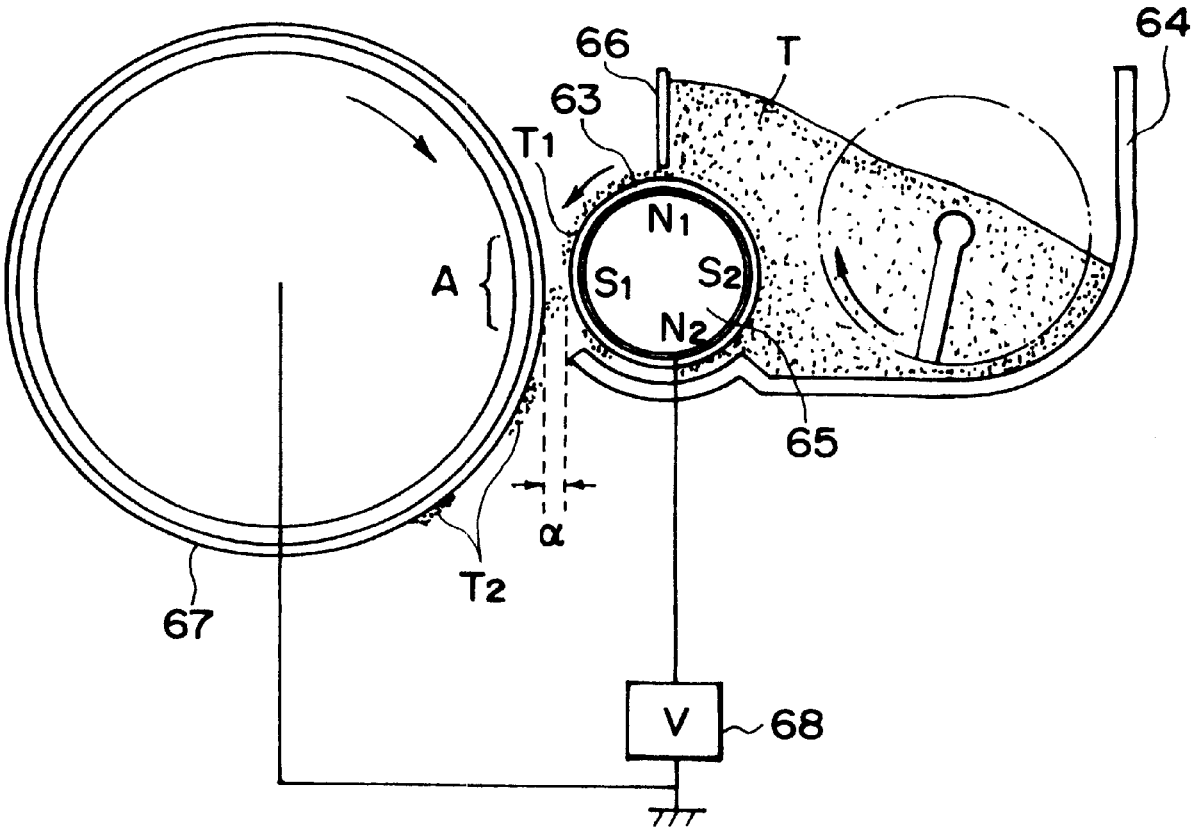
FIGS. 6 and 7 respectively illustrate a magnetic mono-component developing system.

Referring to FIG. 6, an almost right half circumference of a developer-carrying member (developing sleeve) 63 is disposed to always contact a toner reservoir in a toner vessel 64, and a toner T in proximity to the developing sleeve 63 surface is attached to and held on the developing sleeve 63 surface under the action of a magnetic force exerted by a magnetic field generating means 65 and/or an electrostatic force. As the developing sleeve 63 is rotated, the magnetic toner layer on the sleeve 63 surface is caused to pass by a regulating member 66, where a thin toner layer T1 of an almost uniform thickness is formed. The magnetic toner is charged by frictional contact with the sleeve surface along with the rotation of the developing sleeve 63, and the charged thin magnetic toner layer T1 is moved to and passes through a developing region A where the developing sleeve 63 and the image-bearing member 67 are closest to each other, along with the rotation of the developing sleeve 63. At the stage of passing through the developing region A, the magnetic toner forming the thin magnetic toner layer T1 on the developing sleeve 63 is caused to fly and reciprocally move between the developing sleeve 63 and the image-bearing member 67 under the action of an AC/DC-superposed electric field caused by a bias voltage application means 68. Consequently, the magnetic toner on the side of the developing sleeve 63 is selectively moved and attached onto the image-bearing member 67 surface depending on a latent image potential pattern formed thereon to form a toner image T2 thereon. After passing by the developing region A, the developing sleeve 63 surface carrying the selectively consumed toner layer is re-rotated to the toner reservoir in the toner vessel 64 and re-supplied with a magnetic toner, whereby the thin magnetic toner layer T1 is formed again on the developing sleeve 63 and moved to the developing region A for repeating the developing operation. The regulation member 66 as a thin toner layer-forming means used in the system of FIG. 6 is a doctor blade comprising a metal blade or a magnetic blade disposed with a prescribed gap from the sleeve 63. Instead thereof, it is also possible to use a roller made of a metal, resin or ceramic. Further, as such a thin toner layer-forming means, it is also possible to use an elastic blade or elastic roller pressed with an elastic force against the developing sleeve surface. As the material for constituting such an elastic blade or elastic roller, it is possible to use an elastomer, such as silicone rubber, urethane rubber or NBR; synthetic elastic resin, such as polyethylene terephthalate; or an elastic metal member, such as stainless steel, steel or phosphor bronze. It is also possible to use a composite member of these materials. A portion abutted against the sleeve of the elastic member may preferably comprise a rubber or resin elastic material.

Figure 7:
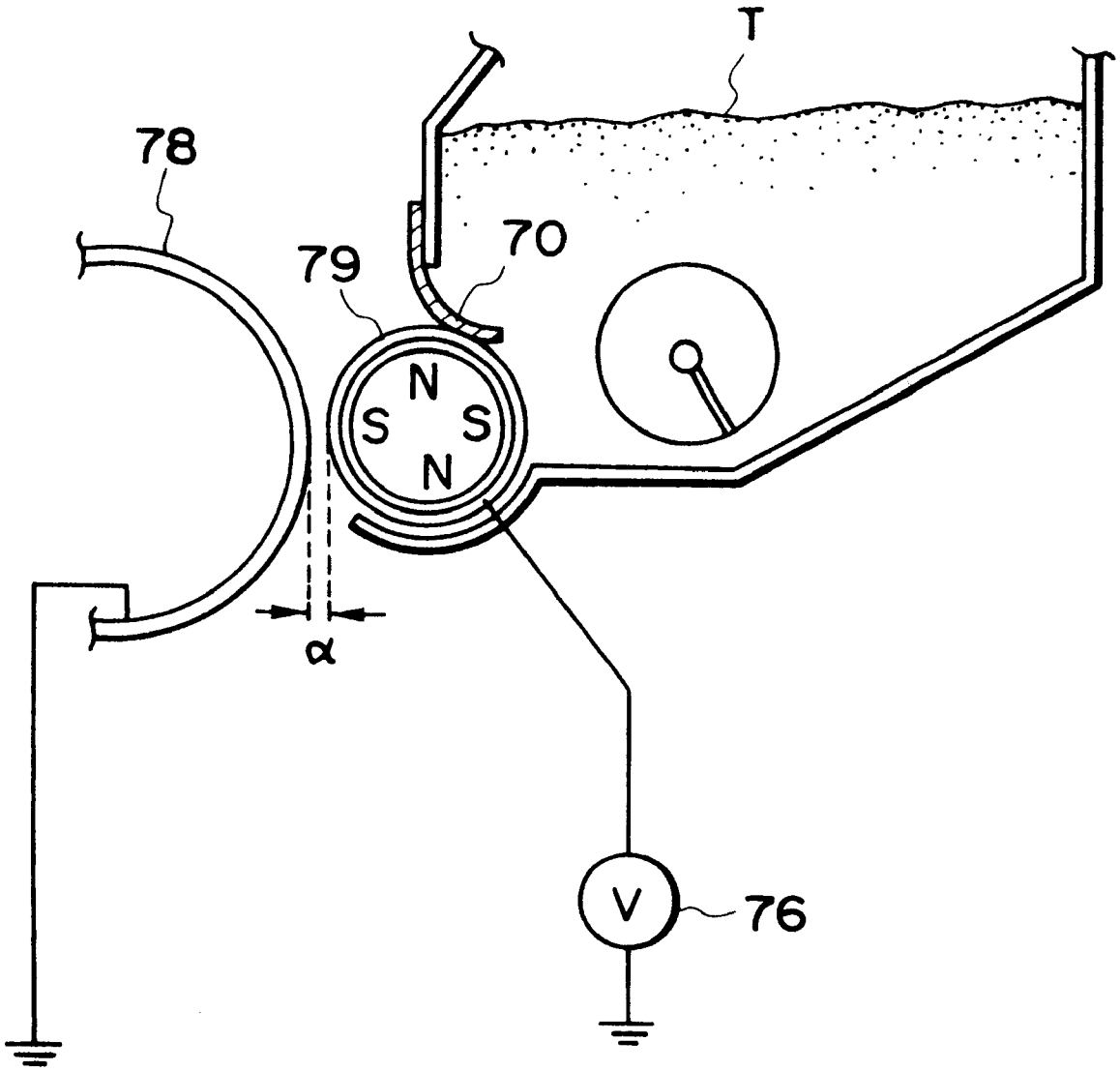

An example of a mono-component developing system using an elastic blade as a thin toner layer-forming means is illustrated in FIG. 7.

An elastic blade 70 is fixed at its upper but root portion to the developer vessel and having its lower free length portion pressed at an appropriate pressure against the developing sleeve 79 so as to extend in a reverse direction (as shown or in a forward direction). By using such an application means, it becomes possible to form a tight toner layer stable against an environmental change.

On the other hand, the use of such an elastic blade is liable to cause a toner melt-sticking onto the developing sleeve or the elastic blade, but the toner of the present invention is suitably used because of excellent releasability and stable triboelectric chargeability.

In the case of a magnetic monocomponent developing method, the elastic member may be abutted against the toner-carrying member at an abutting pressure of at least 0.1 kg/m, preferably 0.3–25 kg/m, further preferably 0.5–12 kg/m, in terms of a linear pressure in the direction of a generatrix of the toner-carrying member.

The developing sleeve 79 can contact the image-bearing member 78, but it is preferred to dispose the electrostatic image-bearing member 25 and the toner-carrying member 24 with a gap a of 50–500 $\mu$m.

It is generally most preferred that the toner layer thickness is set to be thinner than the gap between the electrostatic image-bearing member 78 and the toner carrying member 79, but the toner layer thickness can be set so that a portion of toner ears constituting the toner layer contacts the electrostatic image-bearing member 78. The developing sleeve 79 is rotated at a peripheral speed which is 100 to 200% of that of the electrostatic image-bearing member 78. An alternating electric field applied from a bias voltage supply 26 may comprise a peak-to-peak voltage Vpp of at least 100 volts, preferably 200–3000 volts, further preferably 300–2000 volts, and a frequency f of 500–5000 Hz, preferably 1000–3000 Hz, further preferably 1500–3000 Hz. The alternating electric field may comprise a waveform of a rectangular wave, a sinusoidal wave, a sawteeth wave or a triangular wave. Further, it is also possible to apply an asymmetrical AC bias electric field having a positive wave portion and a negative wave portion having different voltages and durations. It is also preferred to superpose a DC bias component.

Next, an embodiment of a non-magnetic monocomponent developing method is described with reference to FIG. 8.

An electrostatic latent image is formed on an image-bearing member 85 according to an electrophotographic process means or electrostatic recording means (not shown). A developer-carrying member (developing sleeve) 84 comprises a non-magnetic sleeve of, e.g., aluminum or stainless steel, which may be in a form of crude pipe but may be provided with a uniformly roughened state by blasting with spherical particles, such as glass beads, a mirror-finished surface or a resin-coated surface. A toner T is stored in a hopper 81 and supplied onto the developing sleeve 84 by means of a toner application roller 82. The toner application roller 82 my preferably comprise a roller formed of a porous elastic foam, such as soft polyurethane foam. The roller 82 is rotated in an direction identical or opposite to the developing sleeve 84 with a non-zero relative speed, thereby supplying the toner to and simultaneously peeling the non-used toner layer after developing from the developing sleeve 84. In view of th balance of the toner supply and the peeling, the abutting nip width between the toner application roller 82 onto the developing sleeve 84 may preferably be 2.0 to 10.0 mm, more preferably 4.0 to 6.0 mm. In this system, a stress is applied to the toner, thus being liable to cause increased toner agglomeration due to toner deterioration and toner melt-sticking onto the developing sleeve 84 and/or the toner application roller 82. As the toner of the present invention is excellent in flowability, releasability and durability, however, it is suitably used in the system of FIG. 8. The toner supplied onto the developing sleeve 84 is uniformly applied to form a thin layer by a regulating member 83. Th toner regulating member 83 may preferably comprise an elastic blade (as shown) or an elastic roller for effecting pressure-application of the toner onto the developing sleeve 84 surface. The elastic blade or elastic roller may preferably comprise a material having a position intriboelectric chargeability series suitable for charging the toner to a desired polarity. More specifically, the toner regulating member 83 may suitably comprise silicone rubber, urethane rubber, or styrene-butadiene rubber. It is also possible to form a layer of organic resin, such as polyamide, polyimide, nylon, melamine, melamine-crosslinked nylon, phenolic resin, fluorine resin, silicone resin, polyester resin, urethane resin, styrene resin or acrylic resin on the toner-regulating member 83.

The elastic blade or elastic roller may preferably be abutted against the developing sleeve 84 at a linear pressure in a sleeve generatrix direction of 0.1–25 kg/m, more preferably 0.5–12 kg/m. As a result, it becomes possible to effectively disintegrate the toner agglomeration and realize a quick charging of the toner. In order to attain a sufficient image density in such a blade application system for formation of a thin layer of particularly a non-magnetic monocomponent toner, the developing sleeve 84 may be rotated at a peripheral speed which is 100 to 300%, preferably 120 to 250% of that of the image-bearing member 85.

The developing sleeve 84 may be disposed in contact or no contact with the image bearing member 85. In the case of the non-contact disposition, it is preferable that the toner layer thickness on the developing sleeve 84 is made smaller than a gap a between the developing sleeve 84 and the image-bearing member 85, and an alternating electric field is formed across the gap a which is preferably 50–500 $\mu$m. By applying an AC or AC/DC-superposed bias voltage to the developing sleeve 84 from a bias voltage supply 86, the movement of the toner from the developing sleeve 84 onto the electrostatic image-bearing member 85 may be made smoother to provide an image of further better quality.

Hereinbelow, the present invention will be described more specifically with reference to Production Examples and Examples which should not be however construed to restrict the scope of the present invention in any way, "Part(s)" used hereinbelow for describing relative amounts of ingredients are "part(s) by weight".

(Production of Sulfur-Containing Polymer 1)

Into a 2 liter-flask equipped with a stirrer, a condenser, a thermometer and a nitrogen intake pipe, 100 parts of toluene, 300 parts of methanol, 470 parts of styrene, 40 parts of 2-acrylamido-2-methylpropane-sulfonic acid, 90 parts of 2-ethylhexyl acrylate and 10 parts of lauryl peroxide were charged and subjected to 10 hours of solution polymerization at 65° C. under stirring and nitrogen stream. The polymerizate was taken out of the flask, dried at 40° C. under a reduced pressure and crushed by a hammer mill to obtain Sulfur-containing polymer 1, which exhibited a weight-average molecular weight (Mw=20000), a volatile matter content (Cvol) of below 1%, a glass transition temperature (Tg) of 65° C., and a residual monomer content (Mres) of 900 ppm.

Sulfur-containing polymer 1 also exhibited an acid value (Av) of 22 mgKOH/g, whereas Sulfur-containing polymers 2 to 8 prepared in the following Examples exhibited acid values in a range of 18–25 mgKOH/g.

(Production of Sulfur-Containing Polymer 2)

Into a 2 liter-flask equipped with a stirrer, a condenser, a thermometer and a nitrogen intake pipe, 300 parts of toluene, 100 parts of methanol, 470 parts of styrene, 40 parts of 2-acrylamido-2-methylpropane-sulfonic acid, 90 parts of 2-ethylhexyl acrylate and 12 parts of lauryl peroxide were charged and subjected to 10 hours of solution polymerization at 65° C. under stirring and nitrogen stream. The polymerizate was taken out of the flask, dried at 40° C. under a reduced pressure, and crushed by a hammer mill to obtain Sulfur-containing polymer 2, which exhibited Mw=36000, Cvol=<1%, Tg=65° C. and Mres=900 ppm.

(Production of Sulfur-Containing Polymer 3)

Into a 2 liter-flask equipped with a stirrer, a condenser, a thermometer and a nitrogen intake pipe, 100 parts of toluene, 300 parts of methanol, 550 parts of styrene, 50 parts of 2-acrylamido-2-methylpropane-sulfonic acid and 12 parts of lauryl peroxide were charged and subjected to 10 hours of solution polymerization at 65° C. under stirring and nitrogen stream. The polymerizate was taken out of the flask, dried at 40° C. under a reduced pressure, and crushed by a hammer mill to obtain Sulfur-containing polymer 3, which exhibited Mw=40000, Cvol=<1%, Tg=98° C. and Mres=900 ppm.

(Production of Sulfur-Containing Polymer 4)

Into a 2 liter-flask equipped with a stirrer, a condenser, a thermometer and a nitrogen intake pipe, 100 parts of toluene, 300 parts of methanol, 470 parts of styrene, 40 parts of methacrylsulfonic acid, 90 parts of 2-ethylhexyl acrylate and 10 parts of lauryl peroxide were charged and subjected to 10 hours of solution polymerization at 65° C. under stirring and nitrogen stream. The polymerizate was taken out of the flask, dried at 40° C. under a reduced pressure, and crushed by a hammer mill to obtain Sulfur-containing polymer 4, which exhibited Mw=22000, Cvol=<1%, and Mres=800 ppm.

(Production of Sulfur-Containing Polymer 5)

Into a 2 liter-flask equipped with a stirrer, a condenser, a thermometer and a nitrogen intake pipe, 300 parts of toluene, 100 parts of methanol, 470 parts of styrene, 40 parts of methacrylsulfonic acid, 90 parts of 2-ethylhexyl acrylate and 12 parts of lauryl peroxide were charged and subjected to 10 hours of solution polymerization at 65° C. under stirring and nitrogen stream. The polymerizate was taken out of the flask, dried at 40° C. under a reduced pressure, and crushed by a hammer mill to obtain Sulfur-containing polymer 5, which exhibited Mw=40000, Cvol=<1%, and Mres=800 ppm.

(Production of Sulfur-Containing Polymer 6)

Into a 2 liter-flask equipped with a stirrer, a condenser, a thermometer and a nitrogen intake pipe, 300 parts of toluene, 100 parts of methanol, 20 parts of potassium hydroxide, 470 parts of styrene, 40 parts of 2-acrylamido-2-methylpropane-sulfonic acid, 90 parts of 2-ethylhexyl acrylate and 10 parts of lauryl peroxide were charged and subjected to 10 hours of solution polymerization at 65° C. under stirring and nitrogen stream. The polymerizate was taken out of the flask, dried at 40° C. under a reduced pressure, and crushed by a hammer mill to obtain Sulfur-containing polymer 6, which exhibited Mw=19000, Cvol=<1%, Tg=65° C. and Mres=900 ppm.

(Production of Sulfur-Containing Polymer 7)

Into a 2 liter-flask equipped with a stirrer, a condenser, a thermometer and a nitrogen intake pipe, 100 parts of toluene, 300 parts of methanol, 520 parts of styrene, 20 parts of 2-acrylamido-2-methylpropane-sulfonic acid, 60 parts of 2-ethylhexyl acrylate and 10 parts of lauryl peroxide were charged and subjected to 10 hours of solution polymerization at 60° C. under stirring and nitrogen stream. The polymerizate was taken out of the flask, dried at 50° C. under a reduced pressure, and crushed by a hammer mill to obtain Sulfur-containing polymer 7, which exhibited Mw=45000, Cvol=<1%, Tg=76° C. and Mres=200 ppm.

(Production of Sulfur-Containing Polymer 8)

Into a 2 liter-flask equipped with a stirrer, a condenser, a thermometer and a nitrogen intake pipe, 100 parts of toluene, 300 parts of methanol, 540 parts of styrene, 12 parts of 2-acrylamido-2-methylpropane-sulfonic acid, 48 parts of 2-ethylhexyl acrylate and 10 parts of lauryl peroxide were charged and subjected to 10 hours of solution polymerization at 60° C. under stirring and nitrogen stream. The polymerizate was taken out of the flask, dried at 50° C. under a reduced pressure, and crushed by a hammer mill to obtain Sulfur-containing polymer 8, which exhibited Mw=48000, Cvol=<1%, Tg=81° C. and Mres=200 ppm.

EXAMPLE 1

(Dispersion Medium)

To 1000 parts of deionized water placed in a reaction vessel, 14 parts of sodium phosphate and 4.5 pats of 10%-hydrochloric acid were added, and the system was held at 65° C. for 60 min. under $N_2$-purging. While the mixture was stirred at 12000 rpm by a TK-homomixer (made by Tokushu Kika Kogyo K.K.), a calcium chloride aqueous solution formed by dissolving 8 parts of calcium chloride in 10 parts of deionized water was added at a time to form an aqueous medium containing a dispersion stabilizer.

| (Polymerizable monomer composition) | |
|---|---|
| Styrene | 60 part(s) |
| Colorant (C.I. Pigment Red 122/C.I. Pigment Red 57 = 1/1) | 7 " |
| Sulfur-containing polymer 1 | 0.8 " |

The above ingredients were charged in a dispersion machine ("Attritor", made by Mitsui Kakoki K.K.) containing 2 mm-dia. zirconia particles and were dispersed at 220 rpm for 5 hours to form a monomer mixture.

To the monomer mixture, the following ingredients:

| | |
|---|---|
| Styrene | 20 part(s) |
| n-Butyl acrylate | 20 " |
| Condensation resin (saturated polyester) (isophthalic acid-propylene oxide (P.O.)-modified bisphenol A; Mw = 10,000, AV = 15 mgKOH/g) | 8 " |
| Release agent No. 8 | 20 " |
| Crosslinking agent (divinylbenzene) | 0.4 " |

were further added.

The resultant mixture was placed in a separate vessel, and subjected to uniform dissolution and dispersion under stirring at 500 rpm by a TK-Homomixer, and 2.5 parts of 2,2'-azobis(2,4-dimethylvaleronitrile) (polymerization initiator) was dissolved therein to form a polymerizable monomer composition.

Into the above-prepared aqueous dispersion medium in the reaction vessel, the polymerizable monomer composition was added, and the system was stirred at 10000 rpm by the TK-homomixer for 5 min. at 65° C. under $N_2$-purging to form droplets of the polymerizable monomer composition. Then, while being stirred by paddle stirring blades, the system was subjected to 6 hours of polymerization and then heated to 90° C. for further 6 hours of polymerization.

After the polymerization, the system was cooled, and 10%-hydrochloric acid was added thereto to provide pH 2, followed by 2 hours of stirring for dissolution of the dispersion stabilizer. The polymerizate was then recovered by filtration under pressure and washed with 2000 parts or more of deionized water. Then, the recovered polymerizate in the form of a cake was re-dispersed in 1000 parts of deionized water, and 10%-hydrochloric acid was added thereto to provide pH=1 or below, followed by further 2 hours of stirring for re-washing. The re-washed polymerizate was again recovered by filtration under pressure similarly as above, washed with 2000 parts or more of deionized water, sufficiently aerated, dried and then pneumatically classified to obtain Magenta toner particles No. 1.

Figure 2:
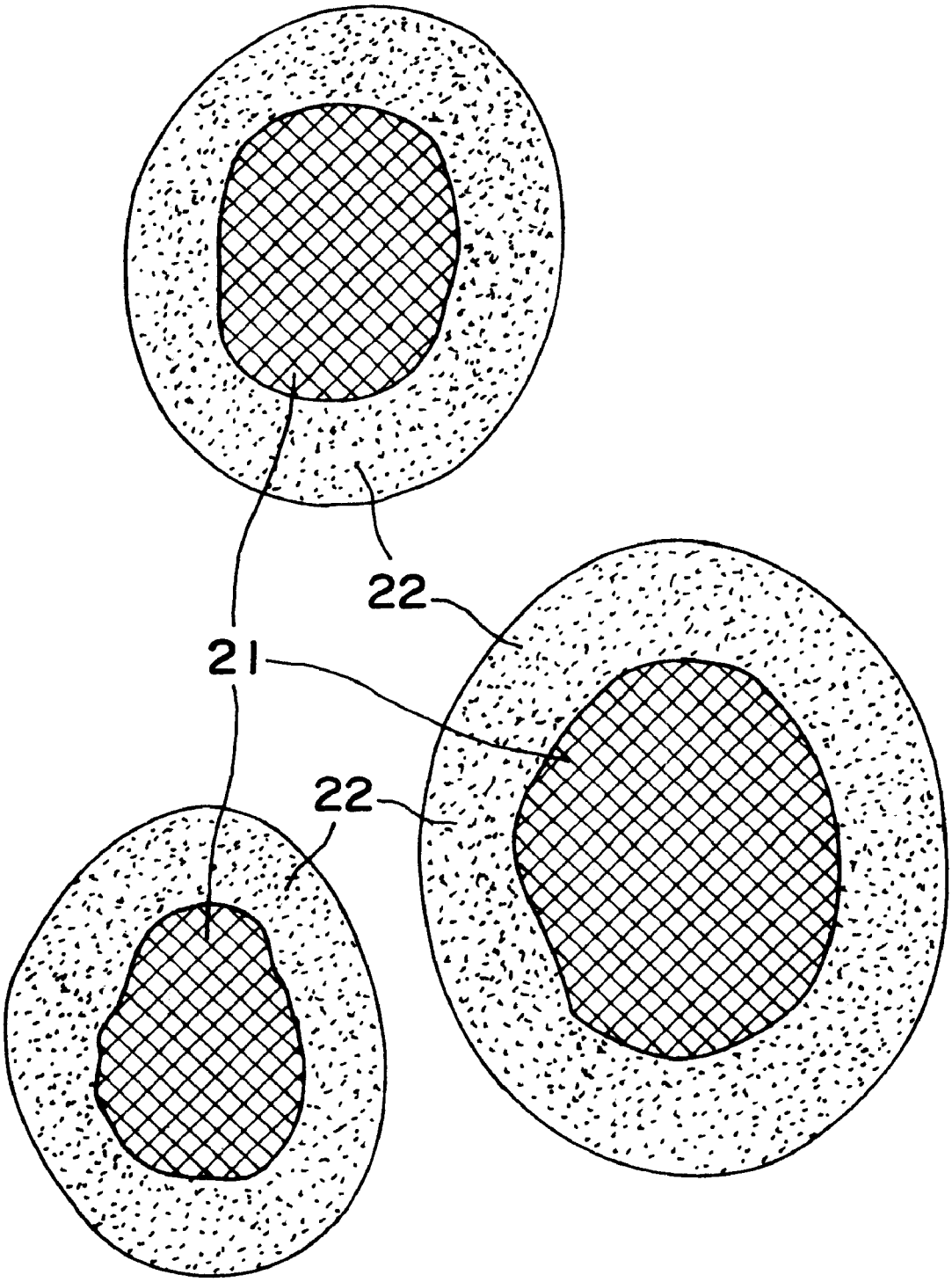
FIG. 2 is a sectional illustration of toner particles containing a release agent enclosed within an outer shell resin.

A slight portion of the toner particles was embedded within a UV-curable resin, and the cured sample was sliced by a microtoner to be observed through a transmission electron microscope (TEM), whereby a major portion of the release agent (21) in the toner particles was found to be well enclosed within the outer shell resin (22) as shown in FIG. 2.

100 parts of Magenta toner particles No. 1 were blended with 1.0 part of hydrophobic titanium oxide fine powder (having a BET specific surface area (SBET) of 100 $m^2/g$) to obtain Magenta toner No. 1, which exhibited a circle-equivalent number-average particle size (D1) of 6.7 $\mu$m and also exhibited triboelectric chargeabilities in three environments of A: 13° C./10%RH, B: 20° C./60%RH and C: 32° C./80%RH as shown in Table 4 according to a measurement method described hereinafter.

Magenta toner No. 1 in 7 parts were blended with 93 parts of silicone resin-coated magnetic material-dispersed carrier to prepare a developer, which was charged in a full-color copying machine having an organization as shown in FIG. 5 obtained by remodeling a commercially available digital full-color copying machine ("Creative Processor 660", made by Canon K.K.) to effect an image forming test for evaluating toner performances regarding evaluation items described hereinafter.

The physical properties and results of the evaluation of Magenta toner No. 1 are inclusively shown in Tables 2–7 (particularly Tables 2 and 4) together with those of other toners prepared in the following Examples and Comparative Examples.

EXAMPLE 2

An aqueous dispersion medium containing a dispersion stabilizer was prepared by gradually adding an aqueous solution of 28 parts of sodium hydroxide in 200 parts of deionized water into an aqueous solution under stirring of 40 parts of magnesium chloride in 1000 parts of deionized water. Magenta toner No. 2 was prepared and evaluated by using the aqueous dispersion medium and using Release agent No. 11 instead of Release agent No. 8, otherwise in the same manner as in Example 1.

EXAMPLE 3

An aqueous dispersion medium containing a dispersion stabilizer was prepared by adding 30 parts of aluminum hydroxide into 1000 parts of deionized water. Magenta toner No. 3 was prepared and evaluated by using the aqueous dispersion medium and using Release agent No. 12 instead of Release agent No. 8, otherwise in the same manner as in Example 1.

EXAMPLE 4

(Dispersion Medium)

To 1000 parts of deionized water placed in a reaction vessel, 25 parts of sodium phosphate and 6.5 pats of 10%-hydrochloric acid were added, and the system was held at 65° C. for 60 min. under $N_2$-purging. While the mixture was stirred at 12000 rpm by a TK-homomixer (made by Tokushu Kika Kogyo K.K.), a calcium chloride aqueous solution formed by dissolving 13 parts of calcium chloride in 20 parts of deionized water was added at a time to form an aqueous medium containing a dispersion stabilizer.

| (Polymerizable monomer composition) | |
|---|---|
| Styrene | 60 part(s) |
| Colorant (C.I. Pigment Red 122/C.I. Pigment Red 57 = 1/1) | 7 " |
| Sulfur-containing polymer 1 | 1 " |

The above ingredients were charged in a dispersion machine ("Attritor", made by Mitsui Kokaki K.K.) containing 2 mm-dia. zirconia particles and were dispersed at 220 rpm for 5 hours to form a monomer mixture.

To the monomer mixture, the following ingredients:

| | |
|---|---|
| Styrene | 20 part(s) |
| n-Butyl acrylate | 20 " |
| Condensation resin (saturated polyester) (isophthalic acid-propylene oxide (P.O.)-modified bisphenol A; Mw = 10,000, AV = 15 mgKOH/g) | 8 " |
| Release agent No. 8 | 36 " |
| Crosslinking agent (divinylbenzene) | 0.4 " |

were further added to prepare a polymerizable monomer composition otherwise in the same manner as in Example 1.

Magenta toner No. 4 was prepared and evaluated by using the above-prepared aqueous dispersion medium and polymerizable monomer composition otherwise in the same manner as in Example 1.

EXAMPLE 5

(Dispersion Medium)

To 1000 parts of deionized water placed in a reaction vessel, 25 parts of sodium phosphate and 6.5 pats of 10%-hydrochloric acid were added, and the system was held at 65° C. for 60 min. under $N_2$-purging. While the mixture was stirred at 12000 rpm by a TK-homomixer (made by Tokushu Kika Kogyo K.K.), a calcium chloride aqueous solution formed by dissolving 13 parts of calcium chloride in 20 parts of deionized water was added at a time to form an aqueous medium containing a dispersion stabilizer.

| (Polymerizable monomer composition) | |
|---|---|
| Styrene | 60 part(s) |
| Colorant (C.I. Pigment Red 122/C.I. Pigment Red 57 = 1/1) | 7 " |
| Sulfur-containing polymer 1 | 7 " |

The above ingredients were charged in a dispersion machine ("Attritor", made by Mitsui Kakoki K.K.) containing 2 mm-dia. zirconia particles and were dispersed at 220 rpm for 5 hours to form a monomer mixture.

To the monomer mixture, the following ingredients:

| | |
|---|---|
| Styrene | 20 part(s) |
| n-Butyl acrylate | 20 " |
| Condensation resin (saturated polyester) (isophthalic acid-propylene oxide (P.O.)-modified bisphenol A; Mw = 10,000, AV = 15 mgKOH/g) | 2 " |
| Release agent No. 8 | 20 " |
| Crosslinking agent (divinylbenzene) | 0.4 " |

were further added to prepare a polymerizable monomer composition otherwise in the same manner as in Example 1.

Polymerization was performed and evaluated by using the above-prepared aqueous dispersion medium and polymerizable monomer composition otherwise in the same manner as in Example 1.

After the polymerization, the system was cooled, and 10%-hydrochloric acid was added thereto to provide pH 2, followed by 2 hours of stirring for dissolution of the dispersion stabilizer. The polymerizate was then recovered by filtration under pressure and washed with 2000 parts or more of deionized water. Then, the recovered polymerizate in the form of a cake was re-dispersed in 1000 parts of deionized water, and 10%-hydrochloric acid was added thereto to provide pH=2, followed by further 2 hours of stirring for re-washing. The re-washed polymerizate was again recovered by filtration under pressure similarly as above, washed with 2000 parts or more of deionized water. Thereafter, the post treatment including the drying, classification and blending with an external additive was performed in the same manner as in Example 1 to obtain Magenta toner No. 5, which was evaluated in the same manner as in Example 1.

EXAMPLE 6

Magenta toner No. 6 was prepared and evaluated in the same manner as in Example 1 except for using Sulfur-containing polymer 2 instead of Sulfur-containing polymer 1.

EXAMPLE 7

Magenta toner No. 7 was prepared and evaluated in the same manner as in Example 1 except for using Sulfur-containing polymer 3 instead of Sulfur-containing polymer 1.

EXAMPLE 8

Magenta toner No. 8 was prepared and evaluated in the same manner as in Example 1 except for using Sulfur-containing polymer 4 instead of Sulfur-containing polymer 1.

EXAMPLE 9

Magenta toner No. 9 was prepared and evaluated in the same manner as in Example 1 except for using Sulfur-containing polymer 5 instead of Sulfur-containing polymer 1.

EXAMPLE 10

The process of Example 1 was repeated up to the polymerization except for changing the colorant to 7 parts of carbon black, increasing the amount of Sulfur-containing polymer 1 to 1.0 part, reducing the amount of Release agent No. 8 to 4 parts and increasing the amount of divinylbenzene to 0.8 part.

After the polymerization, the system was cooled, and 10%-hydrochloric acid was added thereto to provide pH 2, followed by 2 hours of stirring for dissolution of the dispersion stabilizer. The polymerizate was then recovered by filtration under pressure and washed with 2000 parts or more of deionized water. Then, the recovered polymerizate in the form of a cake was re-dispersed in 1000 parts of deionized water, and 10%-hydrochloric acid was added thereto to provide pH=2, followed by further 2 hours of stirring for re-washing. The re-washed polymerizate was again recovered by filtration under pressure similarly as above, and re-dispersed in 1000 parts of deionized water to form a dispersion liquid, which was then agglomerated by adding 100 parts of 6%-aluminum chloride aqueous solution. The agglomerates were further recovered by filtration under pressure and washed with 2000 parts or more of deionized water, and the cake-like particles on the filter was further treated with 3000 parts of warm water at 90° C., whereby a massive block of melt-stuck particles was formed. After drying at 40° C., the block was coarsely crushed by a hammer mill and passed through a sieve having an opening of 1 mm. The crushed product having passed through the sieve was further pulverized by an impingement-type pulverizer utilizing a jet air stream and then pneumatically classified to recover Back toner particles.

Block toner No. 1 was prepared and evaluated by using Black toner particles otherwise in the same manner as in Example 1.

EXAMPLE 11

An aqueous dispersion medium containing a dispersion stabilizer was prepared by adding 30 parts of zinc phosphate to 1000 parts of deionized water. Magenta toner No. 10 was prepared and evaluated in the same manner as in Example 1 except for using the aqueous dispersion medium.

EXAMPLE 12

An aqueous dispersion medium containing a dispersion stabilizer was prepared by adding 30 parts of barium sulfate to 1000 parts of deionized water. Magenta toner No. 11 was prepared and evaluated in the same manner as in Example 1 except for using the aqueous dispersion medium.

EXAMPLE 13

Magenta toner No. 12 was prepared and evaluated in the same manner as in Example 1 except for using Sulfur-containing polymer 6 instead of Sulfur-containing polymer 1.

EXAMPLE 14

Magenta toner No. 13 was prepared and evaluated in the same manner as in Example 1 except for using Sulfur-containing polymer 7 instead of Sulfur-containing polymer 1.

EXAMPLE 15

Magenta toner No. 14 was prepared and evaluated in the same manner as in Example 1 except for using Sulfur-containing polymer 8 instead of Sulfur-containing polymer 1.

Figure 8:
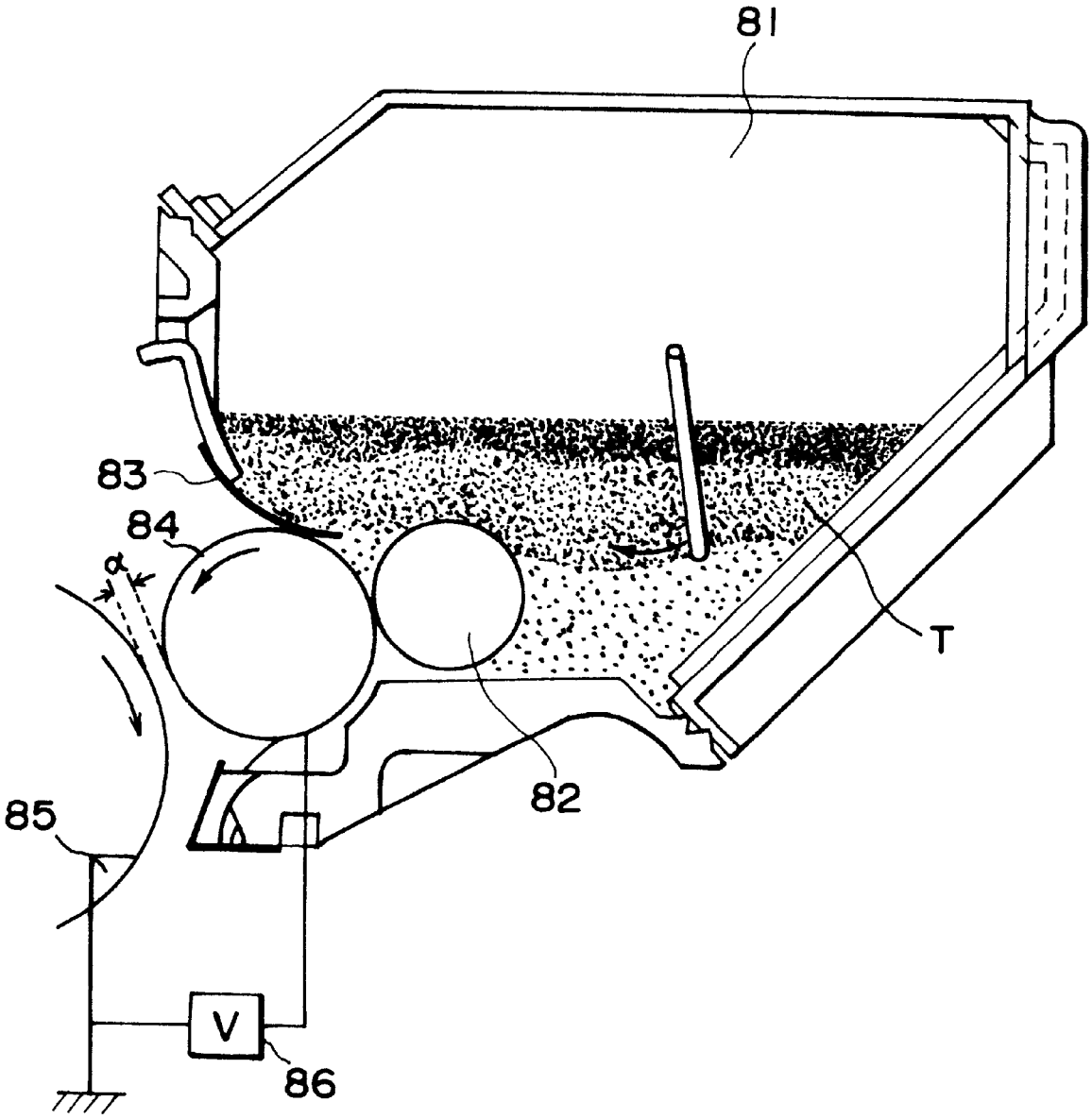
FIG. 8 illustrates a non-magnetic mono-component developing system.

Magenta toner No. 14 thus prepared was subjected to an image forming test by incorporating it in a full-color copying machine having an organization as shown in FIG. 5 and equipped with a non-magnetic mono-component developing device as shown in FIG. 8 obtained by remodeling a commercially available digital full-color copying machine ("Creative Processor 660", made by Canon K.K.).

The physical property and results of performance evaluation are shown in Tables 2 and 5.

EXAMPLE 16

Magenta toner No. 15 was prepared and evaluated in the same manner as in Example 1 except for omitting the condensation resin (isophthalic acid-P.O.-modified bisphenol A).

EXAMPLE 17

Magenta toner No. 16 was prepared and evaluated in the same manner as in Example 1 except for changing the condensation resin to a condensation resin having an acid value (AV) of 40 mgKOH/g.

EXAMPLE 18

Cyan toner No. 1, Yellow toner No. 1 and Black toner No. 2 were respectively prepared in the same manner as in Example 1 except for using C.I. Pigment Blue 15:3, C.I. Pigment Yellow 185 and carbon black, respectively, instead of C.I. Pigment Red 122/C.I. Pigment Red 57 (=1/1).

7 parts each of Magenta toner No. 1 (prepared in Example 1), Cyan toner No. 1, Yellow toner No. 1 and Black toner No. 2 were respectively blended with 93 parts of the silicone resin-coated magnetic material dispersion-type carrier to prepare four developers of the respective colors.

These developers were charged in respective developing devices 54-1 to 54-4 of an image forming apparatus having an organization as shown in FIG. 5 obtained by remodeling the commercially available digital full-color copying machine ("Creative Processor 660", made by Canon K.K.) and evaluated with respect to full-color image forming performance. As a result, the resultant full-color images exhibited good color reproducibility, were free from fog and satisfactory regarding image contour of secondary colors.

Further, the transferability of the toners were evaluated in the respective environments, the physical property and evaluation results are shown in Tables 2 and 7 together with those obtained in the following Example 19.

EXAMPLE 19

Cyan toner No. 2, Yellow toner No. 2 and Black toner No. 3 were respectively prepared in the same manner as in Example 18 except for using Sulfur-containing polymer 8 instead of Sulfur-containing polymer 1.

Similar image forming evaluation as in Example 18 was performed by using Magenta toner No. 14 (prepared in Example 15) and the above-prepared Cyan toner No. 2, Yellow toner No. 2 and Black toner No. 3.

The resultant full-color images exhibited good color reproducibility, were free from fog and satisfactory regarding image contour of secondary colors and also exhibited good transferability.

COMPARATIVE EXAMPLE 1

(Dispersion Medium)

To 1000 parts of deionized water placed in a reaction vessel, 14 parts of sodium phosphate and 45 pats of 10%-hydrochloric acid were added, and the system was held at 65° C. for 60 min. under $N_2$-purging. While the mixture was stirred at 12000 rpm by a TK-homomixer (made by Tokushu Kika Kogyo K.K.), a calcium chloride aqueous solution formed by dissolving 8 parts of calcium chloride in 10 parts of deionized water was added at a time to form an aqueous medium containing a dispersion stabilizer.

| (Polymerizable monomer composition) | |
|---|---|
| Styrene | 60 part(s) |
| Colorant (C.I. Pigment Red 122/C.I. Pigment Red 57 = 1/1) | 7 " |
| Sulfur-containing polymer 1 | 8 " |

The above ingredients were charged in a dispersion machine ("Attritor", made by Mitsui Kakoki K.K.) containing 2 mm-dia. zirconia particles and were dispersed at 220 rpm for 5 hours to form a monomer mixture.

To the monomer mixture, the following ingredients:

| | |
|---|---|
| Styrene | 20 part(s) |
| n-Butyl acrylate | 20 " |
| Sulfur-containing polymer 1 | 8 " |
| Release agent No. 8 | 20 " |
| Crosslinking agent (divinylbenzene) | 0.4 " |

were further added.

The resultant mixture was placed in a separate vessel, and subjected to uniform dissolution and dispersion under stirring at 500 rpm by a TK-Homomixer, and 2.5 parts of 2,2'-azobis(2,4-dimethylvaleronitrile) (polymerization initiator) was dissolved therein to form a polymerizable monomer composition.

Into the above-prepared aqueous dispersion medium in the reaction vessel, the polymerizable monomer composition was added, and the system was stirred at 10000 rpm by the TK-homomixer for 5 min. at 65° C. under $N_2$-purging to form droplets of the polymerizable monomer composition. Then, while being stirred by paddle stirring blades, the system was subjected to 6 hours of polymerization and then heated to 90° C. for further 6 hours of polymerization.

After the polymerization, the system was cooled, and 10%-hydrochloric acid was added thereto to provide pH 2, followed by 2 hours of stirring for dissolution of the dispersion stabilizer. The polymerizate was then recovered by filtration under pressure and washed with 2000 parts or more of deionized water. Then, the recovered polymerizate in the form of a cake was re-dispersed in 1000 parts of deionized water, and 10%-hydrochloric acid was added thereto to provide pH=2, followed by further 2 hours of stirring for re-washing. The re-washed polymerizate was again recovered by filtration under pressure similarly as above, washed with 2000 parts or more of deionized water. Thereafter, the post treatment including the drying, classification and blending with an external additive was performed in the same manner as in Example 1 to obtain Magenta toner No. 17, which was evaluated in the same manner as in Example 1.

The physical properties and results of evaluation are inclusively shown in Tables 3 and 6 together with those of the following Comparative Examples.

COMPARATIVE EXAMPLE 2

(Dispersion Medium)

To 1000 parts of deionized water placed in a reaction vessel, 0.25 part of silane coupling agent ("KBE 903", made by Shin'etsu Silicone K.K.) was added and uniformly dispersed and then 5 parts of colloidal silica ("Aerosil #200", made by Nippon Aerosil K.K.) was added and uniformly dispersed, to form an aqueous medium containing a dispersion stabilizer.

| (Polymerizable monomer composition) | |
|---|---|
| Styrene | 60 part(s) |
| Colorant (C.I. Pigment Red 122/C.I. Pigment Red 57 = 1/1) | 7 " |
| Sulfur-containing polymer 1 | 0.8 " |

The above ingredients were charged in a dispersion machine ("Attritor", made by Mitsui Kakoki K.K.) containing 2 mm-dia. zirconia particles and were dispersed at 220 rpm for 5 hours to form a monomer mixture.

To the monomer mixture, the following ingredients:

| | |
|---|---|
| Styrene | 20 part(s) |
| n-Butyl acrylate | 20 " |
| Condensation resin (saturated polyester) (isophthalic acid-propylene oxide (P.O.)-modified bisphenol A; Mw = 10,000, AV = 15 mgKOH/g) | 8 " |
| Release agent No. 8 | 20 " |
| Crosslinking agent (divinylbenzene) | 0.4 " |

were further added.

The resultant mixture was placed in a separate vessel, and subjected to uniform dissolution and dispersion under stirring at 500 rpm by a TK-Homomixer, and 2.5 parts of 2,2'-azobis(2,4-dimethylvaleronitrile) (polymerization initiator) was dissolved therein to form a polymerizable monomer composition.

Into the above-prepared aqueous dispersion medium in the reaction vessel, the polymerizable monomer composition was added, and the system was stirred at 10000 rpm by the TK-homomixer for 5 min. at 65° C. under $N_2$-purging to form droplets of the polymerizable monomer composition. Then, while being stirred by paddle stirring blades, the system was subjected to 6 hours of polymerization and then heated to 90° C. for further 6 hours of polymerization.

After the polymerization, the system was cooled, and 35 parts of 20%-sodium hydroxide was added thereto to effect an alkali treatment. The polymerizate was then recovered by filtration under pressure and washed with 2000 parts or more of deionized water. Thereafter, the post-treatment including the drying, classification and blending with an external additive was performed in the same manner as in Example 1 to obtain Magenta toner No. 18, which was then evaluated in the same manner as in Example 1.

COMPARATIVE EXAMPLE 3

Magenta toner No. 19 was prepared and evaluated in the same manner as in Example 1 except for reducing the amount of Sulfur-containing polymer 1 in the monomer mixture to 0.1 part.

COMPARATIVE EXAMPLE 4

(Dispersion Medium)

An aqueous medium containing a dispersion stabilizer was prepared in the same manner as in Example 1.

| (Polymerizable monomer composition) | |
|---|---|
| Styrene | 60 part(s) |
| Colorant (carbon black) | 7 " |
| Urea compound | 1.0 " |

The above ingredients were charged in a dispersion machine ("Attritor", made by Mitsui Kakoki K.K.) containing 2 mm-dia. zirconia particles and were dispersed at 220 rpm for 5 hours to form a monomer mixture.

To the monomer mixture, the following ingredients:

| | |
|---|---|
| Styrene | 20 part(s) |
| n-Butyl acrylate | 20 " |
| Condensation resin (saturated polyester) (isophthalic acid-propylene oxide (P.O.)-modified bisphenol A; Mw = 10,000, AV = 15 mgKOH/g) | 8 " |
| Release agent No. 8 | 20 " |
| Crosslinking agent (divinylbenzene) | 0.4 " |

were further added.

The resultant mixture was placed in a separate vessel, and subjected to uniform dissolution and dispersion under stirring at 500 rpm by a TK-Homomixer, and 2.5 parts of 2,2'-azobis(2,4-dimethylvaleronitrile) (polymerization initiator) was dissolved therein to form a polymerizable monomer composition.

Into the above-prepared aqueous dispersion medium in the reaction vessel, the polymerizable monomer composition was added, and the system was stirred at 10000 rpm by the TK-homomixer for 5 min. at 65° C. under $N_2$-purging to form droplets of the polymerizable monomer composition. Then, while being stirred by paddle stirring blades, the system was subjected to 6 hours of polymerization and then heated to 90° C. for further 6 hours of polymerization.

After the polymerization, the system was cooled, and 10%-hydrochloric acid was added thereto to provide pH 2, followed by 2 hours of stirring for dissolution of the dispersion stabilizer. The polymerizate was then recovered by filtration under pressure and washed with 2000 parts or more of deionized water. Then, the recovered polymerizate in the form of a cake was re-dispersed in 1000 parts of deionized water, and 10%-hydrochloric acid was added thereto to provide pH=2, followed by further 2 hours of stirring for re-washing. The re-washed polymerizate was again recovered by filtration under pressure similarly as above, washed with 2000 parts or more of deionized water. Thereafter, the post-treatment including the drying, classification and blending with an external additive was performed in the same manner as in Example 1 to obtain Black toner No. 4, which was then evaluated in the same manner as in Example 1.

COMPARATIVE EXAMPLE 5

Magenta toner No. 20 was prepared and evaluated in the same manner as in Example 1 except for using salicylic acid aluminum compound instead of Sulfur-containing polymer 1.

COMPARATIVE EXAMPLE 6

The process of Example 1 was repeated up to the polymerization.

After the polymerization, 10%-hydrochloric acid was added to the system to provide pH 2, followed by 2 hours of stirring for dissolution of the dispersion stabilizer. The polymerizate was then recovered by filtration under pressure and washed with 2000 parts or more of deionized water. Then, the recovered polymerizate in the form of a cake was re-dispersed in 1000 parts of deionized and then, instead of the addition of 10%-hydrochloric acid for re-washing, sulfuric acid was added to provide pH 5.5, followed by 10 min. of stirring for dissolution. Thereafter, the post-treatment including the drying, classification and blending with an external additive was performed in the same manner as in Example 1 to obtain Magenta toner No. 21, which was then evaluated in the same manner as in Example 1.

COMPARATIVE EXAMPLE 7

Cyan toner No. 3, Yellow toner No. 3 and Black toner No. 5 were respectively prepared in the same manner as in Comparative Example 1 except for using C.I. Pigment Blue 15:3, C.I. Pigment Yellow 185 and carbon black, respectively, instead of C.I. Pigment Red 122/C.I. Pigment Red 57 (=1/1). 7 parts each of Magenta toner No. 17 (prepared in Comparative Example 1), Cyan toner No. 1, Yellow toner No. 3 and Black toner No. 5 were respectively blended with 93 parts of the silicone resin-coated magnetic material dispersion-type carrier to prepare four developers of the respective colors.

These developers were charged in respective developing devices 54-1 to 54-4 of an image forming apparatus having an organization as shown in FIG. 5 obtained by remodeling the commercially available digital full-color copying machine ("Creative Processor 660", made by Canon K.K.) and evaluated with respect to full-color image forming performance. As a result, the resultant full-color images were not so good in color reproducibility, were accompanied with fog and resulted in noticeable image contour line.

The physical property and results of transfer efficiency evaluation are shown in Tables 3 and 7.

The toners prepared in the above Examples and Comparative Examples were evaluated with respect to the following items.

1) Chargeability in a Two-Component Developer

As described in Example 1, a sample toner (a mixture of 100 parts of toner particles with 1.0 part of hydrophobic titanium oxide fine powder ($S_{BET}$=100 $m^2/g$)) is blended with silicone resin-coated magnetic material dispersion-type carrier in a weight ratio of 7:93 to provide 20 g of a sample developer.

The chargeability measurement is performed in each of three environments of A: 13° C./10%RH, B: 20° C./60%RH and C: 32° C./80%RH. In each environment, each sample developer is first left to stand for 24 hours, then shaked 150 times in a polyethylene bottle and then subjected to the charge measurement. Further, each sample developer is left to stand for 7 days, shaked one time in a polyethylene bottle and then subjected to the charge measurement.

The charge of each sample developer is subjected to the charge measurement in an apparatus as illustrated in FIG. 1.

More specifically, referring to FIG. 1, ca. 0.2 g of a developer sample is placed in a metal measurement vessel 102 provided with a 635-mesh screen 3 being an opening of 20 $\mu$m at a bottom and is covered with a metal lid 4. At this time, the entire measurement vessel 2 is weighted at $W_1$ (g). Then, the developer is sucked through an aspirator 1 (of which at least a portion contacting the vessel 2 is composed of an insulating material), and a suction port 7 connected to a vacuum system (not shown) while adjusting a control valve 6 to provide a pressure of 250 mmAq at a vacuum gauge 5. In this state, the toner is sufficiently removed by suction, preferably by suction for ca. 2 min. Thereafter, a potential meter 9 connected via a capacitor 8 having a capacitance C ($\mu$F) is read at a potential V (volts.) After the suction, the entire measurement vessel is weighed at $W_2$ (g). From these values, the triboelectric charge Q (mC/kg) of the toner is calculated by the following equation:

$$Q(mC/kg)=(C\times V)/(W_1-W_2).$$

The measured results are shown in Tables 4 and 6.

2) Chargeability in a Mono-Component Developer (Example 15)

In each of the above-mentioned three environments of A, B and C, a developing device containing a sample toner is left to stand for 24 hours, then placed on a developing sleeve rotation driver to effect 30 sec of rotation, and then subjected to a chargeability measurement. Then, a sample toner is left to stand for 7 days and subjected to rotation for 1 sec and then to rotation for 30 sec for chargeability measurement after each rotation.

For measurement, a sample toner on the sleeve after the rotation is collected by sucking in an amount of M (kg), and a charge T (mC) thereof is measured by means a Coulomb meter to calculate a chargeability Q (mC/kg)=T/M.

The measured results of Example 15 are shown in Table 5.

3) Image Density

Solid images were formed and fixed by using the copying machine described in Example 1 including a mechanism for controlling the density of a solid image on the image bearing member together with a 40 mm-dia. external heat roller fixing device having no oil application mechanism, and the reflection densities thereof were measured by a reflection densitometer ("Macbeth RD918", made by Macbeth Co.).

The heat roller fixing device included a pair of rollers both surfaced with a fluorine-containing resin, and the fixed images were formed on plain paper of 75 $g/m^2$ (made by Xerox Co.).

More specifically, in each environment, the image forming apparatus containing a sample toner was left to stand for 24 hours and then used for formation of images of an image real percentage of 5% on 1000 sheets an then a fully solid image on one sheet for the density measurement. Then, the image forming apparatus was further left to stand for 7 days and then used for image formation of a 5%-area image on one sheet and then a fully solid image on one sheet for the density measurement. Further, image formation was continued for forming 5%-area images on 1000 sheets and then a fully solid image on one sheet for the density measurement.

The results are shown in Tables 4 and 6.

4) Transfer Efficiency

The image forming apparatus similar to the one used in the above-density measurement was used for full-color image formation as described in Example 18.

For the primary transfer efficiency (Tef.1st), four-color solid images were outputted to form superposed toner images on the intermediate transfer member (55 in FIG. 5). The primary transfer residual toner (Tres.1st) on the photosensitive drum and the unfixed toner images (Tunfixed) on the intermediate transfer member were recovered by air sucking to determine the respective amounts, from which a primary transfer efficiency (Tef.1st) was calculated according to the following formula:

$$Tef.1st(\%)=(Tunfixed/(Tunfixed+Tres.1st))\times 100$$

For the secondary transfer efficiency (Tef.2nd), four color solid images were outputted and transferred via the intermediate transfer member onto transfer paper of 80 g/m$^2$. The secondary transfer residual toner (Tres.2nd) on the intermediate transfer member and the unfixed toner image (Tunfixed.p) on the transfer paper were recovered by air sucking to determine the respective amounts, from which a secondary transfer efficiency (Tef.2nd) was calculated according to the following formula:

$$Tef.2nd(\%)=(Tunfixed.p)/(Tunfixed.p+Tres.2nd))\times 100.$$

Each transfer efficiency was evaluated in Table 7 according to the following standard.

A: Tef≧90%

B: 80%≦Tef<90%

C: 70%≦Tef<80%

D: Tef<70%

5) Half-tone Image Uniformity

After the image density evaluation in the B environment of 20° C./60%RH (after image formation on 2000 sheets), a 5%-area image was formed on 10000 sheets (in the case of two-component developers) or on 2000 sheets (in the case of mono-component developer in Example 15), and the uniformity of the halftone image was evaluated by eye observation at the time of completion of the halftone image formation on the prescribed number of sheets according to the following standard.

A: Very uniform image

B: Uniform image

C: Image accompanied with some nonuniformity at edges.

D: Nonuniformity observed on the entire image.

6) Fixability (1) (in B Environment)

By using the image forming machine in the B environment of 20° C./60%RH, unfixed toner images at a toner coverage of 1.0 mg/cm$^2$ were outputted onto transfer paper of 75 g/m$^2$ (made by Xerox Co) and subjected to fixation at 180° C. and 120 mm/sec by a 40 mm-dia. external heat roller fixing device including a pair of rollers both surfaced with a fluorine-containing resin and not equipped with an oil application mechanism. The fixability was evaluated based on number of blisters found at two fixed toner image patches each measuring 2 cm×5 cm according to the following standard.

A: Good fixability with no irregularity observed.

B: 1 to 5 blisters having a diameter of below 2 mm.

C: 6 to 10 blisters having a diameter of below 2 mm.

D: 11 or more blister having a diameter of below 2 mm or a blister having a diameter of 2 mm or larger observed.

7) Fixability (2) (in A Environment)

By using the image forming machine in the A environment of 13° C./10% RH, unfixed toner images at a toner coverage of 1.0 mg/cm$^2$ were outputted onto both transfer paper of 90 g/m$^2$ and transfer paper of 75 g/m$^2$ (made by Xerox Co) and subjected to fixation at 180° C. and 120 mm/sec by a 40 mm-dia. external heat roller fixing device including a pair of rollers both surfaced with a fluorine-containing resin and not equipped with an oil application mechanism. The fixability was evaluated according to the following standard.

A: Good fixability with no irregularity observed on both papers of 90 g/m$^2$ and 75 g/m$^2$.

B: Good fixability with no irregularity observed on paper of 75 g/m$^2$.

C: 1 to 5 blisters having a diameter of below 2 mm on paper of 75 g/m$^2$.

D: 6 or more blister having a diameter of below 2 mm or a blister having a diameter of 2 mm or larger observed on paper of 75 g/m$^2$.

TABLE 2

Physical properties of toners

| Example | Toner No. | Cav. | SDc | Dispersion stabilizer elements (ppm) Mg | Ca | Ba | Zn | Al | P | total | Sulfur-contains polymer Species | parts | Toner D1 (μm) | Ci < 0.950 (N%) | Mw (×10$^4$) | Release agent parts | species |
|---|---|---|---|---|---|---|---|---|---|---|---|---|---|---|---|---|---|
| 1 | Magenta 1 | 0.975 | 0.034 | 0 | 2010 | 0 | 0 | 0 | 2660 | 4670 | No. 1 | 0.8 | 6.7 | 13.4 | 21 | 20 | No. 8 |
| 2 | Magenta 2 | 0.976 | 0.034 | 2350 | 0 | 0 | 0 | 0 | 0 | 2350 | No. 1 | 0.8 | 6.7 | 13.5 | 20 | 20 | No. 11 |
| 3 | Magenta 3 | 0.977 | 0.031 | 0 | 0 | 0 | 0 | 2250 | 0 | 2250 | No. 1 | 0.8 | 6.7 | 12.8 | 20 | 20 | No. 12 |
| 4 | Magenta 4 | 0.961 | 0.038 | 0 | 3020 | 0 | 0 | 0 | 3850 | 6870 | No. 1 | 1.0 | 6.9 | 19.4 | 19 | 36 | No. 8 |
| 5 | Magenta 5 | 0.968 | 0.034 | 0 | 8500 | 0 | 0 | 0 | 11000 | 19500 | No. 1 | 7.0 | 6.8 | 14.3 | 20 | 20 | No. 8 |
| 6 | Magenta 6 | 0.975 | 0.034 | 0 | 2350 | 0 | 0 | 0 | 3030 | 5380 | No. 2 | 0.8 | 6.5 | 13.4 | 21 | 20 | No. 8 |
| 7 | Magenta 7 | 0.972 | 0.032 | 0 | 2220 | 0 | 0 | 0 | 2810 | 5030 | No. 3 | 0.8 | 6.5 | 13.4 | 21 | 20 | No. 8 |
| 8 | Magenta 8 | 0.97 | 0.032 | 0 | 2540 | 0 | 0 | 0 | 3300 | 5840 | No. 4 | 0.8 | 6.5 | 13.6 | 21 | 20 | No. 8 |
| 9 | Magenta 9 | 0.971 | 0.033 | 0 | 2470 | 0 | 0 | 0 | 3210 | 5680 | No. 5 | 0.8 | 6.5 | 13.7 | 20 | 20 | No. 8 |
| 10 | Black 1 | 0.919 | 0.051 | 0 | 4100 | 0 | 0 | 0 | 5300 | 9400 | No. 1 | 1.0 | 6.8 | 21.1 | 18 | 4 | No. 8 |
| 11 | Magenta 10 | 0.965 | 0.038 | 0 | 0 | 0 | 2100 | 0 | 2700 | 4800 | No. 1 | 0.8 | 6.9 | 14.1 | 21 | 20 | No. 8 |
| 12 | Magenta 11 | 0.963 | 0.038 | 0 | 0 | 2500 | 0 | 0 | 0 | 2500 | No. 1 | 0.8 | 6.9 | 14.0 | 21 | 20 | No. 8 |
| 13 | Magenta 12 | 0.97 | 0.035 | 0 | 2100 | 0 | 0 | 0 | 2700 | 4800 | No. 6 | 0.8 | 6.8 | 13.9 | 20 | 20 | No. 8 |
| 14 | Magenta 13 | 0.976 | 0.034 | 0 | 1950 | 0 | 0 | 0 | 2550 | 4500 | No. 7 | 0.8 | 6.8 | 13.2 | 21 | 20 | No. 8 |
| 15 | Magenta 14 | 0.977 | 0.035 | 0 | 1900 | 0 | 0 | 0 | 2500 | 4400 | No. 8 | 0.8 | 6.9 | 13.0 | 21 | 20 | No. 8 |
| 16 | Magenta 15 | 0.964 | 0.039 | 0 | 2030 | 0 | 0 | 0 | 2700 | 4730 | No. 1 | 0.8 | 6.9 | 14.3 | 21 | 20 | No. 8 |
| 17 | Magenta 16 | 0.968 | 0.038 | 0 | 1000 | 0 | 0 | 0 | 1500 | 2500 | No. 1 | 0.8 | 6.8 | 13.6 | 21 | 20 | No. 8 |
| 18 | Magenta 1 | 0.975 | 0.034 | 0 | 2010 | 0 | 0 | 0 | 2660 | 4670 | No. 1 | 0.8 | 6.7 | 13.4 | 21 | 20 | No. 8 |
| | Cyan 1 | 0.976 | 0.034 | 0 | 2040 | 0 | 0 | 0 | 3200 | 5240 | No. 1 | 0.8 | 6.4 | 13.5 | 21 | 20 | No. 8 |

TABLE 2-continued

| Example | Toner No. | Cav. | SDc | Mg | Ca | Ba | Zn | Al | P | total | Sulfur-contains polymer Species | parts | D1 (μm) | Ci < 0.950 (N%) | Mw (×10⁴) | Release agent parts | species |
|---|---|---|---|---|---|---|---|---|---|---|---|---|---|---|---|---|---|
| | | | | Dispersion stabilizer elements (ppm) | | | | | | | | | Toner | | | | |
| | Yellow 1 | 0.973 | 0.034 | 0 | 2060 | 0 | 0 | 0 | 3000 | 5060 | No. 1 | 0.8 | 6.5 | 13.2 | 21 | 20 | No. 8 |
| | Black 2 | 0.978 | 0.032 | 0 | 2080 | 0 | 0 | 0 | 2950 | 5030 | No. 1 | 0.8 | 6.5 | 12.6 | 21 | 20 | No. 8 |
| 19 | Magenta 14 | 0.977 | 0.035 | 0 | 1900 | 0 | 0 | 0 | 2500 | 4400 | No. 8 | 0.8 | 6.9 | 13.0 | 21 | 20 | No. 8 |
| | Cyan 2 | 0.976 | 0.033 | 0 | 2000 | 0 | 0 | 0 | 2640 | 4640 | No. 8 | 0.8 | 6.7 | 13.6 | 21 | 20 | No. 8 |
| | Yellow 2 | 0.972 | 0.035 | 0 | 1980 | 0 | 0 | 0 | 2610 | 4590 | No. 8 | 0.8 | 6.8 | 13.3 | 21 | 20 | No. 8 |
| | Black 3 | 0.977 | 0.034 | 0 | 2010 | 0 | 0 | 0 | 2660 | 4670 | No. 8 | 0.8 | 6.7 | 13 | 21 | 20 | No. 8 |

TABLE 3

Physical properties of toners (Comparative)

| Comp. Ex. | Toner No. | Cav. | SDc | Mg | Ca | Ba | Zn | Al | P | total | Sulfur-contains polymer Species | parts | D1 (μm) | Ci < 0.950 (N%) | Mw (×10⁴) | Release agent parts | species |
|---|---|---|---|---|---|---|---|---|---|---|---|---|---|---|---|---|---|
| | | | | Dispersion stabilizer elements (ppm) | | | | | | | | | Toner | | | | |
| 1 | Magenta 17 | 0.959 | 0.040 | 0 | 21000 | 0 | 0 | 0 | 28000 | 49000 | No. 1 | 16.0 | 6.7 | 15 | 21 | 20 | No. 8 |
| 2* | Magenta 18 | 0.965 | 0.039 | 0 | 0 | 0 | 0 | 0 | 0 | 0 | No. 1 | 0.8 | 6.8 | 14.9 | 20 | 20 | No. 8 |
| 3 | Magenta 19 | 0.97 | 0.033 | 0 | 10 | 0 | 0 | 0 | 20 | 30 | No. 1 | 0.1 | 6.7 | 13.7 | 21 | 20 | No. 8 |
| 4 | Black 4 | 0.973 | 0.032 | 0 | 400 | 0 | 0 | 0 | 510 | 910 | — | — | 6.6 | 14.9 | 20 | 20 | No. 8 |
| 5 | Magenta 20 | 0.968 | 0.038 | 0 | 500 | 0 | 0 | 0 | 700 | 1200 | No. 1 | 0.8 | 6.9 | 14.7 | 21 | 20 | No. 8 |
| 6 | Magenta 21 | 0.975 | 0.034 | 0 | 15000 | 0 | 0 | 0 | 21000 | 36000 | No. 1 | 0.8 | 6.7 | 13.4 | 21 | 20 | No. 8 |
| 7 | Magenta 17 | 0.959 | 0.040 | 0 | 21000 | 0 | 0 | 0 | 28000 | 49000 | No. 1 | 16.0 | 6.7 | 15 | 21 | 20 | No. 8 |
| | Cyan 3 | 0.959 | 0.040 | 0 | 20500 | 0 | 0 | 0 | 27000 | 47500 | No. 1 | 16.0 | 6.7 | 15 | 21 | 20 | No. 8 |
| | Yellow 3 | 0.959 | 0.040 | 0 | 20800 | 0 | 0 | 0 | 27600 | 48400 | No. 1 | 16.0 | 6.7 | 15 | 21 | 20 | No. 8 |
| | Black 5 | 0.959 | 0.040 | 0 | 20700 | 0 | 0 | 0 | 26500 | 47200 | No. 1 | 16.0 | 6.7 | 15 | 21 | 20 | No. 8 |

*Si content in Comp. Ex. 2 was 5550 ppm.

TABLE 4

Toner performances (in two-component developer)

| Example | Toner No. | Chargeability (mC/kg) A: 13° C./10% RH 24 hr 150 times | A: 13° C./10% RH 7 days 1 time | A: 13° C./10% RH 7 days 150 times | B: 20° C./60% RH 24 hr 150 times | B: 20° C./60% RH 7 days 1 time | B: 20° C./60% RH 7 days 150 times | C: 32° C./80% RH 24 hr 150 times | C: 32° C./80% RH 7 days 1 time | C: 32° C./80% RH 7 days 150 times | Image density A: 13° C./10% RH 24 hr after 1000 sheets | A: 13° C./10% RH 7 days after 1 sheet | A: 13° C./10% RH 7 days after 1000 sheets | B: 20° C./60% RH 24 hr after 1000 sheets | B: 20° C./60% RH 7 days after 1 sheet | B: 20° C./60% RH 7 days after 1000 sheets |
|---|---|---|---|---|---|---|---|---|---|---|---|---|---|---|---|---|
| 1 | Magenta 1 | −35 | −36 | −37 | −30 | −31 | −32 | −25 | −26 | −27 | 1.39 | 1.38 | 1.38 | 1.4 | 1.4 | 1.4 |
| 2 | Magenta 2 | −34 | −35 | −36 | −29 | −30 | −31 | −24 | −25 | −26 | 1.39 | 1.39 | 1.38 | 1.41 | 1.4 | 1.4 |
| 3 | Magenta 3 | −33 | −34 | −35 | −28 | −29 | −30 | −23 | −24 | −25 | 1.39 | 1.39 | 1.39 | 1.41 | 1.41 | 1.4 |
| 4 | Magenta 4 | −34 | −35 | −36 | −29 | −30 | −31 | −24 | −23 | −21 | 1.39 | 1.39 | 1.38 | 1.41 | 1.4 | 1.4 |
| 5 | Magenta 5 | −36 | −38 | −42 | −28 | −29 | −31 | −24 | −25 | −27 | 1.38 | 1.38 | 1.36 | 1.41 | 1.41 | 1.4 |
| 6 | Magenta 6 | −37 | −38 | −39 | −32 | −33 | −34 | −27 | −28 | −29 | 1.38 | 1.38 | 1.37 | 1.4 | 1.39 | 1.39 |
| 7 | Magenta 7 | −35 | −36 | −37 | −30 | −31 | −32 | −25 | −26 | −27 | 1.39 | 1.38 | 1.38 | 1.4 | 1.4 | 1.4 |
| 8 | Magenta 8 | −36 | −38 | −42 | −31 | −32 | −33 | −26 | −27 | −28 | 1.38 | 1.38 | 1.36 | 1.4 | 1.4 | 1.39 |
| 9 | Magenta 9 | −36 | −38 | −42 | −31 | −32 | −33 | −26 | −27 | −28 | 1.38 | 1.38 | 1.36 | 1.4 | 1.4 | 1.39 |
| 10 | Black 1 | −35 | −38 | −41 | −30 | −32 | −37 | −25 | −22 | −19 | 1.39 | 1.38 | 1.37 | 1.4 | 1.4 | 1.38 |
| 11 | Magenta 10 | −35 | −36 | −37 | −30 | −31 | −32 | −25 | −24 | −22 | 1.39 | 1.38 | 1.38 | 1.4 | 1.4 | 1.4 |

TABLE 4-continued

| Toner performances (in two-component developer) | | | | | | | | | | | | | | | | |
|---|---|---|---|---|---|---|---|---|---|---|---|---|---|---|---|---|
| 12 | Magenta 11 | −34 | −35 | −36 | −29 | −30 | −31 | −24 | −23 | −21 | 1.39 | 1.39 | 1.38 | 1.41 | 1.4 | 1.4 |
| 13 | Magenta 12 | −33 | −35 | −37 | −28 | −30 | −32 | −23 | −25 | −27 | 1.39 | 1.39 | 1.38 | 1.41 | 1.4 | 1.4 |
| 14 | Magenta 13 | −36 | −37 | −37 | −28 | −29 | −30 | −24 | −25 | −25 | 1.38 | 1.38 | 1.37 | 1.41 | 1.41 | 1.4 |
| 16 | Magenta 14 | −30 | −24 | −20 | −22 | −18 | −15 | −20 | −17 | −15 | 1.4 | 1.42 | 1.44 | 1.43 | 1.44 | 1.45 |
| 17 | Magenta 16 | −40 | −43 | −46 | −35 | −33 | −37 | −27 | −24 | −28 | 1.37 | 1.36 | 1.35 | 1.39 | 1.39 | 1.38 |

| | | Image density C: 32° C./80% RH | | | | | |
|---|---|---|---|---|---|---|---|
| | | 24 hr | 7 days | | | | |
| Example | Toner No. | after 1000 sheets | after 1 sheet | after 1000 sheets | Half tone | Fixability B | Fixability A |
| 1 | Magenta 1 | 1.42 | 1.42 | 1.41 | A | A | B |
| 2 | Magenta 2 | 1.42 | 1.42 | 1.42 | A | A | B |
| 3 | Magenta 3 | 1.43 | 1.42 | 1.42 | A | A | B |
| 4 | Magenta 4 | 1.42 | 1.43 | 1.43 | B | A | B |
| 5 | Magenta 5 | 1.42 | 1.42 | 1.41 | B | B | B |
| 6 | Magenta 6 | 1.41 | 1.41 | 1.41 | A | A | B |
| 7 | Magenta 7 | 1.42 | 1.42 | 1.41 | A | A | B |
| 8 | Magenta 8 | 1.42 | 1.41 | 1.41 | B | A | B |
| 9 | Magenta 9 | 1.42 | 1.41 | 1.41 | B | A | B |
| 10 | Black 1 | 1.42 | 1.43 | 1.44 | B | B | B |
| 11 | Magenta 10 | 1.42 | 1.42 | 1.43 | B | A | B |
| 12 | Magenta 11 | 1.42 | 1.43 | 1.43 | B | A | B |
| 13 | Magenta 12 | 1.43 | 1.42 | 1.41 | B | A | B |
| 14 | Magenta 13 | 1.42 | 1.42 | 1.42 | A | A | A |
| 16 | Magenta 14 | 1.44 | 1.45 | 1.45 | B | B | B |
| 17 | Magenta 16 | 1.41 | 1.42 | 1.41 | B | B | B |

TABLE 5

| Toner performance (in mono-component developer) | | | | | | | | | | | | | | | | |
|---|---|---|---|---|---|---|---|---|---|---|---|---|---|---|---|---|
| | | Chargeability (mC/kg) | | | | | | | | | Image density | | | | | |
| | | | | | | | | | | | A: 13° C./10% RH | | | B: 20° C./60% RH | | |
| | | A: 13° C./10% RH | | | B: 20° C./60% RH | | | C: 32° C./80% RH | | | 24 hr | 7 days | | 24 hr | 7 days | |
| | | 24 hr | 7 days | | 24 hr | 7 days | | 24 hr | 7 days | | after | | after | after | | after |
| Example | Toner No. | 30 sec | 1 sec | 30 sec | 30 sec | 1 sec | 30 sec | 30 sec | 1 sec | 30 sec | 1000 sheets | after 1 sheet | 1000 sheets | 1000 sheets | after 1 sheet | 1000 sheets |
| 15 | Magenta 14 | −36 | −37 | −38 | −28 | −29 | −30 | −24 | −25 | −25 | 1.38 | 1.38 | 1.38 | 1.41 | 1.41 | 1.4 |

| | | Image density C: 32° C./80% RH | | | | | |
|---|---|---|---|---|---|---|---|
| | | 24 hr | 7 days | | | | |
| Example | Toner No. | after 1000 sheets | after 1 sheet | after 1000 sheets | Half tone | Fixability B | Fixability A |
| 15 | Magenta 14 | 1.42 | 1.42 | 1.42 | A | A | A |

TABLE 6

Toner performances (Comparative)
(in two-component developers)

| | | Chargeability (mC/kg) | | | | | | | | | Image density | | | | | |
|---|---|---|---|---|---|---|---|---|---|---|---|---|---|---|---|---|
| | | | | | | | | | | | A: 13° C./10% RH | | | B: 20° C./60% RH | | |
| | | A: 13° C./10% RH | | | B: 20° C./60% RH | | | C: 32° C./80% RH | | | 24 hr | 7 days | | 24 hr | 7 days | |
| | | 24 hr | 7 days | | 24 hr | 7 days | | 24 hr | 7 days | | after | | after | after | | after |
| Comp. Ex. | Toner times | 150 time | 1 times | 150 times | 150 time | 1 times | 150 times | 150 time | 1 times | 150 times | 1000 sheets | after 1 sheet | 1000 sheets | 1000 sheets | after 1 sheet | 1000 sheets |
| 1 | Magenta 17 | −25 | −20 | −15 | −20 | −13 | −9 | −15 | −10 | −5 | 1.42 | 1.44 | 1.45 | 1.44 | 1.46 | 1.47 |
| 2 | Magenta 18 | −34 | −37 | −45 | −29 | −34 | −38 | −24 | −20 | −16 | 1.39 | 1.38 | 1.35 | 1.41 | 1.39 | 1.47 |
| 3 | Magenta 19 | −28 | −23 | −18 | −21 | −15 | −11 | −15 | −10 | −7 | 1.41 | 1.43 | 1.44 | 1.43 | 1.45 | 1.38 |
| 4 | Black 4 | −31 | −15 | −10 | −25 | −10 | −8 | −15 | −8 | −4 | 1.4 | 1.45 | 1.47 | 1.42 | 1.47 | 1.48 |
| 5 | Magenta 20 | −34 | −37 | −40 | −29 | −34 | −36 | −24 | −22 | −18 | 1.39 | 1.38 | 1.37 | 1.41 | 1.39 | 1.38 |
| 6 | Magenta 21 | −15 | −8 | −8 | −10 | −5 | −5 | −5 | −3 | −3 | 1.45 | 1.48 | 1.48 | 1.47 | 1.49 | 1.49 |

| | | Image density C: 32° C./80% RH | | | | | |
|---|---|---|---|---|---|---|---|
| | | 24 hr | 7 days | | | | |
| Example | Toner No. | after 1000 sheets | after 1 sheet | after 1000 sheets | Half tone | Fixability B | Fixability A |
| 1 | Magenta 17 | 1.45 | 1.47 | 1.49 | D | D | D |
| 2 | Magenta 18 | 1.42 | 1.44 | 1.45 | C | B | C |
| 3 | Magenta 19 | 1.45 | 1.47 | 1.48 | D | A | B |
| 4 | Black 4 | 1.45 | 1.48 | 1.49 | D | A | B |
| 5 | Magenta 20 | 1.42 | 1.43 | 1.44 | C | B | C |
| 6 | Magenta 21 | 1.49 | 1.49 | 1.49 | D | D | D |

TABLE 7

Full-color image-forming performances

| | | Transferability | | | | | |
|---|---|---|---|---|---|---|---|
| | | A: 13 ° C./ 10% RH | | B: 20° C./ 60% RH | | C: 32° C./ 80% RH | |
| Example | Toner No. | 1st | 2nd | 1st | 2nd | 1st | 2nd |
| 18 | Magenta 1<br>Cyan 1<br>Yellow 1<br>Black 2 | A | A | A | A | A | A |
| 19 | Magenta 14<br>Cyan 2<br>Yellow 2<br>Black 3 | A | A | A | A | A | A |
| Comp. 7 | Magenta 17<br>Cyan 3<br>Yellow 3<br>Black 5 | C | D | C | D | D | D |

What is claimed is:

1. A toner comprising: toner particles each comprising at least a binder resin, a colorant, a release agent and a sulfur-containing polymer, and an external additive;

wherein the toner particles contain 100 to 30,000 ppm by weight thereof of at least one element selected from the group consisting of magnesium, calcium, barium, zinc, aluminum and phosphorus.

2. The toner according to claim 1, wherein the sulfur-containing polymer is a polymer having a sulfonic acid group.

3. The toner according to claim 1, wherein the sulfur-containing polymer contains 0.01–20 wt. % thereof of polymerized units of a sulfur-containing monomer.

4. The toner according to claim 1, wherein the sulfur-containing polymer contains 0.05–10 wt. % thereof of polymerized units of a sulfur-containing monomer.

5. The toner according to claim 1, wherein the sulfur-containing polymer contains 0.1–7 wt. % thereof of polymerized units of a sulfur-containing monomer.

6. The toner according to claim 1, wherein the sulfur-containing polymer is a copolymer of at least a sulfonic acid group-containing (meth)acrylamide and a vinyl group-containing aromatic hydrocarbon.

7. The toner according to claim 1, wherein the sulfur-containing polymer is a copolymer of at least a sulfonic acid group-containing (meth)acrylamide and a (meth)acrylate ester.

8. The toner according to claim 1, wherein the sulfur-containing polymer is a copolymer of at least a sulfonic acid group-containing (meth)acrylamide, a vinyl group-containing aromatic hydrocarbon and a (meth)acrylate ester.

9. The toner according to claim 1, wherein the sulfur-containing polymer has a glass transition temperature of 50 to 100° C.

10. The toner according to claim 1, wherein the sulfur-containing polymer has a glass transition temperature of above 70° C. and at most 100° C.

11. The toner according to claim 1, wherein the sulfur-containing polymer has a residual monomer content of at most 1000 ppm.

12. The toner according to claim 1, wherein the sulfur-containing polymer has a residual monomer content of at most 300 ppm.

13. The toner according to claim 1, wherein the sulfur-containing polymer has an acid value of 3–80 mgKOH/g.

14. The toner according to claim 1, wherein the sulfur-containing polymer has an acid value of 5–40 mgKOH/g.

15. The toner according to claim 1, wherein the sulfur-containing polymer has an acid value of 10–40 mgKOH/g.

16. The toner according to claim 1, wherein the sulfur-containing polymer has a weight-average molecular weight of $5\times10^2$ to $1\times10^5$.

17. The toner according to claim 1, wherein the sulfur-containing polymer has a weight-average molecular weight of $5\times10^2$ to $1\times10^5$.

18. The toner according to claim 1, wherein the sulfur-containing polymer has a weight-average molecular weight of $5\times10^3$ to $5\times10^4$.

19. The toner according to claim 1, wherein the sulfur-containing polymer is contained in an amount of 0.01–15 wt. parts per 100 wt. parts of the binder resin.

20. The toner according to claim 1, wherein the sulfur-containing polymer is contained in an amount of 0.01–10 wt. parts per 100 wt. parts of the binder resin.

21. The toner according to claim 1, wherein the toner particles contain said at least one element selected from the group consisting of magnesium, calcium, barium, zinc, aluminum and phosphorus in a total amount of 100 to 20,000 ppm by weight of the toner particles.

22. The toner according to claim 1, wherein the toner particles contain said at least one element selected from the group consisting of magnesium, calcium, barium, zinc, aluminum and phosphorus in a total amount of 100 to 9,000 ppm by weight of the toner particles.

23. The toner according to claim 1, wherein the toner has an average circularity of 0.920 to 0.995, and a standard deviation of circularity of below 0.040 as measured by a flow particle image analyzer.

24. The toner according to claim 1, wherein the toner has an average circularity of 0.950 to 0.995, and a standard deviation of circularity of below 0.035 as measured by a flow particle image analyzer.

25. The toner according to claim 1, wherein the toner has an average circularity of 0.970 to 0.995, and a standard deviation of circularity of from 0.015 to below 0.035 as measured by a flow particle image analyzer.

26. The toner according to claim 1, wherein the toner has a number-average circle equivalent diameter of 2–10 $\mu$m.

27. The toner according to claim 1, wherein the toner contain at most 15% by number of toner particles having a circularity below 0.950.

28. The toner according to claim 1, wherein the toner contains a tetrahydrofuran (THF)-soluble component having a weight-average molecular weight of $1\times10^4$–$1.5\times10^6$ as measured by gel-permeation chromatography.

29. The toner according to claim 1, wherein the toner contains a tetrahydrofuran (THF)-soluble component having a weight-average molecular weight of $5\times10^4$–$4\times10^5$ as measured by gel-permeation chromatography.

30. The toner according to claim 1, wherein the release agent is an ester wax containing 50 to 95 wt. % thereof of ester compounds having an identical number of total carbon atoms.

31. The toner according to claim 1, wherein the release agent is contained in an amount of 1 to 40 wt. parts per 100 wt. parts of the binder resin.

32. The toner according to claim 1, wherein the release agent is contained in an amount of 5 to 30 wt. parts per 100 wt. parts of the binder resin.

33. The toner according to claim 1, wherein the toner particles further contain a condensation resin in addition to the binder resin and the sulfur-containing polymer.

34. The toner according to claim 33, wherein the condensation resin is a polyester.

35. The toner according to claim 33, wherein the condensation resin is a polycarbonate.

36. The toner according to claim 33, wherein the condensation resin has an acid value of 0.1–35 mgKOH/g.

37. The toner according to claim 33, wherein the condensation resin has an acid value of 5–30 mgKOH/g.

38. The toner according to claim 33, wherein the condensation resin has a weight-average molecular weight of $6\times10^3$ to $1\times10^5$.

39. The toner according to claim 33, wherein the condensation resin has a weight-average molecular weight of $6.5\times10^3$ to $4.5\times10^4$.

40. A process for producing a toner, comprising:

dispersing a monomer composition comprising at least a polymerizable monomer, a colorant, a release agent and a sulfur-containing polymer in an aqueous medium containing at least one element selected from the group consisting of magnesium, calcium, barium, zinc, aluminum and phosphorus, to form droplets of the monomer composition therein, subjecting the droplets of the monomer composition to polymerization in the aqueous medium to form toner particles containing 100 to 30,000 ppm by weight thereof of at least one element selected from the group consisting of magnesium, calcium, barium, zinc, aluminum and phosphorus, and blending the toner particles with an external additive to form a toner.

41. The process according to claim 40, wherein said at least one element selected from the group consisting of magnesium, calcium, barium, zinc, aluminum and phosphorus is contained as an element of a dispersion stabilizer in the aqueous medium.

42. The process according to claim 40, wherein the monomer composition is dispersed into droplets thereof in an aqueous medium at a pH of 4.5–13.

43. The process according to claim 42, wherein the aqueous medium is at a pH of 4.5–7.

44. The process according to claim 40, wherein the toner particles after the polymerization are washed with an acid at a pH of at most 3.

45. The process according to claim 40, wherein the toner particles after the polymerization are washed with an acid at a pH of at most 1.5.

46. A process for producing a toner, comprising:

dispersing a monomer composition comprising at least a polymerizable monomer, a colorant, a release agent and a sulfur-containing polymer in an aqueous medium containing at least one element selected from the group consisting of magnesium, calcium, barium, zinc, aluminum and phosphorus, to form droplets of the monomer composition therein, subjecting the droplets of the monomer composition to polymerization in the aqueous medium to form toner particles containing 100 to 30,000 ppm by weight thereof of at least one element selected from the group consisting of magnesium, calcium, barium, zinc, aluminum and phosphorus, and blending the toner particles with an external additive to form a toner, thereby producing a toner according to any one of claims 2 to 39.

47. An image forming method, comprising at least:

a charging step of charging an image-bearing member, an electrostatic image forming step of forming an electrostatic image on the image-bearing member, a developing step of developing the electrostatic image with a toner carried on a developer-carrying member to form a toner image on the image-bearing member, a transfer step of transferring the toner image from the image bearing member to a transfer material via or without via an intermediate transfer member, and a fixing step of fixing the toner image onto the transfer material;

wherein the toner is a toner according to any one of claims 1 to 39.

* * * * *

UNITED STATES PATENT AND TRADEMARK OFFICE

CERTIFICATE OF CORRECTION

PATENT NO. : 6,569,589 B2
DATED : May 27, 2003
INVENTOR(S) : Koji Inaba et al.

It is certified that error appears in the above-identified patent and that said Letters Patent is hereby corrected as shown below:

Column 1,
Line 20, "(-receiving)" should read -- (receiving) --; and
Line 66, "future," should read -- the future, --.

Column 5,
Line 39, "bonding" should read -- bond --.

Column 7,
Line 2, "29-table," should read -- table, --; and
Line 19, "mold" should read -- molded --.

Column 8,
Line 48, "acrylate" should read -- acrylate, --; and
Line 63, "isopropyl" should read -- iso-propyl --.

Column 9,
Line 10, "-dis(" should read -- -bis( --.

Column 10,
Line 30, "any" should read -- in any -- and "methods" should read -- method --; and
Line 32, "resins" should read -- resin --.

Column 14,
Line 56, "a" (first occurrence) should read -- an --.

Column 16,
Line 67, "medium" should read -- medium. --.

Column 17,
Line 49, "well shaked" should read -- shaken well --.

Column 18,
Line 17, "potasiumhydroxide" should read -- potassium hydroxide --; and
Line 58, "potasiumhydroxide" should read -- potassium hydroxide --.

Column 19,
Line 45, "control" should read -- control. --.

Column 22,
Line 15, "gent" should read -- agent-- and "gents" should read -- agents --.

UNITED STATES PATENT AND TRADEMARK OFFICE

CERTIFICATE OF CORRECTION

PATENT NO. : 6,569,589 B2
DATED : May 27, 2003
INVENTOR(S) : Koji Inaba et al.

It is certified that error appears in the above-identified patent and that said Letters Patent is hereby corrected as shown below:

Column 23,
Line 32, "fail in provide" should read -- will fail to provide --; and
Line 35, "manners" should read -- manner --.

Column 29,
Line 27, "$L_o/\pi$." should read -- $L_o/\pi$). --; and
Line 40, "results" should read -- result --.

Column 31,
Line 37, "acrylate" should read -- acrylate. --; and
Line 66, "-dis" should read -- -bis --.

Column 32,
Line 19, "proxy-" should read -- peroxy --; and
Line 34, "crosslikage" should read -- crosslinkage --.

Column 33,
Line 5, "subjective" should read -- subjecting --.

Column 40,
Line 38, "for repeating" should read -- to repeat --; and
Line 58, "but root" should be deleted.

Column 41,
Line 12, "gap a" should read -- gap α --;
Line 47, "my" should read -- may --;
Line 53, "th" should read -- the --; and
Line 65, "Th" should read -- The --.

Column 42,
Line 2, "intri-" should read -- in tri- --;
Line 27, "gag a" should read -- gap α --; and
Line 29, "gap a" should read -- gap α --.

Column 44,
Line 13, "4.5 pats" should read -- 4.5 parts --.

Column 45,
Line 64, "6.5 pats" should read -- 6.5 parts --.

UNITED STATES PATENT AND TRADEMARK OFFICE

CERTIFICATE OF CORRECTION

PATENT NO. : 6,569,589 B2
DATED : May 27, 2003
INVENTOR(S) : Koji Inaba et al.

It is certified that error appears in the above-identified patent and that said Letters Patent is hereby corrected as shown below:

Column 46,
Line 45, "6.5 pats" should read -- 6.5 parts --.

Column 48,
Line 17, "was" should read -- were --.

Column 49,
Line 63, "45 pats" should read -- 45 parts --.

Column 53,
Line 10, "deionized" should read -- deionized water --.

Column 54,
Line 29, "means" should read -- means of --; and
Line 48, "an" should read -- and --.

Column 56,
Line 17, "blister" should read -- blisters --; and
Line 37, "blister" should read -- blisters --.

Column 61,
Table 6:

"

| | | Chargeability (mC/kg) | | | | | | | | |
|---|---|---|---|---|---|---|---|---|---|---|
| | | A: 13° C./10% RH | | | B: 20° C./60% RH | | | C: 32° C./80% RH | | |
| | | 24 hr | 7 days | | 24 hr | 7 days | | 24 hr | 7 days | |
| Comp. Ex. | Toner times | 150 time | 1 times | 150 times | 150 time | 1 times | 150 times | 150 time | 1 times | 150 times |

"

should read

--

| Comp. Ex. | Toner No. | Chargeability (mC/kg) | | | | | | | | |
|---|---|---|---|---|---|---|---|---|---|---|
| | | A: 13° C /10% RH | | | B: 20° C/60%RH | | | C: 32° C/80% RH | | |
| | | 24hr | 7 days | | 24hr | 7 days | | 24hr | 7 days | |
| | | 150 times | 1 time | 150 times | 150 times | 1 time | 150 times | 150 times | 1 time | 150 times |

--.

UNITED STATES PATENT AND TRADEMARK OFFICE

CERTIFICATE OF CORRECTION

PATENT NO. : 6,569,589 B2
DATED : May 27, 2003
INVENTOR(S) : Koji Inaba et al.

It is certified that error appears in the above-identified patent and that said Letters Patent is hereby corrected as shown below:

Column 63,
Line 12, "$5 \times 10^2$" should read -- $1 \times 10^3$ to $7 \times 10^4$. --; and
Line 49, "contain" should read -- contains --.

Signed and Sealed this

Twenty-third Day of December, 2003

JAMES E. ROGAN
*Director of the United States Patent and Trademark Office*